US008244509B2

(12) United States Patent
Banerjee et al.

(10) Patent No.: US 8,244,509 B2
(45) Date of Patent: Aug. 14, 2012

(54) METHOD FOR MANAGING PRODUCTION FROM A HYDROCARBON PRODUCING RESERVOIR IN REAL-TIME

(75) Inventors: Raj Banerjee, Abingdon (GB); Michael Thambynayagam, Sugar Land, TX (US); Jeffrey Spath, Missouri City, TX (US); Bobby Poe, Houston, TX (US); Lumay Viloria, Manvel, TX (US); Greg Grove, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 630 days.

(21) Appl. No.: 12/182,885

(22) Filed: Jul. 30, 2008

(65) Prior Publication Data

US 2009/0084545 A1 Apr. 2, 2009

Related U.S. Application Data

(63) Continuation-in-part of application No. 11/924,560, filed on Oct. 25, 2007, now Pat. No. 8,145,463.

(60) Provisional application No. 60/953,449, filed on Aug. 1, 2007, provisional application No. 60/956,070, filed on Aug. 15, 2007, provisional application No. 61/027,801, filed on Feb. 11, 2008.

(51) Int. Cl.

| | |
|---|---|
| ***G06G 7/50*** | (2006.01) |
| ***G06G 7/48*** | (2006.01) |
| ***G05B 11/01*** | (2006.01) |

(52) U.S. Cl. ..... 703/9; 703/10; 702/11; 702/12

(58) Field of Classification Search ..... 703/9–10; 702/11–12

See application file for complete search history.

(56) References Cited

U.S. PATENT DOCUMENTS 2,727,682 A 12/1955 Patterson
3,373,805 A * 3/1968 Boberg et al. ..... 166/303

(Continued)

FOREIGN PATENT DOCUMENTS

GB 2309562 A 7/1997

(Continued)

OTHER PUBLICATIONS

Definition: Fredholm integral equation, http://en.wikipedia.org/wiki/Fredholm_integral_equation, pp. 1-2. retrieved Jan. 26, 2011.*

(Continued)

*Primary Examiner* — Kamini S Shah
*Assistant Examiner* — Akash Saxena
(74) *Attorney, Agent, or Firm* — Colin L. Wier

(57) ABSTRACT

The invention relates to a method of performing an oilfield operation of an oilfield having at least one wellsite, each wellsite having a wellbore penetrating a subterranean formation for extracting fluid from an underground reservoir therein. The method steps include obtaining a plurality of real-time parameters from a plurality of sensors disposed about the oilfield, wherein the plurality of real-time parameters comprise at least one selected from a group consisting of real-time flow rate data and real-time pressure data of the wellbore, configuring a gridless analytical simulator for simulating the underground reservoir based on the plurality of real-time parameters, generating real-time simulation results of the underground reservoir and the at least one wellsite in real-time using the gridless analytical simulator, and performing the oilfield operation based on the real-time simulation results.

30 Claims, 8 Drawing Sheets

U.S. PATENT DOCUMENTS

| | | | | |
|---|---|---|---|---|
| 4,518,039 | A * | 5/1985 | Graham et al. | 166/276 |
| 4,828,028 | A * | 5/1989 | Soliman | 166/250.1 |
| 5,414,674 | A * | 5/1995 | Lichman | 367/49 |
| 5,501,273 | A * | 3/1996 | Puri | 166/252.5 |
| 5,787,050 | A | 7/1998 | Slevinsky | |
| 5,960,369 | A | 9/1999 | Samaroo | |
| 5,992,519 | A | 11/1999 | Ramakrishnan et al. | |
| 6,002,985 | A * | 12/1999 | Stephenson | 702/13 |
| 6,018,497 | A | 1/2000 | Gunasekera et al. | |
| 6,041,017 | A | 3/2000 | Goldsberry | |
| 6,052,520 | A | 4/2000 | Watts, III | |
| 6,078,869 | A | 6/2000 | Gunasekera et al. | |
| 6,106,561 | A | 8/2000 | Farmer et al. | |
| 6,128,580 | A | 10/2000 | Thomsen | |
| 6,131,071 | A | 10/2000 | Partyka et al. | |
| 6,135,966 | A * | 10/2000 | Ko | 600/481 |
| 6,230,101 | B1 | 5/2001 | Wallis | |
| 6,263,284 | B1 | 7/2001 | Crider et al. | |
| 6,313,837 | B1 | 11/2001 | Assa et al. | |
| 6,356,844 | B2 * | 3/2002 | Thomas et al. | 702/12 |
| 6,374,185 | B1 * | 4/2002 | Taner et al. | 702/6 |
| 6,498,989 | B1 | 12/2002 | Pisetski et al. | |
| 6,502,037 | B1 | 12/2002 | Jorgensen et al. | |
| 6,591,201 | B1 * | 7/2003 | Hyde | 702/45 |
| 6,724,687 | B1 * | 4/2004 | Stephenson et al. | 166/250.1 |
| 6,799,117 | B1 * | 9/2004 | Proett et al. | 702/12 |
| 6,842,700 | B2 | 1/2005 | Poe | |
| 6,901,391 | B2 * | 5/2005 | Storm et al. | 706/16 |
| 6,957,577 | B1 * | 10/2005 | Firmin | 73/152.51 |
| 6,980,940 | B1 | 12/2005 | Gurpinar et al. | |
| 7,062,420 | B2 | 6/2006 | Poe, Jr. | |
| 7,069,148 | B2 | 6/2006 | Thambynayagam et al. | |
| 7,079,952 | B2 | 7/2006 | Thomas | |
| 7,134,496 | B2 * | 11/2006 | Jones et al. | 166/278 |
| 7,164,990 | B2 | 1/2007 | Bratvedt et al. | |
| 7,299,131 | B2 * | 11/2007 | Tabarovsky et al. | 702/7 |
| 7,363,162 | B2 | 4/2008 | Thambynayagam et al. | |
| 7,369,979 | B1 * | 5/2008 | Spivey | 703/9 |
| 7,774,140 | B2 * | 8/2010 | Craig | 702/11 |
| 7,890,264 | B2 * | 2/2011 | Elphick | 702/12 |
| 2002/0050993 | A1 | 5/2002 | Kennon et al. | |
| 2002/0099505 | A1 * | 7/2002 | Thomas et al. | 702/12 |
| 2003/0047308 | A1 * | 3/2003 | Hirsch et al. | 166/250.15 |
| 2003/0132934 | A1 | 7/2003 | Fremming | |
| 2003/0216897 | A1 | 11/2003 | Endres et al. | |
| 2004/0006429 | A1 * | 1/2004 | Brown | 702/12 |
| 2004/0111216 | A1 * | 6/2004 | Kneissl et al. | 702/12 |
| 2004/0117121 | A1 * | 6/2004 | Gray et al. | 702/11 |
| 2004/0138819 | A1 * | 7/2004 | Goswami et al. | 702/10 |
| 2004/0153437 | A1 * | 8/2004 | Buchan | 707/1 |
| 2004/0220846 | A1 | 11/2004 | Cullick et al. | |
| 2005/0043892 | A1 * | 2/2005 | Lichman et al. | 702/13 |
| 2005/0049838 | A1 * | 3/2005 | Danko | 703/2 |
| 2005/0149307 | A1 | 7/2005 | Gurpinar et al. | |
| 2006/0069511 | A1 * | 3/2006 | Thambynayagam et al. | 702/12 |
| 2006/0129366 | A1 | 6/2006 | Shaw | |
| 2006/0184329 | A1 | 8/2006 | Rowan et al. | |
| 2006/0197759 | A1 | 9/2006 | Fremming | |
| 2007/0112442 | A1 * | 5/2007 | Zhan et al. | 700/29 |
| 2007/0112547 | A1 | 5/2007 | Ghorayeb et al. | |
| 2008/0120076 | A1 | 5/2008 | Thambynayagam et al. | |
| 2008/0162099 | A1 * | 7/2008 | Vega Velasquez | 703/10 |
| 2008/0183451 | A1 * | 7/2008 | Weng et al. | 703/10 |
| 2008/0306892 | A1 * | 12/2008 | Crossley et al. | 706/16 |
| 2009/0084544 | A1 * | 4/2009 | Caldera | 703/10 |
| 2009/0234584 | A1 * | 9/2009 | Casey et al. | 702/12 |
| 2009/0276156 | A1 * | 11/2009 | Kragas et al. | 702/6 |
| 2009/0312996 | A1 * | 12/2009 | Guyaguler et al. | 703/10 |
| 2010/0145667 | A1 * | 6/2010 | Niu et al. | 703/5 |

FOREIGN PATENT DOCUMENTS

| | | |
|---|---|---|
| GB | 2336008 | 10/1999 |
| WO | 9964896 | 12/1999 |
| WO | 2004049216 | 6/2004 |
| WO | 2005122001 | 12/2005 |

OTHER PUBLICATIONS

Definition: Volterra integral equation, http://en.wikipedia.org/wiki/Volterra_equation pp. 1-2, retrieved Jan. 26, 2010.*

Saputellil; "Real-time reservoir management: a multiscale adaptive optimization and control approach"; Computational Geosciences, Mar. 2006, vol. 10, No. 1, pp. 61-96.

Klie; "Models, methods and middleware for grid-enabled multiphysics oil reservoir managment"; Engineering with Computers, Dec. 2006, vol. 22, Issue 3, pp. 349-370.

Saputellil; "Real-time, decision-making for value creation while drilling"; SPE International, 2003, SPE/IADC 85314, pp. 1-19.

Examination Report of Canadian Serial No. 2,694,336 dated Jul. 8, 2011.

Examination Report of Eurasian Serial No. 201070207 dated Jul. 15, 2011.

Search Report and Written Opinion of PCT Serial No. PCT/US04/38762 dated Sep. 6, 2005.

Search Report and Written Opinion of PCT Serial No. PCT/US2008/071774 dated Dec. 23, 2008.

Supplementary Search Report of European Serial No. 04811474.8 dated Sep. 17, 2009.

* cited by examiner

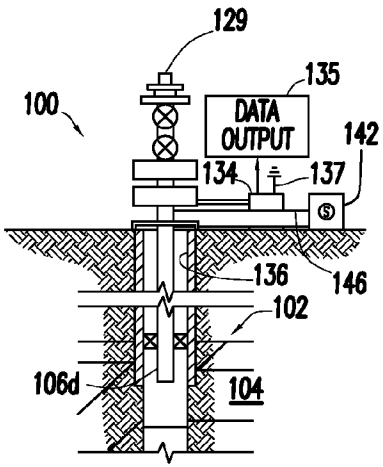
FIG. 1A
FIG. 1B
FIG. 1C
FIG. 1D
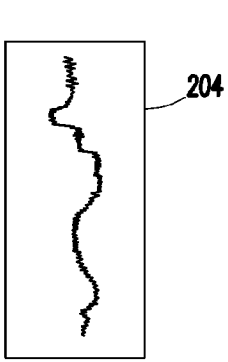
FIG. 2A
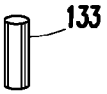
FIG. 2B
FIG. 2C
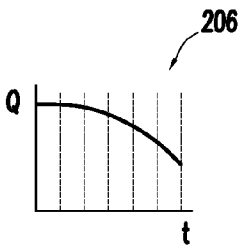
FIG. 2D

METHOD FOR MANAGING PRODUCTION FROM A HYDROCARBON PRODUCING RESERVOIR IN REAL-TIME

CROSS REFERENCE TO RELATED APPLICATIONS

This application claims priority under 35 U.S.C. §119(e) from Provisional Patent Application Nos. 60/953,449 filed Aug. 1, 2007, 60/956,070 filed Aug. 15, 2007, and 61/027,801 filed Feb. 11, 2008. This is a continuation-in-part (CIP) application of and claims priority under 35 U.S.C. §120 to U.S. patent application Ser. No. 11/924,560 filed on Oct. 25, 2007.

BACKGROUND

1. Field of the Invention

The present invention relates to techniques for performing oilfield operations relating to subterranean formations having reservoirs therein. More particularly, the invention relates to techniques for performing oilfield operations involving an analysis of reservoir operations, and their impact on such oilfield operations.

2. Background of the Related Art

Oilfield operations, such as surveying, drilling, wireline testing, completions, production, planning and oilfield analysis, are typically performed to locate and gather valuable downhole fluids. Various aspects of the oilfield and its related operations are shown in FIGS. 1A-1D. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

As shown in FIG. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing.

After the drilling operation is complete, the well may then be prepared for production. As shown in FIG. 1D, wellbore completions equipment is deployed into the wellbore to complete the well in preparation for the production of fluid therethrough. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipment may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to, for example, formation structure and geological stratigraphy that define the geological structure of the subterranean formation. Dynamic data relates to, for example, fluids flowing through the geologic structures of the subterranean formation over time. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples may be used to take physical specimens of the formation at various depths as shown in FIG. 1B. Well logging typically involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the drilling equipment may monitor drilling conditions, sensors in the wellbore may monitor fluid composition, sensors located along the flow path may monitor flow rates, and sensors at the processing facility may monitor fluids collected. Other sensors may be provided to monitor downhole, surface, equipment or other conditions.

The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other operations and/or conditions. Often this information is used to determine when to drill new wells, re-complete existing wells, or alter wellbore production.

Data from one or more wellbores may be analyzed to plan or predict various outcomes at a given wellbore. In some cases, the data from neighboring wellbores or wellbores with similar conditions or equipment may be used to predict how a well will perform. There are usually a large number of variables and large quantities of data to consider in analyzing oilfield operations. It is, therefore, often useful to model the behavior of the oilfield operation to determine the desired course of action. During the ongoing operations, the operating conditions may need adjustment as conditions change and new information is received.

Techniques have been developed to model the behavior of various aspects of the oilfield operations, such as geological structures, downhole reservoirs, wellbores, surface facilities as well as other portions of the oilfield operation. Typically, there are different types of simulators for different purposes. For example, there are simulators that focus on reservoir properties, wellbore production, or surface processing. Examples of simulators that may be used at the wellsite are described in U.S. Pat. No. 5,992,519 and WO2004049216. Other examples of these modeling techniques are shown in U.S. Pat. Nos. 5,992,519, 6,313,837, WO1999/064896, WO2005/122001, US2003/0216897, US2003/0132934, US2005/0149307, and US2006/0197759.

Recent attempts have been made to consider a broader range of data in oilfield operations. For example, U.S. Pat. No. 6,842,700 to Poe describes a method for evaluating a well and a reservoir without the need for well pressure history. In another example, US2006/0069511 to Thambynayagam discloses a gas reservoir evaluation and assessment tool. Other examples of such recent attempts are disclosed in U.S. Pat. Nos. 6,018,497, 6,078,869, 6,106,561, 6,230,101, 6,980,940, 7,164,990, GB2336008, US2004/0220846, US2006/0129366, US2006/0184329, U.S. Ser. No. 10/586,283, and WO04049216.

Despite the development and advancement of wellbore modeling and/or simulation techniques, many of which employ finite difference numerical methods to construct reservoir models, there remains a need to provide techniques capable of performing real-time simulations for the oilfield operation. It would be desirable to have a system that performs simulations that consider data throughout the oilfield operation. In some cases, it may be desirable to continuously monitor and analyze oilfield data, anticipate and identify events, and to perform real-time diagnostics and interpretation of the oilfield data. In other cases, it may be desirable to support real-time decision making for performing oilfield operations. It is further desirable that such techniques be capable of one of more of the following, among others: taking into consideration the effects of production from other wells in the same reservoir; updating the reservoir model based on history matching; and automatic workflow with real-time plotting of key parameters against time and real-time alarms based on pre-determined criteria.

SUMMARY

In general, in one aspect, the invention relates to a method of performing an oilfield operation of an oilfield having at least one wellsite, each wellsite having a wellbore penetrating a subterranean formation for extracting fluid from an underground reservoir therein. The method steps include obtaining a plurality of real-time parameters from a plurality of sensors disposed about the oilfield, wherein the plurality of real-time parameters comprise at least one selected from a group consisting of real-time flow rate data and real-time pressure data of the wellbore, configuring a gridless analytical simulator for simulating the underground reservoir based on the plurality of real-time parameters, generating real-time simulation results of the underground reservoir and the at least one wellsite in real-time using the gridless analytical simulator, and performing the oilfield operation based on the real-time simulation results.

In general, in one aspect, the invention relates to a method of performing an oilfield operation of an oilfield having a plurality of wellsites, each wellsite having a wellbore penetrating a subterranean formation for extracting fluid from an underground reservoir therein. The method steps include obtaining real-time pressure data from a permanent down-hole pressure gauge, identifying a reservoir model for a gridless analytical simulator based on a rate of change of the real-time pressure data using a neural network method, generating real-time simulation results of the underground reservoir and the plurality of wellsites in real-time using the gridless analytical simulator, and performing the oilfield operation based on the real-time simulation results.

In general, in one aspect, the invention relates to a method of performing an oilfield operation of an oilfield having a plurality of gas wells, each gas well having a wellbore penetrating a subterranean formation for extracting gas from an underground reservoir therein. The method steps include obtaining real-time flow rate data from a flow meter, obtaining at least one selected from a group consisting of real-time pressure data and offline pressure data, generating a first simulation result of the underground reservoir and the plurality of gas wells using a non-linear regression model with the real-time flow rate data, and the real-time pressure data, and the offline pressure data if the real-time pressure data is not available, identifying a reservoir model for a gridless analytical simulator using a neural network method if the real-time pressure data is available, generating a second simulation result of the reservoir and the plurality of gas wells in real-time using the gridless analytical simulator, and performing the oilfield operation based on at least one selected from a group consisting of the first simulation result and the second simulation result.

In general, in one aspect, the invention relates to a computer readable medium, embodying instructions executable by a computer to perform method steps for an oilfield operation, the oilfield having at least one wellsite, each of the at least one wellsite having a wellbore penetrating a subterranean formation for extracting fluid from an underground reservoir therein. The instructions include functionality to obtain a plurality of real-time parameters from a plurality of sensors disposed about the oilfield, wherein the plurality of real-time parameters comprise at least one selected from a group consisting of flow rate and pressure of the wellbore, configure a gridless analytical simulator for simulating the reservoir based on the plurality of real-time parameters, and generate real-time simulation results of the reservoir and the at least one wellsite in real-time using the gridless analytical simulator, wherein the oilfield operation is performed based on the real-time simulation results.

In general, in one aspect, the invention relates to a computer readable medium, embodying instructions executable by a computer to perform method steps for an oilfield operation, the oilfield having a plurality of wellsites, each of the plurality of wellsites having a wellbore penetrating a subterranean formation for extracting fluid from an underground reservoir therein. The instructions include functionality to obtain real-time pressure data from a permanent down-hole pressure gauge, identify a reservoir model for a gridless analytical simulator based on a rate of change of the real-time pressure data using a neural network method, generate real-time simulation results of the reservoir and the plurality of wellsites in real-time using the gridless analytical simulator, and perform the oilfield operation based on the real-time simulation results.

In general, in one aspect, the invention relates to a computer readable medium, embodying instructions executable by a computer to perform method steps for an oilfield operation, the oilfield having a plurality of gas wells, each of the plurality of gas wells having a wellbore penetrating a subterranean formation for extracting gas from an underground reservoir therein. The instructions include functionality to obtain real-time flow rate data from a flow meter, obtain at least one selected from a group consisting of real-time pressure data and offline pressure data, generate a first simulation result of the underground reservoir and the plurality of gas wells using a non-linear regression model with the real-time flow rate data, and the real-time pressure data, and the offline pressure data if the real-time pressure data is not available, identify a reservoir model for a gridless analytical simulator using a neural network method if the real-time pressure data is available, generate a second simulation result of the reservoir and the plurality of gas wells in real-time using the gridless analytical simulator, and perform the oilfield operation based on at least one selected from a group consisting of the first simulation result and the second simulation result.

Other aspects and advantages of the invention will be apparent from the following description and the appended claims.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 1A-1D show exemplary schematic views of an oilfield having subterranean structures including reservoirs therein and various oilfield operations being performed on the oilfield. FIG. 1A depicts an exemplary survey operation being performed by a seismic truck. FIG. 1B depicts an exemplary drilling operation being performed by a drilling tool suspended by a rig and advanced into the subterranean formation. FIG. 1C depicts an exemplary wireline operation being performed by a wireline tool suspended by the rig and into the wellbore of FIG. 1B. FIG. 1D depicts an exemplary production operation being performed by a production tool being deployed from the rig and into a completed wellbore for drawing fluid from the downhole reservoir into a surface facility.

FIGS. 2A-2D are exemplary graphical depictions of data collected by the tools of FIGS. 1A-1D, respectively. FIG. 2A depicts an exemplary seismic trace of the subterranean formation of FIG. 1A. FIG. 2B depicts exemplary core sample of the formation shown in FIG. 1B. FIG. 2C depicts an exemplary well log of the subterranean formation of FIG. 1C. FIG. 2D depicts an exemplary production decline curve of fluid flowing through the subterranean formation of FIG. 1D.

DETAILED DESCRIPTION

Figure 3:
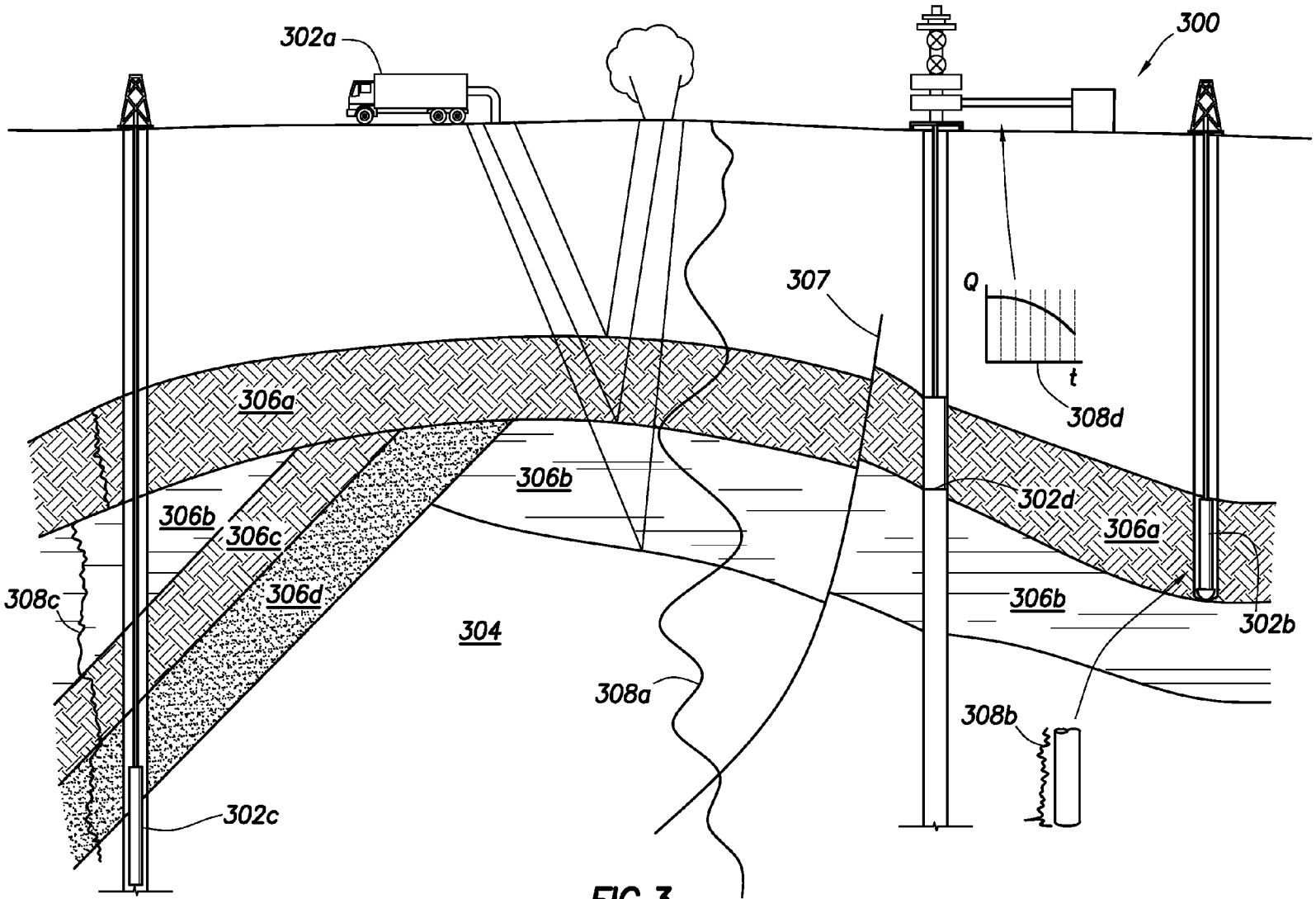
FIG. 3 shows an exemplary schematic view, partially in cross section, of an oilfield having a plurality of data acquisition tools positioned at various locations along the oilfield for collecting data from the subterranean formation.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

FIGS. 1A-D show an oilfield (100) having geological structures and/or subterranean formations therein. As shown in these figures, various measurements of the subterranean formation are taken by different tools at the same location. These measurements may be used to generate information about the formation and/or the geological structures and/or fluids contained therein.

FIGS. 1A-1D depict schematic views of an oilfield (100) having subterranean formations (102) containing a reservoir (104) therein and depicting various oilfield operations being performed on the oilfield (100). FIG. 1A depicts a survey operation being performed by a seismic truck (106*a*) to measure properties of the subterranean formation. The survey operation is a seismic survey operation for producing sound vibration(s) (112). In FIG. 1A, one such sound vibration (112) is generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1.

In response to the received sound vibration(s) (112) representative of different parameters (such as amplitude and/or frequency) of the sound vibration(s) (112). The data received (120) is provided as input data to a computer (122*a*) of the seismic recording truck (106*a*), and responsive to the input data, the recording truck computer (122*a*) generates a seismic data output record (124). The seismic data may be further processed as desired, for example by data reduction.

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool (106*b*) via flow line (132) for circulating drilling mud through the drilling tool (106*b*) and back to the surface. The drilling tool (106*b*) is advanced into the formation to reach reservoir (104). The drilling tool (106*b*) is preferably adapted for measuring downhole properties. The drilling tool (106*b*) may also be adapted for taking a core sample (133), as shown, or removed so that a core sample (133) may be taken using another tool.

A surface unit (134) is used to communicate with the drilling tool (106*b*) and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield (100). The surface unit (134) collects data output (135) generated during the drilling operation. Computer facilities, such as those of the surface unit (134), may be positioned at various locations about the oilfield (100) and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions and other parameters of the oilfield operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting oilfield operations of the current and/or other wellbores.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, reservoir engineering, and/or production simulations. The reservoir, wellbore, surface and/or process data may be used to perform reservoir, wellbore, or other production simulations. The data outputs from the oilfield operation may be generated directly from the sensors (S), or after some preprocessing or modeling. These data outputs may act as inputs for further analysis.

The data is collected and stored at the surface unit (134). One or more surface units (134) may be located at the oilfield (100), or linked remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions (or regions) of the oilfield (100) or other locations. The surface unit (134) may also be provided with or functionally linked to a controller for actuating mechanisms at the oilfield (100). The surface unit (134) may then send command signals to the oilfield (100) in response to data received. The surface unit (134) may receive commands via the transceiver or may itself execute commands to the controller. A processor may be provided to analyze the data (locally or remotely) and make the decisions to actuate the controller. In this manner, the oilfield (100) may be selectively adjusted based on the data collected to optimize fluid recovery rates, or to maximize the longevity of the reservoir and its ultimate production capacity. These adjustments may be made automatically based on computer protocol, or manually by an operator. In some cases, well plans may be adjusted to select optimum operating conditions, or to avoid problems.

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (143) that provides electrical signals to the surrounding subterranean formations (102).

The wireline tool (106*c*) may be operatively linked to, for example, the geophones (118) stored in the computer (122*a*) of the seismic recording truck (106*a*) of FIG. 1A. The wireline tool (106*c*) may also provide data to the surface unit (134). As shown, data output (135) is generated by the wireline tool (106*c*) and collected at the surface. The wireline tool (106*c*) may be positioned at various depths in the wellbore (136) to provide a survey of the subterranean formation.

FIG. 1D depicts a production operation being performed by a production tool (106*d*) deployed from a production unit or christmas tree (129) and into the completed wellbore (136) of FIG. 1C for drawing fluid from the downhole reservoirs into the surface facilities (142). Fluid flows from reservoir (104) through perforations in the casing (not shown) and into the production tool (106*d*) in the wellbore (136) and to the surface facilities (142) via a gathering network (146).

Sensors (S), such as gauges, may be positioned about the oilfield to collect data relating to various oilfield operations as described previously. As shown, the sensor (S) may be positioned in the production tool (106*d*) or associated equipment, such as the Christmas tree, gathering network, surface facilities and/or the production facility, to measure fluid parameters, such as fluid composition, flow rates, pressures, temperatures, and/or other parameters of the production operation.

While only simplified wellsite configurations are shown, it will be appreciated that the oilfield may cover a portion of land, sea, and/or water locations that hosts one or more wellsites. Production may also include injection wells (not shown) for added recovery. One or more gathering facilities may be operatively connected to one or more of the wellsites for selectively collecting downhole fluids from the wellsite(s).

During the production process, data output (135) may be collected from various sensors (S) and passed to the surface unit (134) and/or processing facilities. This data may be, for example, reservoir data, wellbore data, surface data, and/or process data.

While FIGS. 1A-1D depict monitoring tools used to measure properties of an oilfield (100), it will be appreciated that the tools may be used in connection with non-oilfield operations, such as mines, aquifers or other subterranean facilities. Also, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors (S) may be located at various positions along the subterranean formation and/or the monitoring tools to collect and/or monitor the desired data. Other sources of data may also be provided from offsite locations.

The oilfield configuration in FIGS. 1A-1D is not intended to limit the scope of the invention. Part, or all, of the oilfield (100) may be on land and/or sea. Also, while a single oilfield at a single location is depicted, the present invention may be used with any combination of one or more oilfields (100), one or more processing facilities and one or more wellsites. Additionally, while only one wellsite is shown, it will be appreciated that the oilfield (100) may cover a portion of land that hosts one or more wellsites. One or more gathering facilities may be operatively connected to one or more of the wellsites for selectively collecting downhole fluids from the wellsite(s).

FIGS. 2A-2D are graphical depictions of data collected by the tools of FIGS. 1A-D, respectively. FIG. 2A depicts a seismic trace (202) of the subterranean formation of FIG. 1A taken by survey tool (106*a*). The seismic trace measures a two-way response over a period of time. FIG. 2B depicts a core sample (133) taken by the drilling tool (106*b*). The core test typically provides a graph of the density, resistivity, or other physical property of the core sample (133) over the length of the core. Tests for density and viscosity are often performed on the fluids in the core at varying pressures and temperatures. FIG. 2C depicts a well log (204) of the subterranean formation of FIG. 1C taken by the wireline tool (106*c*). The wireline log typically provides a resistivity measurement of the formation at various depths. FIG. 2D depicts a production decline curve (206) of fluid flowing through the subterranean formation of FIG. 1D taken by the production tool (106*d*). The production decline curve (206) typically provides the production rate Q as a function of time t.

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

FIG. 3 is a schematic view, partially in cross section of an oilfield (300) having data acquisition tools (302*a*), (302*b*), (302*c*), and (302*d*) positioned at various locations along the oilfield for collecting data of a subterranean formation (304). The data acquisition tools (302*a*-302*d*) may be the same as data acquisition tools (106*a*-106*d*) of FIG. 1, respectively. As shown, the data acquisition tools (302*a*-302*d*) generate data plots or measurements (308*a*-308*d*), respectively.

Data plots (308*a*-308*c*) are examples of static data plots that may be generated by the data acquisition tools (302*a*-302*d*), respectively. Static data plot (308*a*) is a seismic two-way response time and may be the same as the seismic trace (202) of FIG. 2A. Static plot (308*b*) is core sample data measured from a core sample of the formation (304), similar to the core sample (133) of FIG. 2B. Static data plot (308*c*) is a logging trace, similar to the well log (204) of FIG. 2C. Data plot (308*d*) is a dynamic data plot of the fluid flow rate over time, similar to the graph (206) of FIG. 2D. Other data may also be collected, such as historical data, user inputs, economic information, other measurement data, and other parameters of interest.

The subterranean formation (304) has a plurality of geological structures (306*a*-306*d*). As shown, the formation has a sandstone layer (306*a*), a limestone layer (306*b*), a shale layer (306*c*), and a sand layer (306*d*). A fault line (307) extends through the formation. The static data acquisition tools are preferably adapted to measure the formation and detect the characteristics of the geological structures of the formation.

While a specific subterranean formation (304) with specific geological structures are depicted, it will be appreciated that the formation may contain a variety of geological structures. Fluid may also be present in various portions of the formation. Each of the measurement devices may be used to measure properties of the formation and/or its underlying structures. While each acquisition tool is shown as being in specific locations along the formation, it will be appreciated that one or more types of measurement may be taken at one or more location across one or more oilfields or other locations for comparison and/or analysis.

The data collected from various sources, such as the data acquisition tools of FIG. 3, may then be evaluated. Typically, seismic data displayed in the static data plot (308*a*) from the data acquisition tool (302*a*) is used by a geophysicist to determine characteristics of the subterranean formation (304). Core data shown in static plot (308*b*) and/or log data from the well log (308*c*) is typically used by a geologist to determine various characteristics of the geological structures of the subterranean formation (304). Production data from the production graph (308*d*) is typically used by the reservoir engineer to determine fluid flow reservoir characteristics.

Figure 4:
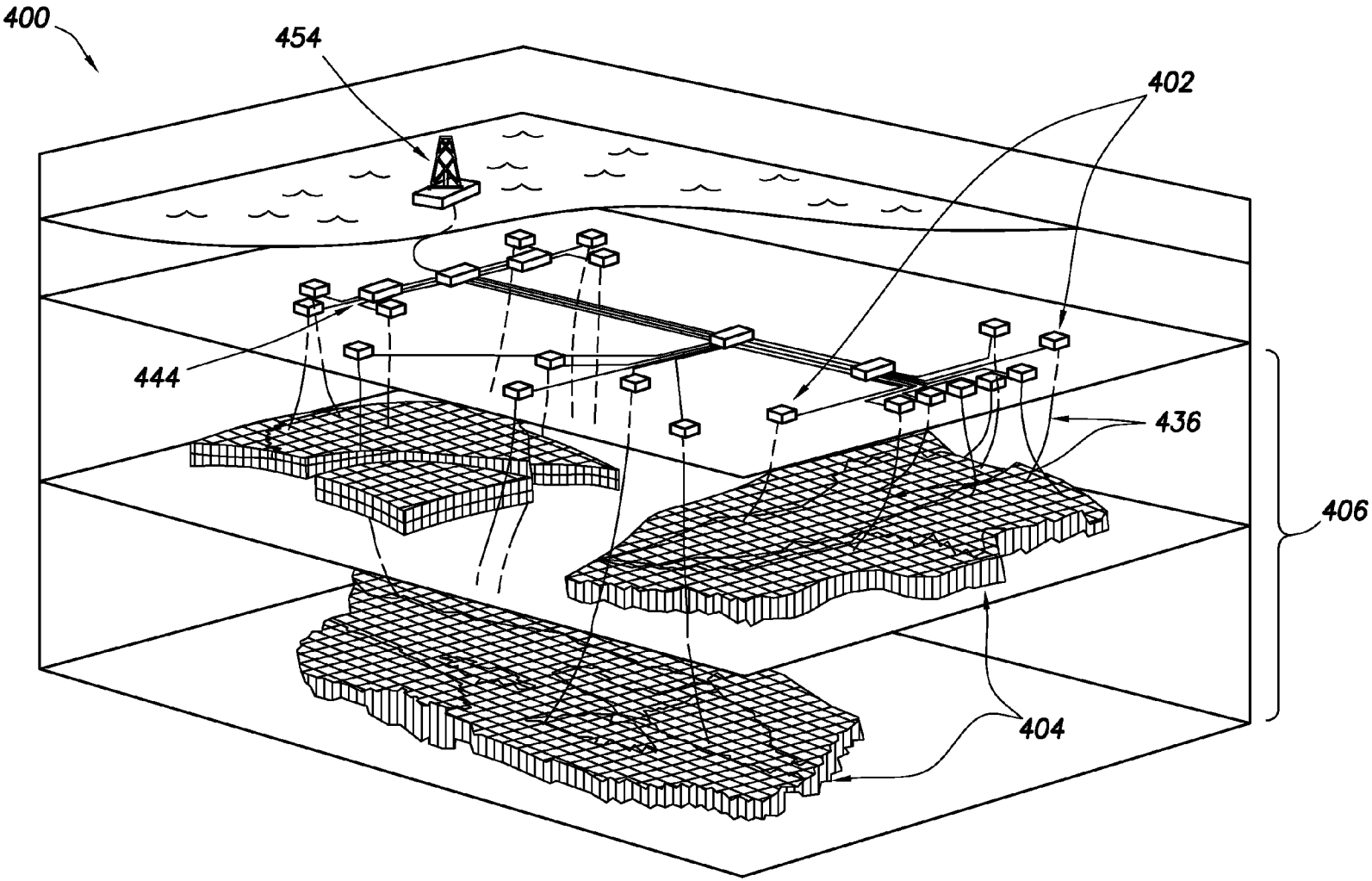
FIG. 4 shows an exemplary schematic view of an oilfield having a plurality of wellsites for producing hydrocarbons from the subterranean formation.

FIG. 4 shows an oilfield (400) for performing production operations. As shown, the oilfield has a plurality of wellsites (402) operatively connected to a central processing facility (454). The oilfield configuration of FIG. 4 is not intended to limit the scope of the invention. Part or all of the oilfield may be on land and/or sea. Also, while a single oilfield with a single processing facility and a plurality of wellsites is depicted, any combination of one or more oilfields, one or more processing facilities and one or more wellsites may be present.

Each wellsite (402) has equipment that forms a wellbore (436) into the earth. The wellbores extend through subterranean formations (406) including reservoirs (404). These reservoirs (404) contain fluids, such as hydrocarbons. The wellsites draw fluid from the reservoirs and pass them to the processing facilities via surface networks (444). The surface networks (444) have tubing and control mechanisms for controlling the flow of fluids from the wellsite to the processing facility (454).

Figure 5:
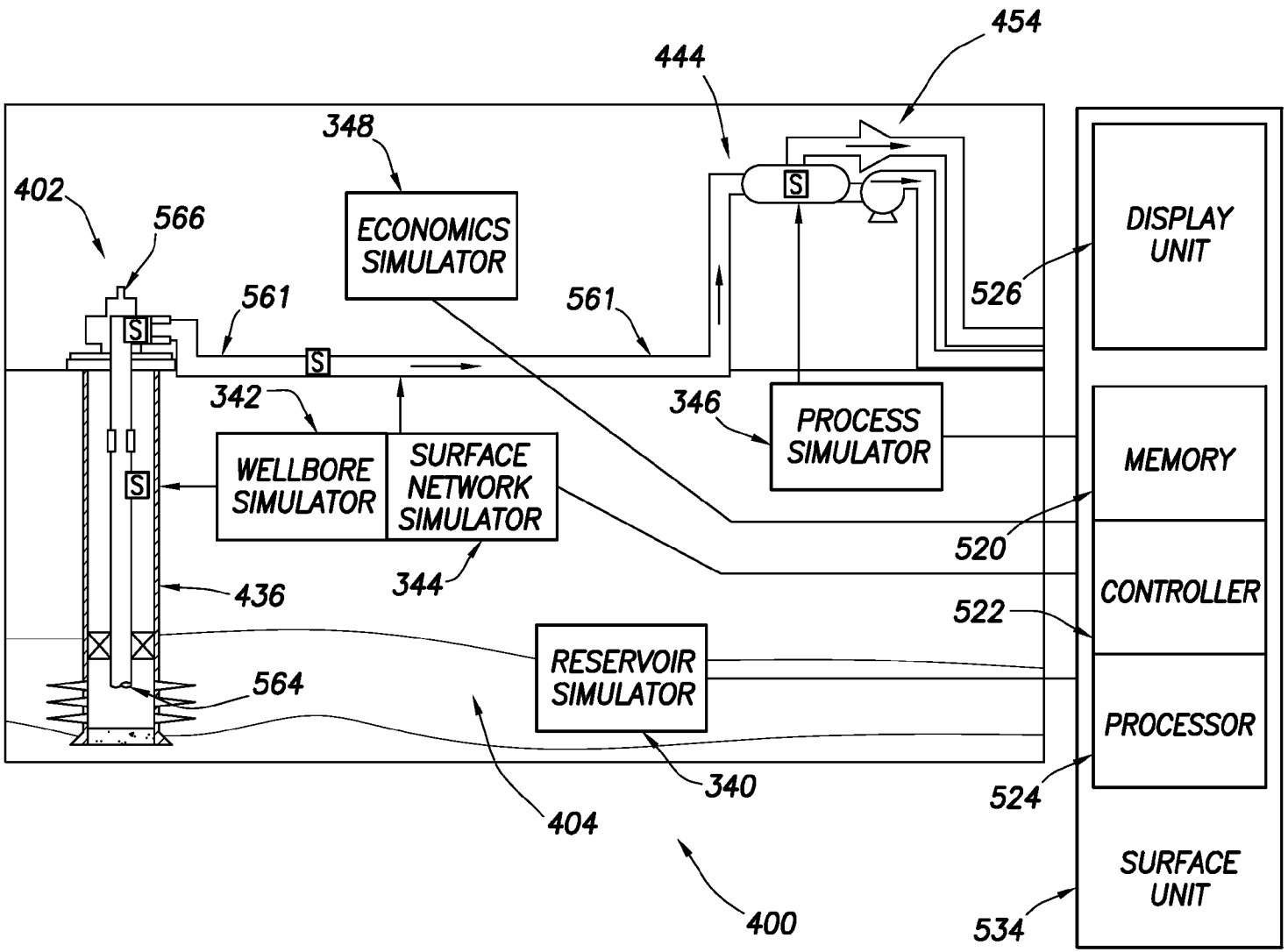
FIG. 5 shows an exemplary schematic diagram of a portion of the oilfield of FIG. 4 depicting the production operation in detail.

FIG. 5 shows a schematic view of a portion (or region) of the oilfield (400) of FIG. 4, depicting a producing wellsite (402) and surface network (444) in detail. The wellsite (402) of FIG. 5 has a wellbore (436) extending into the earth therebelow. As shown, the wellbores (436) has already been drilled, completed, and prepared for production from reservoir (404).

Wellbore production equipment (564) extends from a wellhead (566) of wellsite (402) and to the reservoir (404) to draw fluid to the surface. The wellsite (402) is operatively connected to the surface network (444) via a transport line (561). Fluid flows from the reservoir (404), through the wellbore (436), and onto the surface network (444). The fluid then flows from the surface network (444) to the process facilities (454).

As further shown in FIG. 5, sensors (S) are located about the oilfield (400) to monitor various parameters during oilfield operations. The sensors (S) may measure, for example, pressure, temperature, flow rate, composition, and other parameters of the reservoir, wellbore, surface network, process facilities and/or other portions (or regions) of the oilfield operation. These sensors (S) are operatively connected to a surface unit (534) for collecting data therefrom. The surface unit may be, for example, similar to the surface unit (134) of FIGS. 1A-D.

One or more surface units (534) may be located at the oilfield (400), or linked remotely thereto. The surface unit (534) may be a single unit, or a complex network of units used to perform the necessary data management functions throughout the oilfield (400). The surface unit may be a manual or automatic system. The surface unit may be operated and/or adjusted by a user. The surface unit is adapted to receive and store data. The surface unit may also be equipped to communicate with various oilfield equipment. The surface unit may then send command signals to the oilfield in response to data received or modeling performed.

As shown in FIG. 5, the surface unit (534) has computer facilities, such as memory (520), controller (522), processor (524), and display unit (526), for managing the data. The data is collected in memory (520), and processed by the processor (524) for analysis. Data may be collected from the oilfield sensors (S) and/or by other sources. For example, oilfield data may be supplemented by historical data collected from other operations, or user inputs.

The analyzed data (e.g., based on modeling performed) may then be used to make decisions. A transceiver (not shown) may be provided to allow communications between the surface unit (534) and the oilfield (400). The controller (522) may be used to actuate mechanisms at the oilfield (400) via the transceiver and based on these decisions. In this manner, the oilfield (400) may be selectively adjusted based on the data collected. These adjustments may be made automatically based on computer protocol and/or manually by an operator. In some cases, well plans are adjusted to select optimum operating conditions or to avoid problems.

To facilitate the processing and analysis of data, simulators may be used to process the data for modeling various aspects of the oilfield operation. Specific simulators are often used in connection with specific oilfield operations, such as reservoir or wellbore simulation. Data fed into the simulator(s) may be historical data, real time data or combinations thereof. Simulation through one or more of the simulators may be repeated or adjusted based on the data received.

As shown, the oilfield operation is provided with wellsite and non-wellsite simulators. The wellsite simulators may include a reservoir simulator (340), a wellbore simulator (342), and a surface network simulator (344). The reservoir simulator (340) solves for hydrocarbon flow through the reservoir rock and into the wellbores. The wellbore simulator (342) and surface network simulator (344) solves for hydrocarbon flow through the wellbore and the surface network (444) of pipelines. As shown, some of the simulators may be separate or combined, depending on the available systems.

The non-wellsite simulators may include process (346) and economics (348) simulators. The processing unit has a process simulator (346). The process simulator (346) models the processing plant (e.g., the process facilities (454)) where the hydrocarbon(s) is/are separated into its constituent components (e.g., methane, ethane, propane, etc.) and prepared for sales. The oilfield (400) is provided with an economics simulator (348). The economics simulator (348) models the costs of part or the entire oilfield (400) throughout a portion or the entire duration of the oilfield operation. Various combinations of these and other oilfield simulators may be provided.

While high quality petroleum reservoirs have been successfully explored and exploited for producing oil and gas. Large reservoirs are increasingly difficult to find and producing reservoirs have problems that need to be quickly diagnosed and remedied. Therefore, honoring all relevant measurements to enable on-time decision making is necessary for oilfield operations. The oilfield operations generates a large amount of pressure and production rate data (e.g., data generated from sensors (S) and/or data acquisition tools disposed throughout the oilfield as described with respect to FIGS. 1A-D and 2-5 above), some of which can be measured continuously in real-time. In addition, there are data acquired sporadically, such as well logs and formation test data (e.g., the well log (308*c*) and seismic trace (308*d*) of FIG. 3). Timely and methodical interpretation of this data can provide insight into the status of the well and the reservoir as well as advanced notice to potentially detrimental events.

A workflow is a sequence of steps, organized into routines or subroutines—some of which may be quite complex—that are carried out to achieve a particular goal. Each step receives input in various formats, ranging from digital files or spreadsheets to expert commentary. This input is then processed using a predefined mode, such as a reservoir simulator, spreadsheet analysis, or structured discussions and meetings. The resulting output is utilized in subsequent steps. The goal for most oilfield asset teams is to arrive at an answer that will be used as input for another process, or which will be used to drive a decision. Repetitive workflows can often be automated, freeing personnel to attend to non-routine tasks.

The present invention relates to simulating oilfield workflows using a gridless analytical simulator. In one or more embodiments of the invention, the computation efficiency of the gridless analytical simulator enables the integration of various sources of data at different frequencies in one integrated application, which allows user to step from a single well evaluation & interpretation to multi-well, multi-phase, and/or multi-event diagnostic in a synchronized mode. In one or more embodiments of the invention, oilfield workflows may be simulated by this fast gridless analytical simulator for handling pressure transient data and performing interpretation of key performance indicators during the well/field production life. In one or more embodiments of the invention, these capabilities allow oilfield workflows to monitor and analyze data, anticipate and identify events, and to perform real-time diagnostics and interpretation during the entire life of producing wells.

In one or more embodiments of the invention, the gridless analytical simulator, described below, supports several well configurations and reservoir conditions including vertical, deviated, horizontal, and fractured wells, single and multiple layer heterogeneous reservoir, single phase and multi-phase flowing conditions, and is capable of taking into account superposition effect in multi-well and multi rate scenarios. In one or more embodiments of the invention, special reservoir condition, such as interference effects of multiple wells at different events, may be simulated including surface constrains, pressure transient or rate transient events, etc.

In one or more embodiments of the invention, the gridless analytical simulator may be used either in automatic history matching mode or in prediction mode. The automatic history matching mode aims to compute in real time, key reservoir and well parameters such as reservoir pressure, well skin, effective permeability and well productivity. Subsequently, the prediction mode predicts well and reservoir performance in real-time. The prediction mode is a component to integrate more common production engineer analysis that is used to manage a reservoir, such as well test validation and back allocation correction and forecast in real time, among others.

In one or more embodiments of the invention, the gridless analytical simulator may be used to integrate and keep alive the interaction of the multiple oilfield workflow sub-processes, such as data integration (sources, frequency, etc.), data preparation using techniques such as wavelets transforms to reduce data, remove noise & outliers and transient identification, alarm management system to monitor and control KPI, pressure transient interpretation, automatic model identification using neural networks and systems identification including the use of deconvolution, back allocation, rate reconstruction and well test validation, production (rate and pressure) forecast, reporting and visualization, and/or other suitable oilfield workflow sub-processes.

Figure 6:
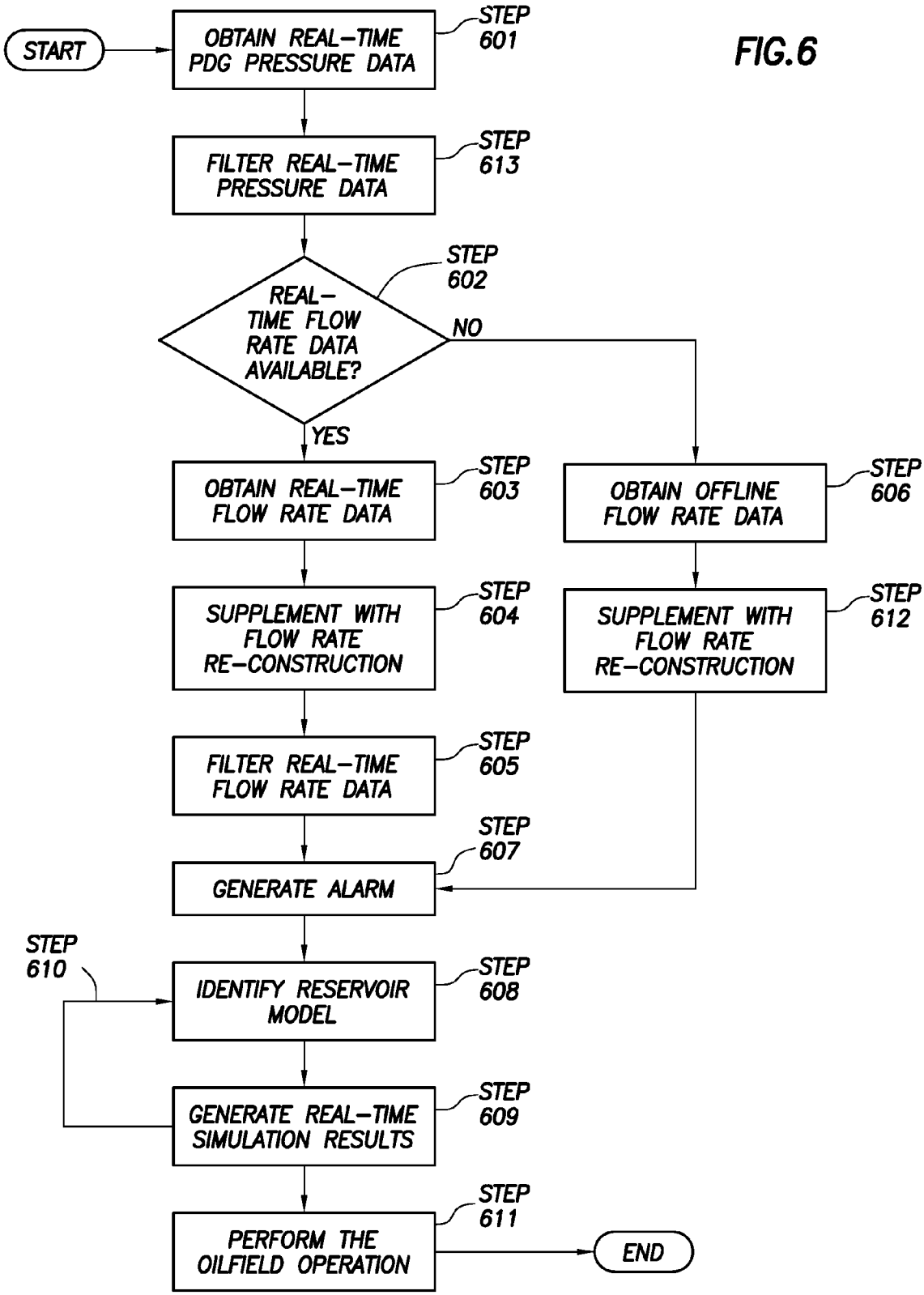
FIG. 6 is a flow chart of a permanent downhole pressure gauge (PDG) workflow in an oilfield.
Figure 7:
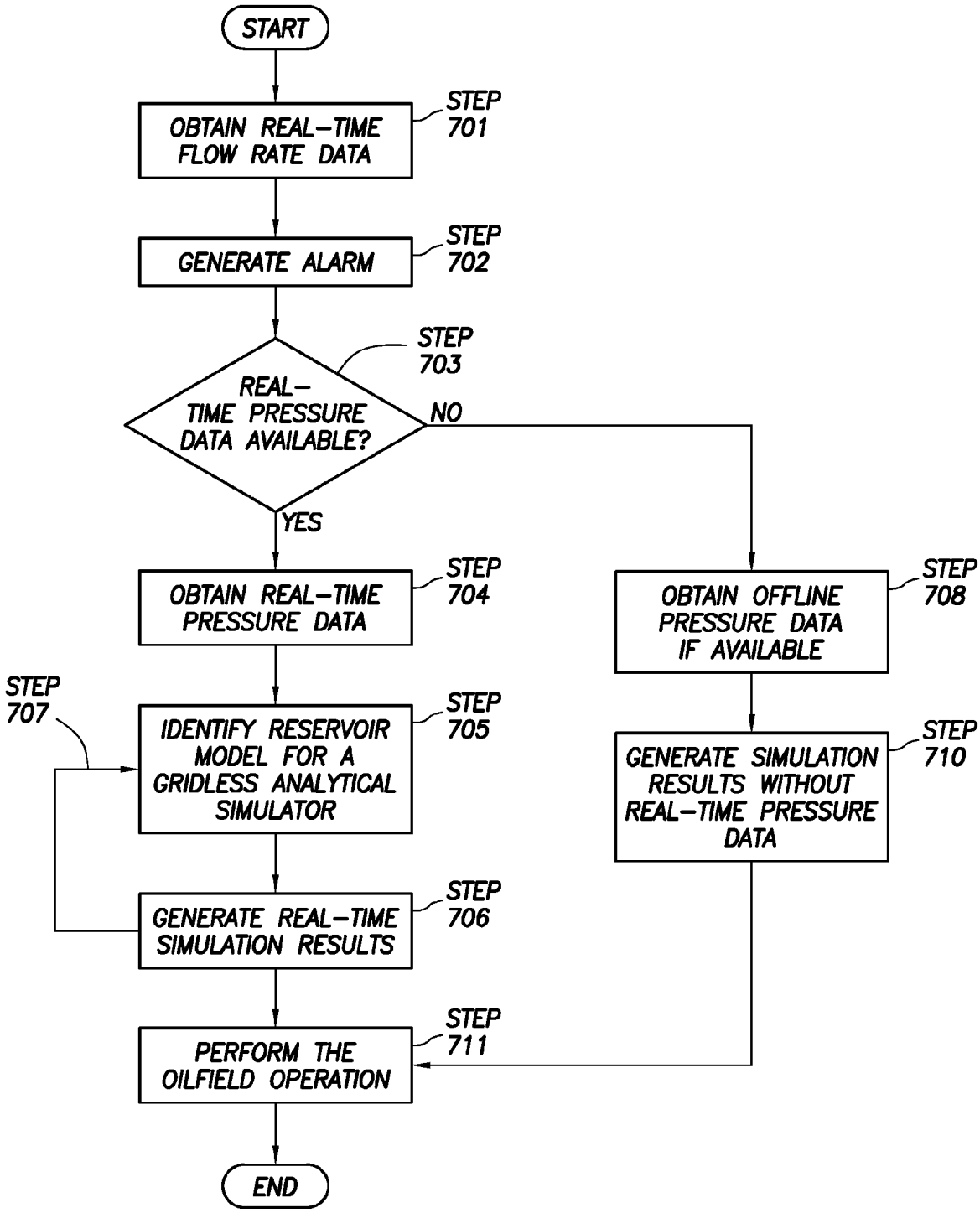
FIG. 7 is a flow chart of a gas rate workflow in a gas field.

FIGS. 6 and 7 show exemplary oilfield workflows modeled using the gridless analytical simulator. FIG. 6 is a flow chart of a permanent downhole pressure gauge (PDG) workflow in an oilfield (e.g., the oilfield (300) of FIG. 3). One of the objectives of the PDG workflow is to enable a lifecycle process to maximize hydrocarbon producing performance of the reservoir over its full life cycle. This is achieved by using a gridless analytical simulator (e.g., a version of the reservoir simulator (340) of FIG. 5), which is described in detail below and can be configured to simulate an interference effect, for example from multiple wellsites of the oilfield (300) in FIG. 3. In the PDG workflow, real-time pressure data is obtained for the gridless analytical simulator from a permanent downhole pressure gauge (e.g., the data acquisition tool (302*d*) of FIG. 3) (Step 601). The real-time pressure data is filtered, for example, by using a wavelet decomposition technique to remove outlier(s), noise, and identify transients (Step 613). The transients may result from a changing oil production rate or shutting down and turning up the production. The identified transients may be used to mark a time interval for simulation sessions. The large amount of real-time raw data may be sampled to reduce to the filtered data to a manageable amount, while retaining all the relevant characteristics of the original larger data set.

The flow rate data may be obtained for the gridless analytical simulator using a variety of methods. In some examples, the flow rate data is obtained through real-time measurement (e.g., the fluid flow rate data plot (308*d*) of FIG. 3) using sensors (e.g., data acquisition tool (302*d*) of FIG. 3) disposed throughout the oilfield (Step 603). In some examples, missing periods of the real-time measurement may exist, which may be supplemented with flow rate re-construction, for example based on tubing head or bottom hole pressure measurement (Step 604). The real-time flow rate data (if available) is also filtered in a similar fashion as filtering of the real-time pressure data (Step 605). In other examples, the real-time flow rate measurement may not be available (Step 602). In such cases, the offline flow rate data is obtained, for example by a method of back allocation using total volume at the point of sales, well test data, and/or downtime measurement at a well (Step 606). The offline flow rate data may also be supplemented with flow rate re-construction, for example, based on tubing head or bottom hole pressure measurement (Step 612).

A set of alarm conditions are calculated based on the real-time data after filtering (Step 607). The alarms may include, for example drawdown alarm, downtime alarm, etc. If the alarm is triggered, detailed diagnostics are performed thereafter.

Within the gridless analytical simulator, many parameters may be used to configure an appropriate model for simulating the oilfield (e.g., the oilfield (300) of FIG. 3). In some examples, the model may be determined manually. The model may be identified by using a neural network method based on, for example, rate of change of the real-time pressure data (Step 608). The model may be further configured based on static parameters obtained through geological surveys (e.g. as depicted in FIG. 1 and FIG. 3 above).

Once the model is identified and the simulator is configured, real-time simulation results are then generated (Step 609). The real-time simulation may include a history matching of key parameters and a prediction of the production rates and reservoir pressure over time. The history matching may be performed as a calibration step at the beginning of a simulation session marked by an identified transient from a change of production rate and/or shutting down and turning up of the production. The real-time simulation results may be delivered in an automatic workflow (i.e., the PDG workflow) with real-time plotting of the key parameters and alarm setting based on pre-determined criteria. The key parameters for the history matching and the real-time plotting may include the reservoir pressure, well skin, effective permeability, and well productivity, etc. The model is automatically updated if the predicted performance diverges from the actual performance by more than a pre-determined limit (Step 610).

In Step 611, the oilfield operation is performed based on the real-time simulation results. For example, the real-time plotting in the simulation results may be analyzed to determine a trend of a wellbore skin, and the oilfield operation performed includes scheduling a workover operation to reduce the wellbore skin. In another example, the real-time plotting in the simulation results may be analyzed to determine a trend of effective permeability, and the oilfield operation performed includes determining a re-completion strategy, such as scheduling an artificial lift operation.

FIG. 7 is a flow chart of a gas field workflow in a gas field, for example, gas may be produced in the oilfield operations depicted in FIGS. 1A-1D and 2-5 above. Initially, the flow rate data is obtained through real-time measurement (e.g., the fluid flow rate data plot (308*d*) of FIG. 3) using sensors (e.g., data acquisition tool (302*d*) of FIG. 3) disposed throughout the oilfield (Step 701). In some examples, missing periods of the real-time measurement may exist. These missing periods may be supplemented with flow rate re-construction, for example, based on tubing head or bottom hole pressure measurement. The real-time flow rate data is also filtered. The filtering functionality includes, for example de-noising using wavelets decomposition, outlier removal, transient identification, data reduction, etc.

As gas wells often may not be equipped with a permanent down hole pressure gauge. A set of first level alarm conditions are calculated based on the real-time flow rate data and basic historic bottom hole or tubing head pressure measurements (Step 702). The alarms may include, for example, drawdown alarm, downtime alarm, etc. If the alarm is triggered, detailed diagnostics are performed thereafter.

Next, a determination is made as to whether real-time measurement is available for bottom hole or tubing head pressure (Step 703). If neither bottom hole nor tubing head pressure measurements is available, offline pressure data is obtained (if available), for example, using historical data and/or by spot measurement (Step 708). The processed real-time flow rate data, and the offline pressure data (if available) are then used to compute key reservoir parameters such as total skin factor, permeability, drainage area, etc. using evaluation method without real-time pressure data, for example, a non-linear regression model (Step 710).

If real-time pressure measurement is available (Step 703), the reliability of the analysis may increase by obtaining pressure data from either bottom hole or tubing head (Step 704). The real-time pressure data obtained this way also involve a filtering step, which includes de-noising, outlier removal, transient identification, and sampling for data reduction.

The reservoir model for a gridless analytical simulator is then identified (Step 705). The model may be identified by using a neural network method based on, for example, hydraulic flow units obtained from pre-processed logs containing information such as layer thickness, porosity, effective permeability, and saturation dependent petro-physical properties. In this step, the model may be further configured based on a history matching method of these key parameters.

Once the model is identified and the simulator is configured, real-time simulation results are then generated (Step 706). The real-time simulation includes a history matching of key parameters and a prediction of the production rates and reservoir pressure over time. The history matching may be performed as a calibration step at the beginning of a simulation session marked by an identified transient from a change of production rate and/or a shutting down and a turning up of the production. The real-time simulation results can be delivered in an automatic workflow (i.e., the gas field workflow) with real-time plotting of the key parameters and alarm setting based on pre-determined criteria. The key parameters for the history matching and the real-time plotting may include the reservoir pressure, well skin, effective permeability, and well productivity, etc. The model is automatically updated if the predicted performance diverges from the actual performance by more than a pre-determined limit (Step 707).

In Step 711, the oilfield operation is performed based on the real-time simulation results.

Figure 8:
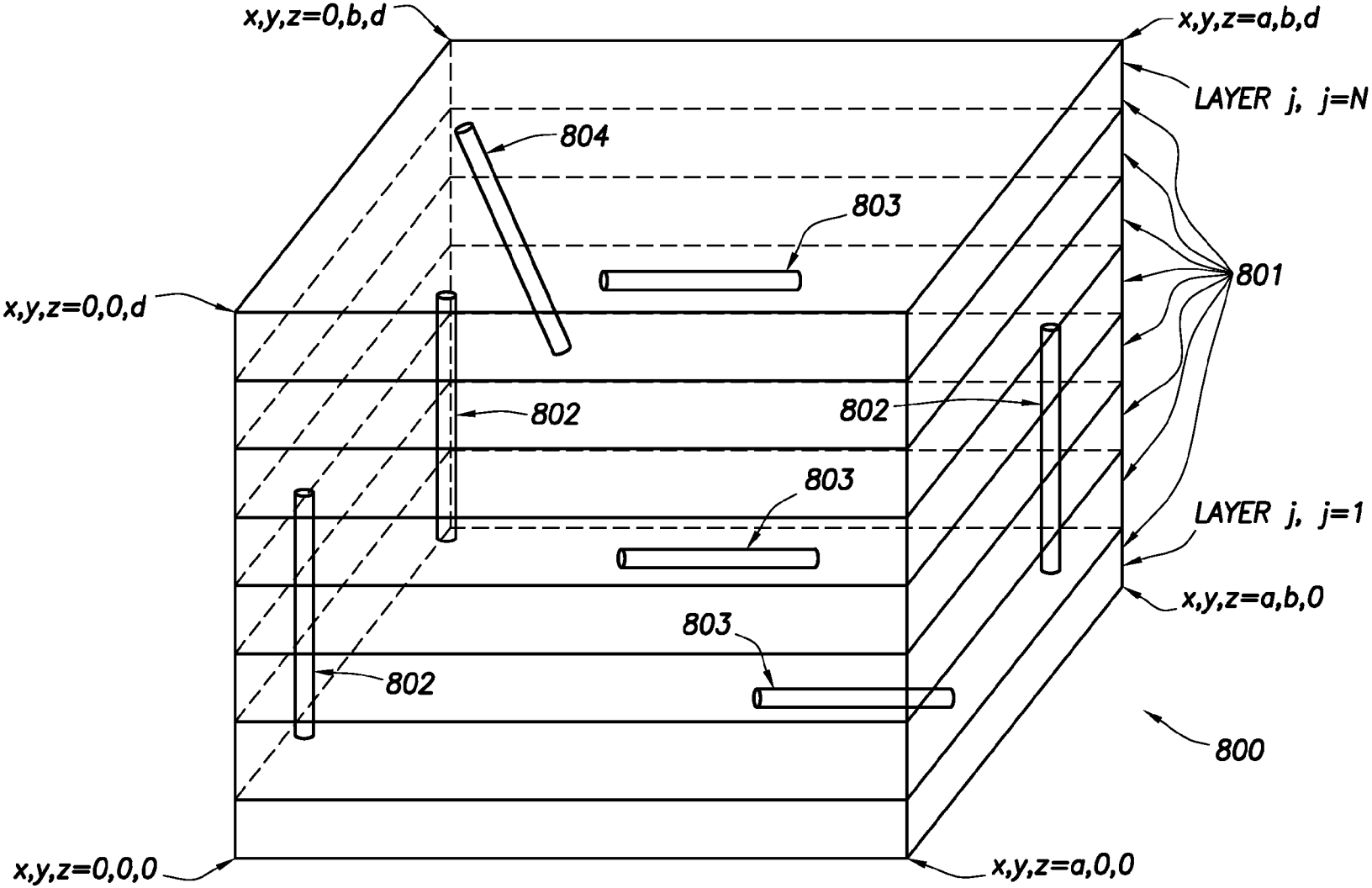
FIG. 8 shows an exemplary schematic diagram of a reservoir modeled in a gridless analytical simulator.

FIG. 8 shows an exemplary schematic diagram of a reservoir modeled in a gridless analytical simulator. In FIG. 8, the reservoir (800) (a portion of which may correspond to the reservoir (404) depicted in FIG. 4 and FIG. 5 above) is represented as a series of N vertically stacked cuboids (or layers) (801), where each of the N cuboids is indexed from 1 through N by an index j. The reservoir (800) is bounded by the planes passing through x=0, x=a; y=0, y=b; z=0, $z=d_N$. Layer j has porosity $\phi_j$ and permeability $k_{xj}$, $k_{yj}$, $k_{zj}$ in the x, y and z directions respectively. The scale of the reservoir (800) drawn in FIG. 8 may be substantially larger than the scale used in FIG. 3, FIG. 4, and FIG. 5.

For example, portions of these cuboids (801) may correspond to the geological structures (306*a*-306*d*) of FIG. 3. The reservoir (800) may be penetrated by multiple wells such as vertical wells (802), horizontal wells (803), and deviated wells (804). The wells (802, 803, 804) may be fractured or un-fractured, the fracture(s) may be naturally occurring or induced by hydraulic fracturing process (not shown). The hydraulic fractures may have finite or infinite conductivity. The reservoir boundary may be modeled as no-flow, constant pressure, or a combination thereof. Even though the wells (802, 803, 804) are represented as a line, suitable corrections may be applied in the model to account for wellbore storage effects and finite wellbore radius. Interference (or superposition) effects from multiple wells in the oilfield are accounted for in the model.

In one or more embodiments of the invention, a gridless analytical simulator may be developed for the vertically stacked system of layers described above. Specifically, an analytic solution within each layer can be derived using a method of integral transforms. In one or more embodiments of the invention, the crossflow between layers are accounted for by coupling these analytic solutions together and solving Fredholm integral equations to obtain the flux field at the layer interfaces. The time evolution of these fluxes is governed by a Volterra integral equation. In one or more embodiments of the invention, the form of these equations allows for stopping a model execution and then restarting from the exact terminated state.

In one or more embodiments of the invention, a general solution for hydrocarbon production can be formulated based on initial and boundary conditions and the governing equations listed in TABLE 1.

TABLE 1

$$\frac{\partial p_j(0,y,z,t)}{\partial x} = -\left(\frac{\mu}{k_x}\right)_j \psi_{0yzj}(y,z,t),\ \frac{\partial p_j(a,y,z,t)}{\partial x} = -\left(\frac{\mu}{k_x}\right)_j \psi_{ayzj}(y,z,t), \tag{0.1}$$

$$\frac{\partial p_j(x,0,z,t)}{\partial y} = -\left(\frac{\mu}{k_x}\right)_j \psi_{x0zj}(x,z,t),\ \frac{\partial p_j(x,b,z,t)}{\partial y} = -\left(\frac{\mu}{k_y}\right)_j \psi_{xbzj}(x,z,t),\ d_j < z < d_{j+1}$$

$\forall\, j = 0, 1, \ldots, \aleph - 1$. At $z = d_0$, $\frac{\partial p(x,y,d_0,t)}{\partial z} = -\left(\frac{\mu}{k_z}\right)_0 \psi_{xy00}(x,y,t)$, and at $z = d_\aleph$, $\frac{\partial p(x,y,d_\aleph,t)}{\partial z} = -\left(\frac{\mu}{k_z}\right)_\aleph \psi_{xyd\aleph}(x,y,t)$, $0 < x < a$, $0 < y < b$. At the interface $z = d_j$, $$\psi_j(x,y,t) = -\left(\frac{k_z}{\mu}\right)_j \left(\frac{\partial p_j(x,y,d_j,t)}{\partial y}\right) = -\left(\frac{k_z}{\mu}\right)_{j-1} \left(\frac{\partial p_{j-1}(x,y,d_j,t)}{\partial y}\right) \text{and}$$

$\breve{\lambda}_j \psi_j(x,y,t) = \{p_{j\ldots1}(x,y,d_j,t) - p_j(x,y,d_j,t)\}$, $\forall_j = 0, 1, \ldots, \aleph - 1$. The initial pressure $p_j(x,y,z,0) = \varphi_j(x,y,z)$. In the interval $d_j \le z \le d_{j+1}$, $j = 0, 1, \ldots, \aleph - 1$, we find $p_j$, the pressure response corresponding any perturbation, from the partial differential equation $$\frac{\partial p_j}{\partial t} = \eta_{xj}\frac{\partial^2 p_j}{\partial x^2} + \eta_{yj}\frac{\partial^2 p_j}{\partial y^2} + + \eta_{zj}\frac{\partial^2 p_j}{\partial z^2} + U(t - t_{0j})\frac{q_j(t - t_{0j})}{(\phi c_t)_j}\delta(x - x_{0j})\delta(y - y_{0j})\delta(z - z_{0j})$$

In the general solution, the hydrocarbon production occurs through multiple vertical or horizontal wells (e.g., vertical wells (802) and horizontal wells (803)), multiple deviated wells (e.g., deviated wells (804)), and fractures.

The multiple vertical or horizontal wells are modeled as line sources of finite lengths $[y_{02ij}-y_{01ij}]$, $[z_{02ij}-z_{01ij}]$, $[x_{02ij}-x_{01ij}]$ passing through:

$(x_{0ij}, y_{0ij})$ for $t=1, 2 \ldots, L_i$ $(y_{0ij}, z_{0ij})$ for $t=L_i+2 \ldots, M_i$ $(x_{0ij}, z_{0ij})$ for $t=M_i+1 \ldots, N_i$ The multiple deviated wells are modeled as $[(z_{02ij}-z_{01ij}) \sin \theta_{0ij}]$, which passes through $(x_{0ij}, y_{0ij}, z_{0ij})$ for $t=N_t+1, \ldots, N_d$.

The fractures are modeled as rectangle sources of finite area $[x_{02tj}-x_{01tj}][y_{02tj}-y_{01tj}]$, $[y_{02tj}-y_{01tj}][z_{02tj}-z_{01tj}]$, and $[x_{02tj}-x_{01tj}][z_{02tj}-z_{01tj}]$, which passes through:

$z_{0tj}$ for $t=N_d+1, \ldots, L_r$ $x_{0tj}$ for $t=L_r+1, \ldots, M_r$ $y_{0tj}$ for $t=M_r+1, \ldots, N_r$ $(L_t<M_t<N_t<N_d<L_r<M_r<N_r)$ The pressure solution at any given point [x, y, z] in the reservoir at time t and the derivation to arrive at a set of general expressions is given as the equations (0.2) through (0.8) listed in TABLE 2 below.

TABLE 2

$$
\begin{aligned}
p_j = {} & \frac{1}{4(\phi c_t)_j ab}\sum_{i=1}^{L_l} U(t-t_{0ij})\int_0^{t-t_{0ij}} q_{ij}(t-t_{0ij}-\tau)\times \\
& \times\left\{\Theta_3\left(\frac{\pi(x-x_{0ij})}{2a}, e^{-\left(\frac{\pi}{a}\right)^2\eta_{xj}\tau}\right)+\Theta_3\left(\frac{\pi(x+x_{0ij})}{2a}, e^{-\left(\frac{\pi}{a}\right)^2\eta_{xj}\tau}\right)\right\}\times \\
& \times\left\{\Theta_3\left(\frac{\pi(y-y_{0ij})}{2b}, e^{-\left(\frac{\pi}{b}\right)^2\eta_{yj}\tau}\right)+\Theta_3\left(\frac{\pi(y+y_{0ij})}{2b}, e^{-\left(\frac{\pi}{b}\right)^2\eta_{yj}\tau}\right)\right\}\times \\
& \times\left\{\Theta_3^f\left(\frac{\pi(z-z_{01ij})}{2(d_{j+1}-d_j)}, e^{-\left(\frac{\pi}{d_{j+1}-d_j}\right)^2\eta_{zj}\tau}\right)-\Theta_3^f\left(\frac{\pi(z+z_{01ij}-2d_j)}{2(d_{j+1}-d_j)}, e^{-\left(\frac{\pi}{d_{j+1}-d_j}\right)^2\eta_{xj}\tau}\right)-\right. \\
& \left.-\Theta_3^f\left(\frac{\pi(z-z_{02ij})}{2(d_{j+1}-d_j)}, e^{-\left(\frac{\pi}{d_{j+1}-d_j}\right)^2\eta_{zj}\tau}\right)+\Theta_3^f\left(\frac{\pi(z+z_{02ij}-2d_j)}{2(d_{j+1}-d_j)}, e^{-\left(\frac{\pi}{d_{j+1}-d_j}\right)^2\eta_{xj}\tau}\right)\right\}d\tau+ \\
& +\frac{1}{4(\phi c_t)_j b(d_{j+1}-d_j)}\sum_{i=L_l+1}^{M_l} U(t-t_{0ij})\int_0^{t-t_{0ij}} q_{ij}(t-t_{0ij}-\tau)\times \\
& \times\left\{\Theta_3\left(\frac{\pi(y-y_{0ij})}{2b}, e^{-\left(\frac{\pi}{b}\right)^2\eta_{yj}\tau}\right)+\Theta_3\left(\frac{\pi(y+y_{0ij})}{2b}, e^{-\left(\frac{\pi}{b}\right)^2\eta_{yj}\tau}\right)\right\}\times \\
& \times\left\{\Theta_3\left(\frac{\pi(z-z_{0ij})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{02ij}-2d_j)}{2(d_{j+1}-d_j)}, e^{-\left(\frac{\pi}{d_{j+1}-d_j}\right)^2\eta_{xj}\tau}\right)\right\}\times \\
& \times\left\{\Theta_3^f\left(\frac{\pi(x-x_{01ij})}{2a}, e^{-\left(\frac{\pi}{a}\right)^2\eta_{xj}\tau}\right)-\Theta_3^f\left(\frac{\pi(x+x_{01ij})}{2a}, e^{-\left(\frac{\pi}{a}\right)^2\eta_{xj}\tau}\right)-\right. \\
& \left.-\Theta_3^f\left(\frac{\pi(x-x_{02ij})}{2a}, e^{-\left(\frac{\pi}{a}\right)^2\eta_{xj}\tau}\right)-\Theta_3^f\left(\frac{\pi(x+x_{02ij})}{2a}, e^{-\left(\frac{\pi}{a}\right)^2\eta_{xj}\tau}\right)\right\}d\tau+ \\
& +\frac{1}{4(\phi c_t)_j a(d_{j+1}-d_j)}\sum_{i=M_l+1}^{N_l} U(t-t_{0ij})\int_0^{t-t_{0ij}} q_{ij}(t-t_{0ij}-\tau)\times \\
& \times\left\{\Theta_3\left(\frac{\pi(x-x_{0ij})}{2a}, e^{-\left(\frac{\pi}{a}\right)^2\eta_{xj}\tau}\right)+\Theta_3\left(\frac{\pi(x+x_{0ij})}{2a}, e^{-\left(\frac{\pi}{a}\right)^2\eta_{xj}\tau}\right)\right\}\times \\
& \times\left\{\Theta_3\left(\frac{\pi(z-z_{0ij})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)}, e^{-\left(\frac{\pi}{d_{j+1}-d_j}\right)^2\eta_{zj}\tau}\right)\right\}\times \\
& \times\left\{\Theta_3^f\left(\frac{\pi(y-y_{01ij})}{2b}, e^{-\left(\frac{\pi}{b}\right)^2\eta_{yj}\tau}\right)-\Theta_3^f\left(\frac{\pi(y+y_{01ij})}{2b}, e^{-\left(\frac{\pi}{b}\right)^2\eta_{yj}\tau}\right)-\right. \\
& \left.-\Theta_3^f\left(\frac{\pi(y-y_{02ij})}{2b}, e^{-\left(\frac{\pi}{b}\right)^2\eta_{yj}\tau}\right)+\Theta_3^f\left(\frac{\pi(y+y_{02ij})}{2b}, e^{-\left(\frac{\pi}{b}\right)^2\eta_{yj}\tau}\right)\right\}d\tau+ \\
& +\frac{1}{8(\phi c_t)_j ab(d_{j+1}-d_j)}\times \\
& \times\sum_{i=N_l+1}^{N_d} U(t-t_{0ij})\sin\vartheta_{0ij}\int_0^{t-t_{0ij}} q_{ij}(t-t_{0ij}-\tau)\int_{z01ij}^{z02ij}\left[\left\{\Theta_3\left(\frac{\pi}{2a}\{x-(z_{0ij}-\gamma_{0ij})\cot\vartheta_{0ij}\cos\theta_{0ij}\}, e^{-\left(\frac{\pi}{a}\right)^2\eta_{xj}\tau}\right)+\right.\right. \\
& \left.+\Theta_3\left(\frac{\pi}{2a}\{x+(z_{0ij}-\gamma_{0ij})\cot\vartheta_{0ij}\cos\theta_{0ij}\}, e^{-\left(\frac{\pi}{a}\right)^2\eta_{xj}\tau}\right)\right\}\times \\
& \times\left\{\Theta_3\left(\frac{\pi}{2b}\{y-(z_{0ij}-\gamma_{0ij})\cot\vartheta_{0ij}\cos\theta_{0ij}\}, e^{-\left(\frac{\pi}{b}\right)^2\eta_{yj}\tau}\right)+\right. \\
& \left.+\Theta_3\left(\frac{\pi}{2b}\{y+(z_{0ij}-\gamma_{0ij})\cot\vartheta_{0ij}\cos\theta_{0ij}\}, e^{-\left(\frac{\pi}{b}\right)^2\eta_{yj}\tau}\right)\right\}\times \\
& \times\left\{\Theta_3\left(\frac{\pi(z-z_{0ij})}{2(d_{j+1}-d_j)}, e^{-\left(\frac{\pi}{d_{j+1}-d_j}\right)^2\eta_{yj}\tau}\right)+\Theta_3\left(\frac{\pi(z+z_{0ij}-2d_j)}{2(d_{j+1}-d_j)}, e^{-\left(\frac{\pi}{d_{j+1}-d_j}\right)^2\eta_{yj}\tau}\right)\right\}\Bigg]dz_{0ij}d\tau+
\end{aligned}
\tag{0.2}
$$

TABLE 2-continued $$+\frac{1}{2(\phi c_t)_j(d_{j+1}-d_j)}\sum_{i=N_d+1}^{L_r}U(t-t_{0ij})\int_0^{t-t_{0ij}}q_{ij}(t-t_{0ij}-\tau)\times$$
$$\times\left\{\Theta_3^f\left(\frac{\pi(x-x_{01ij})}{2a},e^{-\left(\frac{\pi}{a}\right)^2\eta_{xj}\tau}\right)-\Theta_3^f\left(\frac{\pi(x+x_{01ij})}{2a},e^{-\left(\frac{\pi}{a}\right)^2\eta_{xj}\tau}\right)-\right.$$
$$\left.-\Theta_3^f\left(\frac{\pi(x-x_{02ij})}{2a},e^{-\left(\frac{\pi}{a}\right)^2\eta_{xj}\tau}\right)+\Theta_3^f\left(\frac{\pi(x+x_{02ij})}{2a},e^{-\left(\frac{\pi}{a}\right)^2\eta_{xj}\tau}\right)\right\}\times$$
$$\times\left\{\Theta_3^f\left(\frac{\pi(y-y_{01ij})}{2b},e^{-\left(\frac{\pi}{b}\right)^2\eta_{yj}\tau}\right)-\Theta_3^f\left(\frac{\pi(y+y_{01ij})}{2b},e^{-\left(\frac{\pi}{b}\right)^2\eta_{yj}\tau}\right)-\right.$$
$$\left.-\Theta_3^f\left(\frac{\pi(y-y_{02ij})}{2b},e^{-\left(\frac{\pi}{b}\right)^2\eta_{yj}\tau}\right)+\Theta_3^f\left(\frac{\pi(y+y_{02ij})}{2b},e^{-\left(\frac{\pi}{b}\right)^2\eta_{yj}\tau}\right)\right\}\times$$
$$\times\left\{\Theta_3\left(\frac{\pi(z-z_{0ij})}{2(d_{j+1}-d_j)},e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)},e^{-\left(\frac{\pi}{d_{j+1}-d_j}\right)^2\eta_{xj}\tau}\right)\right\}\Bigg]dz_{0ij}d\tau+$$

$$+\frac{1}{2(\phi c_t)_j a}\sum_{i=L_r+1}^{M_r}U(t-t_{0ij})\int_0^{t-t_{0ij}}q_{ij}(t-t_{0ij}-\tau)\times$$
$$\times\left\{\Theta_3\left(\frac{\pi(x-x_{01ij})}{2a},e^{-\left(\frac{\pi}{a}\right)^2\eta_{xj}\tau}\right)+\Theta_3\left(\frac{\pi(x+x_{01ij})}{2a},e^{-\left(\frac{\pi}{a}\right)^2\eta_{xj}\tau}\right)\right\}\times$$
$$\times\left\{\Theta_3^f\left(\frac{\pi(y-y_{01ij})}{2b},e^{-\left(\frac{\pi}{b}\right)^2\eta_{yj}\tau}\right)-\Theta_3^f\left(\frac{\pi(y+y_{01ij})}{2b},e^{-\left(\frac{\pi}{b}\right)^2\eta_{yj}\tau}\right)-\right.$$
$$\left.-\Theta_3^f\left(\frac{\pi(y-y_{02ij})}{2b},e^{-\left(\frac{\pi}{b}\right)^2\eta_{yj}\tau}\right)+\Theta_3^f\left(\frac{\pi(y+y_{02ij})}{2b},e^{-\left(\frac{\pi}{b}\right)^2\eta_{yj}\tau}\right)\right\}\times$$
$$\times\left\{\Theta_3^f\left(\frac{\pi(z-z_{0ij})}{2(d_{j+1}-d_j)},e^{-\left(\frac{\pi}{d_{j+1}-d_j}\right)^2\eta_{zj}\tau}\right)-\Theta_3^f\left(\frac{\pi(z+z_{01ij}-2d_j)}{2(d_{j+1}-d_j)},e^{-\left(\frac{\pi}{d_{j+1}-d_j}\right)^2\eta_{zj}\tau}\right)-\right.$$
$$\left.-\Theta_3^f\left(\frac{\pi(z-z_{02ij})}{2(d_{j+1}-d_j)},e^{-\left(\frac{\pi}{d_{j+1}-d_j}\right)^2\eta_{zj}\tau}\right)+\Theta_3^f\left(\frac{\pi(z+z_{02ij}-2d_j)}{2(d_{j+1}-d_j)},e^{-\left(\frac{\pi}{d_{j+1}-d_j}\right)^2\eta_{zj}\tau}\right)\right\}d\tau+$$

$$+\frac{1}{2(\phi c_t)_j b}\sum_{i=M_r+1}^{N_r}U(t-t_{0ij})\int_0^{t-t_{0ij}}q_{ij}(t-t_{0ij}-\tau)\times$$
$$\times\left\{\Theta_3^f\left(\frac{\pi(x-x_{01ij})}{2a},e^{-\left(\frac{\pi}{a}\right)^2\eta_{xj}\tau}\right)-\Theta_3^f\left(\frac{\pi(x+x_{01ij})}{2a},e^{-\left(\frac{\pi}{a}\right)^2\eta_{xj}\tau}\right)-\right.$$
$$\left.-\Theta_3^f\left(\frac{\pi(x-x_{02ij})}{2a},e^{-\left(\frac{\pi}{a}\right)^2\eta_{xj}\tau}\right)+\Theta_3^f\left(\frac{\pi(x+x_{02ij})}{2a},e^{-\left(\frac{\pi}{a}\right)^2\eta_{xj}\tau}\right)\right\}\times$$
$$\times\left\{\Theta_3\left(\frac{\pi(y-y_{0ij})}{2b},e^{-\left(\frac{\pi}{b}\right)^2\eta_{yj}\tau}\right)-\Theta_3\left(\frac{\pi(y+y_{0ij})}{2b},e^{-\left(\frac{\pi}{b}\right)^2\eta_{yj}\tau}\right)\right\}\times$$
$$\times\left\{\Theta_3^f\left(\frac{\pi(z-z_{01ij})}{2(d_{j+1}-d_j)},e^{-\left(\frac{\pi}{d_{j+1}-d_j}\right)^2\eta_{zj}\tau}\right)-\Theta_3^f\left(\frac{\pi(z+z_{01ij}-2d_j)}{2(d_{j+1}-d_j)},e^{-\left(\frac{\pi}{d_{j+1}-d_j}\right)^2\eta_{zj}\tau}\right)-\right.$$
$$\left.-\Theta_3^f\left(\frac{\pi(z-z_{02ij})}{2(d_{j+1}-d_j)},e^{-\left(\frac{\pi}{d_{j+1}-d_j}\right)^2\eta_{zj}\tau}\right)+\Theta_3^f\left(\frac{\pi(z+z_{02ij}-2d_j)}{2(d_{j+1}-d_j)},e^{-\left(\frac{\pi}{d_{j+1}-d_j}\right)^2\eta_{zj}\tau}\right)\right\}d\tau+$$

$$+\frac{1}{4(\phi c_t)_j ab(d_{j+1}-d_j)}\int_0^c\int_0^a\int_0^b\left[\psi_j(u,v,\tau)\Theta_3\left\{\frac{\pi(z-d_j)}{2(d_{j+1}-d_j)},e^{-\left(\frac{\pi}{d_{j+1}-d_j}\right)^2\eta_{zj}(t-\tau)}\right\}-\right.$$
$$\left.-\psi_{j+1}(u,v,\tau)\Theta_4\left\{\frac{\pi(z-d_j)}{2(d_{j+1}-d_j)},e^{-\left(\frac{\pi}{d_{j+1}-d_j}\right)^2\eta_{zj}(t-\tau)}\right\}\right]\times$$
$$\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times$$
$$\times\left[\Theta_3\left\{\frac{\pi(y-v)}{2b},e^{-\left(\frac{\pi}{b}\right)^2\eta_{yj}(t-\tau)}\right\}+\Theta_3\left\{\frac{\pi(y+v)}{2b},e^{-\left(\frac{\pi}{b}\right)^2\eta_{yj}(t-\tau)}\right\}\right]dudvd\tau+$$

TABLE 2-continued $$+\frac{1}{4(\phi c_t)_j ab(d_{j+1}-d_j)}\times$$
$$\times\int_0^t\int_0^b\int_0^{d_{j+1}-d_j}\left[\psi_{0yzj}(v,w,\tau)\Theta_3\left\{\frac{\pi x}{2a},e^{-\left(\frac{\pi}{a}\right)^2\eta_{xj}(t-\tau)}\right\}-\psi_{ayzj}(v,w,\tau)\Theta_4\left\{\frac{\pi x}{2a},e^{-\left(\frac{\pi}{a}\right)^2\eta_{xj}(t-\tau)}\right\}\right]\times$$
$$\times\left[\Theta_3\left\{\frac{\pi(y-v)}{2b},e^{-\left(\frac{\pi}{b}\right)^2\eta_{yj}(t-\tau)}\right\}+\Theta_3\left\{\frac{\pi(y+v)}{2b},e^{-\left(\frac{\pi}{b}\right)^2\eta_{yj}(t-\tau)}\right\}\right]\times$$
$$\times\left[\Theta_3\left\{\frac{\pi(z-d_j-w)}{2(d_{j+1}-d_j)},e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},e^{-\left(\frac{\pi}{d_{j+1}-d_j}\right)^2\eta_{zj}(t-\tau)}\right\}\right]dvdwd\tau+$$

$$+\frac{1}{4(\phi c_t)_j ab(d_{j+1}-d_j)}\times$$
$$\times\int_0^t\int_0^a\int_0^{d_{j+1}-d_j}\left[\psi_{x0zj}(u,w,\tau)\Theta_3\left\{\frac{\pi y}{2b},e^{-\left(\frac{\pi}{b}\right)^2\eta_{yj}(t-\tau)}\right\}-\psi_{xbzj}(u,w,\tau)\Theta_4\left\{\frac{\pi y}{2b},e^{-\left(\frac{\pi}{b}\right)^2\eta_{yj}(t-\tau)}\right\}\right]\times$$
$$\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times$$
$$\times\left[\Theta_3\left\{\frac{\pi(z-d_j-w)}{2(d_{j+1}-d_j)},e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},e^{-\left(\frac{\pi}{d_{j+1}-d_j}\right)^2\eta_{zj}(t-\tau)}\right\}\right]dudwd\tau+$$

$$+\frac{1}{8ab(d_{j+1}-d_j)}\times$$
$$\times\int_0^{d_{j+1}-d_j}\int_0^b\int_0^a\varphi_j(u,v,w+d_j)\left[\left\{\Theta_3\left\{\frac{\pi(x-u)}{2a},e^{-\left(\frac{\pi}{a}\right)^2\eta_{xj}t}\right\}+\Theta_3\left\{\frac{\pi(x+u)}{2a},e^{-\left(\frac{\pi}{a}\right)^2\eta_{xj}t}\right\}\right\}\times\right.$$
$$\times\left\{\Theta_3\left\{\frac{\pi(y-v)}{2b},e^{-\left(\frac{\pi}{b}\right)^2\eta_{yj}t}\right\}+\Theta_3\left\{\frac{\pi(y+v)}{2b},e^{-\left(\frac{\pi}{b}\right)^2\eta_{yj}t}\right\}\right\}\times$$
$$\left.\times\left\{\Theta_3\left\{\frac{\pi(z-d_j-w)}{2(d_{j+1}-d_j)},e^{-\left(\frac{\pi}{d_{j+1}-d_j}\right)^2\eta_{zj}t}\right\}+\Theta_3\left\{\frac{\pi(z-d_j+w)}{2(d_{j+1}-d_j)},e^{-\left(\frac{\pi}{d_{j+1}-d_j}\right)^2\eta_{zj}t}\right\}\right\}\right]dudvdw$$

where $\eta_{xj}=\left(\frac{k_x}{\phi c_t\mu}\right)_j$, $\eta_{yj}=\left(\frac{k_y}{\phi c_t\mu}\right)_j$ and $\eta_{zj}=\left(\frac{k_z}{\phi c_t\mu}\right)_j$. We employ, in time domain, the interfacial boundary condition. Substituting for $p_j(x, y, d_j, t)$ and $p_{j-1}(x, y, d_j, t)$ from equation (0.2) in $$\breve{\lambda}_j\psi_j(x,y,t)=\{p_{j-1}(x,y,d_j,t)-p_j(x,y,d_j,t)\},\quad \forall_j=1,2,\ldots,\aleph-1$$

we obtain a three-point recurrence integral equation relationship in time and space $$\begin{aligned}\breve{\lambda}_j\psi_j(x,y,t)=&\int_0^t\int_0^a\int_0^b A_j(x,u,y.v,t-\tau)\psi_j(u,v,\tau)dvdud\tau+\\&+\int_0^t\int_0^a\int_0^b B_j(x,u,y,v,t-\tau)\psi_{j+1}(u,v,\tau)dvdud\tau+\\&+\int_0^t\int_0^a\int_0^b C_j(x,u,y,v,t-\tau)\psi_{j-1}(u,v,\tau)dvdud\tau+\Omega_j(x,y,t)\end{aligned}\tag{0.3}$$

The coefficients of the recurrence integral equation (0.3) for $d_j<z<d_{j+1}$, $\forall_j=1,2,\ldots,\aleph-1$, are given by $$A_j(x,u,y,v,t)=g_j(x,u,y,v,t)+g_{j-1}(x,u,y,v,t)\tag{0.4}$$

$$\begin{aligned}g_j(x,u,y,v,t)=&-\frac{\Theta_3\left\{0,e^{-\left(\frac{\pi}{d_{j+1}-d_j}\right)^2\eta_{zj}(t-\tau)}\right\}}{4(\phi c_t)_j ab(d_{j+1}-d_j)}\times\\&\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times\\&\times\left[\Theta_3\left\{\frac{\pi(y-v)}{2b},e^{-\left(\frac{\pi}{b}\right)^2\eta_{yj}(t-\tau)}\right\}+\Theta_3\left\{\frac{\pi(y+v)}{2b},e^{-\left(\frac{\pi}{b}\right)^2\eta_{yj}(t-\tau)}\right\}\right]\end{aligned}\tag{0.5}$$

$$\begin{aligned}B_j(x,u,y,v,t)=&\frac{\Theta_4\left\{0,e^{-\left(\frac{\pi}{d_{j+1}-d_j}\right)^2\eta_{zj}(t-\tau)}\right\}}{4(\phi c_t)_j ab(d_{j+1}-d_j)}\times\\&\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times\\&\times\left[\Theta_3\left\{\frac{\pi(y-v)}{2b},e^{-\left(\frac{\pi}{b}\right)^2\eta_{yj}(t-\tau)}\right\}+\Theta_3\left\{\frac{\pi(y+v)}{2b},e^{-\left(\frac{\pi}{b}\right)^2\eta_{yj}(t-\tau)}\right\}\right]\end{aligned}\tag{0.6}$$

TABLE 2-continued $$C_j(x, u, y, v, t) = B_{j-1}(x, u, y, v, t) \tag{0.7}$$

$$\begin{aligned}
\Omega_j(x, y, t) = {} & \frac{1}{4(\phi c_t)_{j-1} ab} \sum_{i=1}^{L_t} U(t - t_{0ij-1}) \int_0^{t-t_{0ij-1}} q_{ij-1}(t - t_{0ij-1} - \tau) \times \\
& \times \left\{ \Theta_3\left( \frac{\pi(x - x_{0ij-1})}{2a}, e^{-\left(\frac{\pi}{a}\right)^2 \eta_{xj-1}\tau} \right) + \Theta_3\left( \frac{\pi(x + x_{0ij-1})}{2a}, e^{-\left(\frac{\pi}{a}\right)^2 \eta_{xj-1}\tau} \right) \right\} \times \\
& \times \left\{ \Theta_3\left( \frac{\pi(y - y_{0ij-1})}{2b}, e^{-\left(\frac{\pi}{b}\right)^2 \eta_{yj-1}\tau} \right) + \Theta_3\left( \frac{\pi(y + y_{0ij-1})}{2b}, e^{-\left(\frac{\pi}{b}\right)^2 \eta_{yj-1}\tau} \right) \right\} \times \\
& \times \left\{ \Theta_3^f\left( \frac{\pi(d_j - z_{01ij-1})}{2(d_j - d_{j-1})}, e^{-\left(\frac{\pi}{d_j - d_{j-1}}\right)^2 \eta_{zj-1}\tau} \right) - \right. \\
& - \Theta_3^f\left( \frac{\pi(d_j + z_{01ij-1} - 2d_{j-1})}{2(d_j - d_{j-1})}, e^{-\left(\frac{\pi}{d_j - d_{j-1}}\right)^2 \eta_{zj-1}\tau} \right) - \\
& - \Theta_3^f\left( \frac{\pi(d_j - z_{02ij-1})}{2(d_j - d_{j-1})}, e^{-\left(\frac{\pi}{d_j - d_{j-1}}\right)^2 \eta_{zj-1}\tau} \right) + \\
& \left. + \Theta_3^f\left( \frac{\pi(d_j + z_{02ij-1} - 2d_{j-1})}{2(d_j - d_{j-1})}, e^{-\left(\frac{\pi}{d_j - d_{j-1}}\right)^2 \eta_{zj-1}\tau} \right) \right\} d\tau + \\
& + \frac{1}{4(\phi c_t)_{j-1} b(d_j - d_{j-1})} \sum_{i=L_t+1}^{M_t} U(t - t_{0ij-1}) \int_0^{t-t_{0ij-1}} q_{ij-1}(t - t_{0ij-1} - \tau) \times \\
& \times \left\{ \Theta_3\left( \frac{\pi(y - y_{0ij-1})}{2b}, e^{-\left(\frac{\pi}{b}\right)^2 \eta_{yj-1}\tau} \right) + \Theta_3\left( \frac{\pi(y + y_{0ij-1})}{2b}, e^{-\left(\frac{\pi}{b}\right)^2 \eta_{yj-1}\tau} \right) \right\} \times \\
& \times \left\{ \Theta_3\left( \frac{\pi(d_j - z_{0ij-1})}{2(d_j - d_{j-1})}, e^{-\left(\frac{\pi}{d_j - d_{j-1}}\right)^2 \eta_{zj-1}\tau} \right) + \right. \\
& \left. + \Theta_3\left( \frac{\pi(d_j + z_{0ij-1} - 2d_{j-1})}{2(d_j - d_{j-1})}, e^{-\left(\frac{\pi}{d_j - d_{j-1}}\right)^2 \eta_{zj-1}\tau} \right) \right\} \times \\
& \times \left\{ \Theta_3^f\left( \frac{\pi(x - x_{01ij-1})}{2a}, e^{-\left(\frac{\pi}{a}\right)^2 \eta_{xj-1}\tau} \right) - \Theta_3^f\left( \frac{\pi(x + x_{01ij-1})}{2a}, e^{-\left(\frac{\pi}{a}\right)^2 \eta_{xj-1}\tau} \right) - \right. \\
& \left. - \Theta_3^f\left( \frac{\pi(x - x_{02ij-1})}{2a}, e^{-\left(\frac{\pi}{a}\right)^2 \eta_{xj-1}\tau} \right) + \Theta_3^f\left( \frac{\pi(x + x_{02ij-1})}{2a}, e^{-\left(\frac{\pi}{a}\right)^2 \eta_{xj-1}\tau} \right) \right\} d\tau + \\
& + \frac{1}{4(\phi c_t)_{j-1} a(d_j - d_{j-1})} \sum_{i=M_t+1}^{N_t} U(t - t_{0ij-1}) \int_0^{t-t_{0ij-1}} q_{ij-1}(t - t_{0ij-1} - \tau) \times \\
& \times \left\{ \Theta_3\left( \frac{\pi(x - x_{0ij-1})}{2a}, e^{-\left(\frac{\pi}{a}\right)^2 \eta_{xj-1}\tau} \right) + \Theta_3\left( \frac{\pi(x + x_{0ij-1})}{2a}, e^{-\left(\frac{\pi}{a}\right)^2 \eta_{xj-1}\tau} \right) \right\} \times \\
& \times \left\{ \Theta_3\left( \frac{\pi(d_j - z_{0ij-1})}{2(d_j - d_{j-1})}, e^{-\left(\frac{\pi}{d_j - d_{j-1}}\right)^2 \eta_{zj-1}\tau} \right) + \right. \\
& \left. + \Theta_3\left( \frac{\pi(d_j + z_{0ij-1} - 2d_{j-1})}{2(d_j - d_{j-1})}, e^{-\left(\frac{\pi}{d_j - d_{j-1}}\right)^2 \eta_{zj-1}\tau} \right) \right\} \times \\
& \times \left\{ \Theta_3^f\left( \frac{\pi(y - y_{01ij-1})}{2b}, e^{-\left(\frac{\pi}{b}\right)^2 \eta_{yj-1}\tau} \right) + \Theta_3^f\left( \frac{\pi(y + y_{01ij-1})}{2b}, e^{-\left(\frac{\pi}{b}\right)^2 \eta_{yj-1}\tau} \right) - \right. \\
& \left. - \Theta_3^f\left( \frac{\pi(y - y_{02ij-1})}{2b}, e^{-\left(\frac{\pi}{b}\right)^2 \eta_{yj-1}\tau} \right) + \Theta_3^f\left( \frac{\pi(y + y_{02ij-1})}{2b}, e^{-\left(\frac{\pi}{b}\right)^2 \eta_{yj-1}\tau} \right) \right\} d\tau +
\end{aligned}$$

TABLE 2-continued $$+\frac{1}{8(\phi c_t)_{j-1}ab(d_j-d_{j-1})}\sum_{i=N_t+1}^{N_d}U(t-t_{0ij-1})\sin\vartheta_{0ij-1}\int_0^{t-t_{0ij-1}}q_{ij-1}(t-t_{0ij-1}-\tau)\times$$

$$\times\int_{z_{01ij-1}}^{z_{02ij-1}}\left[\left\{\Theta_3\left(\frac{\pi}{2a}\{x-(z_{0ij-1}-\gamma_{0ij-1})\cot\vartheta_{0ij-1}\cos\theta_{0ij-1}\},\ e^{-\left(\frac{\pi}{a}\right)^2\eta_{xj-1}\tau}\right)+\right.\right.$$

$$\left.+\Theta_3\left(\frac{\pi}{2a}\{x+(z_{0ij-1}-\gamma_{0ij-1})\cot\vartheta_{0ij-1}\cos\theta_{0ij-1}\},\ e^{-\left(\frac{\pi}{a}\right)^2\eta_{zj-1}\tau}\right)\right\}\times$$

$$\times\left\{\Theta_3\left(\frac{\pi}{2b}\{y-(z_{0ij-1}-\gamma_{0ij-1})\cot\vartheta_{0ij-1}\sin\theta_{0ij-1}\},\ e^{-\left(\frac{\pi}{b}\right)^2\eta_{yj-1}\tau}\right)+\right.$$

$$\left.+\Theta_3\left(\frac{\pi}{2b}\{y+(z_{0ij-1}-\gamma_{0ij-1})\cot\vartheta_{0ij-1}\sin\theta_{0ij-1}\},\ e^{-\left(\frac{\pi}{b}\right)^2\eta_{yj-1}\tau}\right)\right\}\times$$

$$\times\left\{\Theta_3\left(\frac{\pi(d_j-z_{0ij-1})}{2(d_j-d_{j-1})},\ e^{-\left(\frac{\pi}{d_j-d_{j-1}}\right)^2\eta_{yj-1}\tau}\right)+\right.$$

$$\left.\left.+\Theta_3\left(\frac{\pi(d_j+z_{0ij-1}-2d_{j-1})}{2(d_j-d_{j-1})},\ e^{-\left(\frac{\pi}{d_j-d_{j-1}}\right)^2\eta_{yj-1}\tau}\right)\right\}\right]dz_{0ij-1}d\tau+$$

$$+\frac{1}{2(\phi c_t)_{j-1}(d_j-d_{j-1})}\sum_{i=N_d+1}^{L_r}U(t-t_{0ij-1})\int_0^{t-t_{0ij-1}}q_{ij-1}(t-t_{0ij-1}-\tau)\times$$

$$\times\left\{\Theta_3^f\left(\frac{\pi(x-x_{01ij-1})}{2a},\ e^{-\left(\frac{\pi}{a}\right)^2\eta_{xj-1}\tau}\right)-\Theta_3^f\left(\frac{\pi(x+x_{01ij-1})}{2a},\ e^{-\left(\frac{\pi}{a}\right)^2\eta_{xj-1}\tau}\right)-\right.$$

$$\left.-\Theta_3^f\left(\frac{\pi(x-x_{02ij-1})}{2a},\ e^{-\left(\frac{\pi}{a}\right)^2\eta_{xj-1}\tau}\right)+\Theta_3^f\left(\frac{\pi(x+x_{02ij-1})}{2a},\ e^{-\left(\frac{\pi}{a}\right)^2\eta_{xj-1}\tau}\right)\right\}\times$$

$$\times\left\{\Theta_3^f\left(\frac{\pi(y-y_{0ij-1})}{2b},\ e^{-\left(\frac{\pi}{b}\right)^2\eta_{yj-1}\tau}\right)+\Theta_3^f\left(\frac{\pi(y+y_{01ij-1})}{2b},\ e^{-\left(\frac{\pi}{b}\right)^2\eta_{yj-1}\tau}\right)-\right.$$

$$\left.-\Theta_3^f\left(\frac{\pi(y-y_{02ij-1})}{2b},\ e^{-\left(\frac{\pi}{b}\right)^2\eta_{yj-1}\tau}\right)+\Theta_3^f\left(\frac{\pi(y+y_{02ij-1})}{2b},\ e^{-\left(\frac{\pi}{b}\right)^2\eta_{yj-1}\tau}\right)\right\}\times$$

$$\times\left\{\Theta_3\left(\frac{\pi(d_j-z_{0ij-1})}{2(d_j-d_{j-1})},\ e^{-\left(\frac{\pi}{d_j-d_{j-1}}\right)^2\eta_{zj-1}\tau}\right)+\right.$$

$$\left.+\Theta_3\left(\frac{\pi(d_j+z_{0ij-1}-2d_{j-1})}{2(d_j-d_{j-1})},\ e^{-\left(\frac{\pi}{d_j-d_{j-1}}\right)^2\eta_{zj-1}\tau}\right)\right\}d\tau+$$

$$+\frac{1}{2(\phi c_t)_{j-1}a}\sum_{i=L_r+1}^{M_r}U(t-t_{0ij-1})\int_0^{t-t_{0ij-1}}q_{ij-1}(t-t_{0ij}-\tau)\times$$

$$\times\left\{\Theta_3\left(\frac{\pi(x-x_{01ij-1})}{2a},\ e^{-\left(\frac{\pi}{a}\right)^2\eta_{xj-1}\tau}\right)+\Theta_3\left(\frac{\pi(x+x_{01ij-1})}{2a},\ e^{-\left(\frac{\pi}{a}\right)^2\eta_{xj-1}\tau}\right)\right\}\times$$

$$\times\left\{\Theta_3^f\left(\frac{\pi(y-y_{01ij-1})}{2b},\ e^{-\left(\frac{\pi}{b}\right)^2\eta_{yj-1}\tau}\right)-\Theta_3^f\left(\frac{\pi(y+y_{01ij-1})}{2b},\ e^{-\left(\frac{\pi}{b}\right)^2\eta_{yj-1}\tau}\right)-\right.$$

$$\left.-\Theta_3^f\left(\frac{\pi(y-y_{02ij-1})}{2b},\ e^{-\left(\frac{\pi}{b}\right)^2\eta_{yj-1}\tau}\right)+\Theta_3^f\left(\frac{\pi(y+y_{02ij-1})}{2b},\ e^{-\left(\frac{\pi}{b}\right)^2\eta_{yj-1}\tau}\right)\right\}\times$$

$$\times\left\{\Theta_3^f\left(\frac{\pi(d_j-z_{01ij-1})}{2(d_j-d_{j-1})},\ e^{-\left(\frac{\pi}{d_j-d_{j-1}}\right)^2\eta_{zj-1}\tau}\right)-\right.$$

$$-\Theta_3^f\left(\frac{\pi(d_j+z_{01ij-1}-2d_{j-1})}{2(d_j-d_{j-1})},\ e^{-\left(\frac{\pi}{d_j-d_{j-1}}\right)^2\eta_{zj-1}\tau}\right)-$$

$$-\Theta_3^f\left(\frac{\pi(d_j-z_{02ij-1})}{2(d_j-d_{j-1})},\ e^{-\left(\frac{\pi}{d_j-d_{j-1}}\right)^2\eta_{zj-1}\tau}\right)+$$

$$\left.+\Theta_3^f\left(\frac{\pi(d_j+z_{02ij-1}-2d_{j-1})}{2(d_j-d_{j-1})},\ e^{-\left(\frac{\pi}{d_j-d_{j-1}}\right)^2\eta_{zj-1}\tau}\right)\right\}d\tau+$$

TABLE 2-continued $$+\frac{1}{2(\phi c_t)_{j-1}b}\sum_{i=M_r+1}^{N_r} U(t-t_{0ij-1})\int_0^{t-t_{0ij-1}} q_{ij-1}(t-t_{0ij-1}-\tau)\times$$

$$\times\left\{\Theta_3^f\left(\frac{\pi(x-x_{01ij-1})}{2a}, e^{-\left(\frac{\pi}{a}\right)^2\eta_{xj-1}\tau}\right)-\Theta_3^f\left(\frac{\pi(x+x_{01ij-1})}{2a}, e^{-\left(\frac{\pi}{a}\right)^2\eta_{xj-1}\tau}\right)-\right.$$

$$\left.-\Theta_3^f\left(\frac{\pi(x-x_{02ij-1})}{2a}, e^{-\left(\frac{\pi}{a}\right)^2\eta_{xj-1}\tau}\right)-\Theta_3^f\left(\frac{\pi(x+x_{02ij-1})}{2a}, e^{-\left(\frac{\pi}{a}\right)^2\eta_{xj-1}\tau}\right)\right\}\times$$

$$\times\left\{\Theta_3\left(\frac{\pi(y-y_{0ij-1})}{2b}, e^{-\left(\frac{\pi}{b}\right)^2\eta_{yj-1}\tau}\right)+\Theta_3\left(\frac{\pi(y+y_{0ij-1})}{2b}, e^{-\left(\frac{\pi}{b}\right)^2\eta_{yj-1}\tau}\right)\right\}\times$$

$$\times\left\{\Theta_3^f\left(\frac{\pi(d_j-z_{01ij-1})}{2(d_j-d_{j-1})}, e^{-\left(\frac{\pi}{d_j-d_{j-1}}\right)^2\eta_{zj-1}\tau}\right)-\right.$$

$$-\Theta_3^f\left(\frac{\pi(d_j+z_{01ij-1}-2d_{j-1})}{2(d_j-d_{j-1})}, e^{-\left(\frac{\pi}{d_j-d_{j-1}}\right)^2\eta_{zj-1}\tau}\right)-$$

$$-\Theta_3^f\left(\frac{\pi(d_j-z_{02ij-1})}{2(d_j-d_{j-1})}, e^{-\left(\frac{\pi}{d_j-d_{j-1}}\right)^2\eta_{zj-1}\tau}\right)+$$

$$\left.+\Theta_3^f\left(\frac{\pi(d_j+z_{02ij-1}-2d_{j-1})}{2(d_j-d_{j-1})}, e^{-\left(\frac{\pi}{d_j-d_{j-1}}\right)^2\eta_{zj-1}\tau}\right)\right\}d\tau+$$

$$+\frac{1}{4(\phi c_t)_{j-1}ab(d_j-d_{j-1})}\int_0^t\int_0^b\int_0^{(d_j-d_{j-1})}\left[\psi_{0yzj-1}(v,w,\tau)\Theta_3\left(\frac{\pi x}{2a}, e^{-\left(\frac{\pi}{a}\right)^2\eta_{xj-1}(t-\tau)}\right)-\right.$$

$$\left.-\psi_{ayzj-1}(v,w,\tau)\Theta_4\left(\frac{\pi x}{2a}, e^{-\left(\frac{\pi}{a}\right)^2\eta_{xj-1}(t-\tau)}\right)\right]\times$$

$$\times\left[\Theta_3\left\{\frac{\pi(y-v)}{2b}, e^{-\left(\frac{\pi}{b}\right)^2\eta_{yj-1}(t-\tau)}\right\}+\Theta_3\left\{\frac{\pi(y+v)}{2b}, e^{-\left(\frac{\pi}{b}\right)^2\eta_{yj-1}(t-\tau)}\right\}\right]\times$$

$$\times\left[\Theta_3\left\{\frac{\pi(d_j-d_{j-1}-w)}{2(d_j-d_{j-1})}, e^{-\left(\frac{\pi}{d_j-d_{j-1}}\right)^2\eta_{zj-1}(t-\tau)}\right\}+\right.$$

$$\left.+\Theta_3\left\{\frac{\pi(d_j-d_{j-1}+w)}{2(d_j-d_{j-1})}, e^{-\left(\frac{\pi}{d_j-d_{j-1}}\right)^2\eta_{zj-1}(t-\tau)}\right\}\right]dvdwd\tau+$$

$$+\frac{1}{4(\phi c_t)_{j-1}ab(d_j-d_{j-1})}\int_0^t\int_0^a\int_0^{d_j-d_{j-1}}\left[\psi_{x0zj-1}(u,w,\tau)\Theta_3\left\{\frac{\pi y}{2b}, e^{-\left(\frac{\pi}{b}\right)^2\eta_{yj-1}(t-\tau)}\right\}-\right.$$

$$\left.-\psi_{xbzj-1}(u,w,\tau)\Theta_4\left\{\frac{\pi y}{2b}, e^{-\left(\frac{\pi}{b}\right)^2\eta_{yj-1}(t-\tau)}\right\}\right]\times$$

$$\times\left[\Theta_3\left\{\frac{\pi(x-u)}{2a}, e^{-\left(\frac{\pi}{a}\right)^2\eta_{xj-1}(t-\tau)}\right\}+\Theta_3\left\{\frac{\pi(x+u)}{2a}, e^{-\left(\frac{\pi}{a}\right)^2\eta_{xj-1}(t-\tau)}\right\}\right]\times$$

$$\times\left[\Theta_3\left\{\frac{\pi(d_j-d_{j-1}-w)}{2(d_j-d_{j-1})}, e^{-\left(\frac{\pi}{d_j-d_{j-1}}\right)^2\eta_{zj-1}(t-\tau)}\right\}+\right.$$

$$\left.+\Theta_3\left\{\frac{\pi(d_j-d_{j-1}+w)}{2(d_j-d_{j-1})}, e^{-\left(\frac{\pi}{d_j-d_{j-1}}\right)^2\eta_{zj-1}(t-\tau)}\right\}\right]dudwd\tau+$$

$$+\frac{1}{8ab(d_j-d_{j-1})}\times$$

$$\times\int_0^{d_j-d_{j-1}}\int_0^b\int_0^a\varphi(u,v,w+d_{j-1})\left[\Theta_3\left(\frac{\pi(x-u)}{2a}, e^{-\left(\frac{\pi}{a}\right)^2\eta_{zj-1}t}\right)+\Theta_3\left(\frac{\pi(x+u)}{2a}, e^{-\left(\frac{\pi}{a}\right)^2\eta_{zj-1}t}\right)\right]\times$$

$$\times\left[\Theta_3\left(\frac{\pi(y-v)}{2b}, e^{-\left(\frac{\pi}{b}\right)^2\eta_{yj-1}t}\right)+\Theta_3\left(\frac{\pi(y+v)}{2b}, e^{-\left(\frac{\pi}{b}\right)^2\eta_{yj-1}t}\right)\right]\times$$

$$\times\left[\Theta_3\left(\frac{\pi(d_j-d_{j-1}-w)}{2(d_j-d_{j-1})}, e^{-\left(\frac{\pi}{d_j-d_{j-1}}\right)^2\eta_{zj-1}t}\right)+\right.$$

$$\left.+\Theta_3\left(\frac{\pi(d_j-d_{j-1}+w)}{2(d_j-d_{j-1})}, e^{-\left(\frac{\pi}{d_j-d_{j-1}}\right)^2\eta_{zj-1}t}\right)\right]dudvdw-$$

TABLE 2-continued $$-\frac{1}{2(\phi c_t)_j ab}\sum_{i=1}^{L_t} U(t-t_{0ij})\int_0^{t-t_{0ij}} q_{1ij}(t-t_{0ij}-\tau)\times$$
$$\times\left\{\Theta_3\left(\frac{\pi(x-x_{0ij})}{2a}, e^{-\left(\frac{\pi}{a}\right)^2\eta_{xj}\tau}\right)+\Theta_3\left(\frac{\pi(x+x_{0ij})}{2a}, e^{-\left(\frac{\pi}{a}\right)^2\eta_{xj}\tau}\right)\right\}\times$$
$$\times\left\{\Theta_3\left(\frac{\pi(y-y_{0ij})}{2b}, e^{-\left(\frac{\pi}{b}\right)^2\eta_{yj}\tau}\right)+\Theta_3\left(\frac{\pi(y+y_{0ij})}{2b}, e^{-\left(\frac{\pi}{b}\right)^2\eta_{yj}\tau}\right)\right\}\times$$
$$\times\left\{\Theta_3^{f}\left(\frac{\pi(d_j-z_{01ij})}{2(d_{j+1}-d_j)}, e^{-\left(\frac{\pi}{d_{j+1}-d_j}\right)^2\eta_{zj}\tau}\right)-\Theta_3^{f}\left(\frac{\pi(d_j-z_{02ij})}{2(d_{j+1}-d_j)}, e^{-\left(\frac{\pi}{d_{j+1}-d_j}\right)^2\eta_{zj}\tau}\right)\right\}d\tau-$$

$$-\frac{1}{2(\phi c_t)_j b(d_{j+1}-d_j)}\times$$
$$\times\sum_{i=L_t+1}^{M_t} U(t-t_{0ij})\int_0^{t-t_{0ij}} q_{1ij}(t-t_{0ij}-\tau)\Theta_3\left(\frac{\pi(d_j-z_{0ij})}{2(d_{j+1}-d_j)}, e^{-\left(\frac{\pi}{d_{j+1}-d_j}\right)^2\eta_{zj}\tau}\right)\times$$
$$\times\left\{\Theta_3\left(\frac{\pi(y-y_{0ij})}{2b}, e^{-\left(\frac{\pi}{b}\right)^2\eta_{yj}\tau}\right)+\Theta_3\left(\frac{\pi(y+y_{0ij})}{2b}, e^{-\left(\frac{\pi}{b}\right)^2\eta_{yj}\tau}\right)\right\}\times$$
$$\times\left\{\Theta_3^{f}\left(\frac{\pi(x-x_{01ij})}{2b}, e^{-\left(\frac{\pi}{b}\right)^2\eta_{xj}\tau}\right)-\Theta_3^{f}\left(\frac{\pi(x+x_{01ij})}{2a}, e^{-\left(\frac{\pi}{a}\right)^2\eta_{xj}\tau}\right)-\right.$$
$$\left.-\Theta_3^{f}\left(\frac{\pi(x-x_{02ij})}{2a}, e^{-\left(\frac{\pi}{a}\right)^2\eta_{xj}\tau}\right)+\Theta_3^{f}\left(\frac{\pi(x+x_{02ij})}{2a}, e^{-\left(\frac{\pi}{a}\right)^2\eta_{xj}\tau}\right)\right\}d\tau-$$

$$-\frac{1}{2(\phi c_t)_j a(d_{j+1}-d_j)}\times$$
$$\times\sum_{i=M_r+1}^{N_t} U(t-t_{0ij})\int_0^{t-t_{0ij}} q_{1ij}(t-t_{0ij}-\tau)\Theta_3\left(\frac{\pi(d_j-z_{0ij})}{2(d_{j+1}-d_j)}, e^{-\left(\frac{\pi}{d_{j+1}-d_j}\right)^2\eta_{zj}\tau}\right)\times$$

$$\times\left\{\Theta_3\left(\frac{\pi(x-x_{0ij})}{2a}, e^{-\left(\frac{\pi}{a}\right)^2\eta_{zxj}\tau}\right)+\Theta_3\left(\frac{\pi(x+x_{0ij})}{2a}, e^{-\left(\frac{\pi}{a}\right)^2\eta_{xj}\tau}\right)\right\}\times$$
$$\times\left\{\Theta_3^{f}\left(\frac{\pi(y-y_{01ij})}{2b}, e^{-\left(\frac{\pi}{b}\right)^2\eta_{yj}\tau}\right)-\Theta_3^{f}\left(\frac{\pi(y+y_{01ij})}{2b}, e^{-\left(\frac{\pi}{b}\right)^2\eta_{yj}\tau}\right)-\right.$$
$$\left.-\Theta_3^{f}\left(\frac{\pi(y-y_{02ij})}{2b}, e^{-\left(\frac{\pi}{b}\right)^2\eta_{yj}\tau}\right)+\Theta_3^{f}\left(\frac{\pi(y+y_{02ij})}{2b}, e^{-\left(\frac{\pi}{b}\right)^2\eta_{yj}\tau}\right)\right\}d\tau-$$

$$\times\left\{\Theta_3\left(\frac{\pi}{2b}\{y-(z_{0ij}-\gamma_{0ij})\cot\vartheta_{0ij}\cos\theta_{0ij}\}, e^{-\left(\frac{\pi}{b}\right)^2\eta_{yj}\tau}\right)+\right.$$
$$\left.+\Theta_3\left(\frac{\pi}{2b}\{y+(z_{0ij}-\gamma_{0ij})\cot\vartheta_{0ij}\sin\theta_{0ij}\}, e^{-\left(\frac{\pi}{b}\right)^2\eta_{yj}\tau}\right)\right\}\times$$
$$\left.\times\Theta_3\left(\frac{\pi(d_j-z_{0ij})}{2(d_{j+1}-d_j)}, e^{-\left(\frac{\pi}{d_{j+1}-d_j}\right)^2\eta_{yj}\tau}\right)\right]dz_{0ij}d\tau-$$

$$-\frac{1}{(\phi c_t)_j(d_{j+1}-d_j)}\sum_{i=N_d+1}^{L_r} U(t-t_{0ij})\int_0^{t-t_{0ij}} q_{1ij}(t-t_{0ij}-\tau)\Theta_3\left\{\frac{\pi(d_j-z_{0ij})}{2(d_{j+1}-d_j)}, e^{-\left(\frac{\pi}{d_{j+1}-d_j}\right)^2\eta_{zj}\tau}\right\}\times$$
$$\times\left\{\Theta_3^{f}\left(\frac{\pi(x-x_{01ij})}{2a}, e^{-\left(\frac{\pi}{a}\right)^2\eta_{xj}\tau}\right)-\Theta_3^{f}\left(\frac{\pi(x+x_{01ij})}{2a}, e^{-\left(\frac{\pi}{a}\right)^2\eta_{xj}\tau}\right)-\right.$$
$$\left.-\Theta_3^{f}\left(\frac{\pi(x-x_{02ij})}{2a}, e^{-\left(\frac{\pi}{a}\right)^2\eta_{xj}\tau}\right)+\Theta_3^{f}\left(\frac{\pi(x+x_{02ij})}{2a}, e^{-\left(\frac{\pi}{a}\right)^2\eta_{xj}\tau}\right)\right\}\times$$
$$\times\left\{\Theta_3^{f}\left(\frac{\pi(y-y_{01ij})}{2b}, e^{-\left(\frac{\pi}{b}\right)^2\eta_{yj}\tau}\right)-\Theta_3^{f}\left(\frac{\pi(y+y_{01ij})}{2b}, e^{-\left(\frac{\pi}{b}\right)^2\eta_{yj}\tau}\right)-\right.$$
$$\left.-\Theta_3^{f}\left(\frac{\pi(y-y_{02ij})}{2b}, e^{-\left(\frac{\pi}{b}\right)^2\eta_{yj}\tau}\right)+\Theta_3^{f}\left(\frac{\pi(y+y_{02ij})}{2b}, e^{-\left(\frac{\pi}{b}\right)^2\eta_{yj}\tau}\right)\right\}d\tau-$$

TABLE 2-continued $$-\frac{1}{4(\phi c_t)_j ab(d_{j+1}-d_j)}\sum_{i=N_t+1}^{N_d} U(t-t_{0ij})\sin\vartheta_{0ij}\int_0^{t-t_{0ij}} q_{ij}(t-t_{0ij}-\tau)\times$$

$$\times\int_{z_{01ij}}^{z_{02ij}}\left[\left\{\Theta_3\left\{\frac{\pi}{2a}\{x-(z_{0ij}-\gamma_{0ij})\cot\vartheta_{0ij}\cos\theta_{0ij}\},\ e^{-\left(\frac{\pi}{a}\right)^2\eta_{xj}\tau}\right\}+\right.\right.$$

$$\left.+\Theta_3\left(\left\{\frac{\pi}{2a}\{x-(z_{0ij}-\gamma_{0ij})\cot\vartheta_{0ij}\cos\theta_{0ij}\},\ e^{-\left(\frac{\pi}{a}\right)^2\eta_{zj}\tau}\right)\right\}\times\right.$$

$$-\frac{1}{(\phi c_t)_j a}\sum_{i=L_r+1}^{M_r} U(t-t_{0ij})\int_0^{t-t_{0ij}} q_{ij}(t-t_{0ij}-\tau)\times$$

$$\times\left\{\Theta_3\left(\frac{\pi(x-x_{0ij})}{2a},\ e^{-\left(\frac{\pi}{a}\right)^2\eta_{xj}\tau}\right)+\Theta_3\left(\frac{\pi(x+x_{0ij})}{2a},\ e^{-\left(\frac{\pi}{a}\right)^2\eta_{xj}\tau}\right)\right\}\times$$

$$\times\left\{\Theta_3^{\int}\left(\frac{\pi(y-y_{01ij})}{2b},\ e^{-\left(\frac{\pi}{b}\right)^2\eta_{yj}\tau}\right)-\Theta_3^{\int}\left(\frac{\pi(y+y_{01ij})}{2b},\ e^{-\left(\frac{\pi}{b}\right)^2\eta_{yj}\tau}\right)-\right.$$

$$\left.-\Theta_3^{\int}\left(\frac{\pi(y-y_{02ij})}{2b},\ e^{-\left(\frac{\pi}{b}\right)^2\eta_{yj}\tau}\right)+\Theta_3^{\int}\left(\frac{\pi(y+y_{02ij})}{2b},\ e^{-\left(\frac{\pi}{b}\right)^2\eta_{yj}\tau}\right)\right\}\times$$

$$\times\left\{\Theta_3^{\int}\left(\frac{\pi(d_j-z_{01ij})}{2(d_{j+1}-d_j)},\ e^{-\left(\frac{\pi}{d_{j+1}-d_j}\right)^2\eta_{zj}\tau}\right)-\Theta_3^{\int}\left(\frac{\pi(d_j-z_{02ij})}{2(d_{j+1}-d_j)},\ e^{-\left(\frac{\pi}{d_{j+1}-d_j}\right)^2\eta_{zj}\tau}\right)\right\}d\tau-$$

$$-\frac{1}{(\phi c_t)_j b}\sum_{i=M_r+1}^{N_r} U(t-t_{0ij})\int_0^{t-t_{0ij}} q_{ij}(t-t_{0ij}-\tau)\times$$

$$\times\left\{\Theta_3^{\int}\left(\frac{\pi(x-x_{01ij})}{2a},\ e^{-\left(\frac{\pi}{a}\right)^2\eta_{xj}\tau}\right)+\Theta_3^{\int}\left(\frac{\pi(x+x_{01ij})}{2a},\ e^{-\left(\frac{\pi}{a}\right)^2\eta_{xj}\tau}\right)-\right.$$

$$\left.-\Theta_3^{\int}\left(\frac{\pi(x-x_{02ij})}{2a},\ e^{-\left(\frac{\pi}{a}\right)^2\eta_{xj}\tau}\right)+\Theta_3^{\int}\left(\frac{\pi(x+x_{02ij})}{2a},\ e^{-\left(\frac{\pi}{a}\right)^2\eta_{xj}\tau}\right)\right\}\times$$

$$\times\left\{\Theta_3\left(\frac{\pi(y-y_{0ij})}{2b},\ e^{-\left(\frac{\pi}{b}\right)^2\eta_{yj}\tau}\right)+\Theta_3\left(\frac{\pi(y+y_{0ij})}{2b},\ e^{-\left(\frac{\pi}{b}\right)^2\eta_{yj}\tau}\right)\right\}\times$$

$$\times\left\{\Theta_3^{\int}\left(\frac{\pi(d_j-z_{01ij})}{2(d_{j+1}-d_j)},\ e^{-\left(\frac{w}{d_{j+1}-d_j}\right)^2\eta_{zj}\tau}\right)-\Theta_3^{\int}\left(\frac{\pi(d_j-z_{02ij})}{2(d_{j+1}-d_j)},\ e^{-\left(\frac{\pi}{d_{j+1}-d_j}\right)^2\eta_{zj}\tau}\right)\right\}d\tau-$$

$$-\frac{1}{2(\phi c_t)_j ab(d_{j+1}-d_j)}\int_0^t\int_0^b\int_0^{d_{j+1}-d_j}\left[\psi_{0yzj}(v,w,\tau)\Theta_3\left\{\frac{\pi x}{2a},\ e^{-\left(\frac{\pi}{a}\right)^2\eta_{xj}(t-\tau)}\right\}-\right.$$

$$\left.-\psi_{ayzj}(v,w,\tau)\Theta_4\left\{\frac{\pi x}{2a},\ e^{-\left(\frac{\pi}{a}\right)^2\eta_{xj}(t-\tau)}\right\}\right]\Theta_3\left(\frac{\pi w}{2(d_{j+1}-d_j)},\ e^{-\left(\frac{\pi}{d_{j+1}-d_j}\right)^2\eta_{zj}(t-\tau)}\right)\times$$

$$\times\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]dvdwd\tau-$$

$$-\frac{1}{2(\phi c_t)_j ab(d_{j+1}-d_j)}\int_0^t\int_0^a\int_0^{d_{j+1}-d_j}\left[\psi_{x0zj}(u,w,\tau)\Theta_3\left\{\frac{\pi y}{2b},\ e^{-\left(\frac{\pi y}{b}\right)^2\eta_{yj}(t-\tau)}\right\}-\right.\tag{0.8}$$

$$\left.-\psi_{xbzj}(u,w,\tau)\Theta_4\left(\frac{\pi y}{2b},\ e^{-\left(\frac{\pi}{b}\right)^2\eta_{yj}(t-\tau)}\right)\right]\Theta_3\left(\frac{\pi w}{2(d_{j+1}-d_j)},\ e^{-\left(\frac{\pi}{d_{j+1}-d_j}\right)^2\eta_{zj}(t-\tau)}\right)\times$$

$$\times\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]dudwd\tau-$$

$$-\frac{1}{4ab(d_{j+1}-d_j)}\int_0^{d_{j+1}-d_j}\int_0^b\int_0^a\varphi_j(u,v,w+d_j)\Theta_3\left\{\frac{\pi w}{2(d_{j+1}-d_j)},\ e^{-\left(\frac{\pi}{d_{j+1}-d_j}\right)^2\eta_{zj}t}\right\}\times$$

$$\times\left[\Theta_3\left(\frac{\pi(x-u)}{2a},\ e^{-\left(\frac{\pi}{a}\right)^2\eta_{xj}t}\right)+\Theta_3\left(\frac{\pi(x+u)}{2a},\ e^{-\left(\frac{\pi}{a}\right)^2\eta_{xj}t}\right)\right]\times$$

$$\times\left[\Theta_3\left(\frac{\pi(y-v)}{2b},\ e^{-\left(\frac{\pi}{b}\right)^2\eta_{yj}t}\right)+\Theta_3\left(\frac{\pi(y+v)}{2b},\ e^{-\left(\frac{\pi}{b}\right)^2\eta_{yj}t}\right)\right]dudvdw$$

$$j\times\left\{\Theta_3\left(\frac{\pi(y-y_{0ij})}{2b},\ e^{-\left(\frac{\pi}{b}\right)^2\eta_{yj}\tau}\right)+\Theta_3\left(\frac{\pi(y-y_{0ij})}{2b},\ e^{-\left(\frac{\pi}{b}\right)^2\eta_{yj}\tau}\right)\right\}\times\times\left\{\Theta_3^{\int}\left(\frac{\pi(z-z_{01ij})}{2(d_{j+1}-d_j)},\ e^{-\left(\frac{\pi}{d_{j+1}-d_j}\right)^2\eta_{zj}\tau}\right)-\right.$$

$$\Theta_3^{\int}\left(\frac{\pi(z+z_{01ij}-2d_j)}{2(d_{j+1}-d_j)},\ e^{-\left(\frac{\pi}{d_{j+1}-d_j}\right)^2\eta_{zj}\tau}\right)--\Theta_3^{\int}\left(\frac{\pi(z-z_{02ij})}{2(d_{j+1}-d_j)},\ e^{-\left(\frac{\pi}{d_{j+1}-d_j}\right)^2\eta_{zj}\tau}\right)+\Theta 3\int\pi z+z02ij-2dj2dj+1-dj,$$

TABLE 2-continued $$e - \pi dj + 1 - dj2\eta zj\tau d\tau + \times \Theta 3\pi y - y0ij2b,\ e - \pi b2\eta yj\tau + \Theta 3\pi y + y0ij2b,\ e - \pi b2\eta yj\tau \times$$

$$\times \left\{ \Theta_3\left( \frac{\pi(z - z_{0ij})}{2(d_{j+1} - d_j)},\ e^{-\left(\frac{\pi}{d_{j+1}-d_j}\right)^2 \eta_{zj}\tau} \right) + \Theta_3\left( \frac{\pi(z + z_{0ij} - 2d_j)}{2(d_{j+1} - d_j)},\ e^{-\left(\frac{\pi}{d_{j+1}-d_j}\right)^2 \eta_{zj}\tau} \right) \right\} \times \times$$

$$\left\{ \Theta_3\int\left( \frac{\pi(x - x_{01ij})}{2a},\ e^{-\left(\frac{\pi}{a}\right)^2 \eta_{xj}\tau} \right) - \Theta_3\int\left( \frac{\pi(x + x_{01ij})}{2a},\ e^{-\left(\frac{\pi}{a}\right)^2 \eta_{xj}\tau} \right) - \times \left[ \Theta_3\left( \frac{\pi(x - u)}{2a},\ e^{-\left(\frac{\pi}{a}\right)^2 \eta_{xj}t} \right) + \right.\right.$$

$$\left.\left. \Theta_3\left( \frac{\pi(x + u)}{2a},\ e^{-\left(\frac{\pi}{a}\right)^2 \eta_{xj}t} \right) \right] \times \times \left[ \Theta_3\left( \frac{\pi(y - v)}{2b},\ e^{-\left(\frac{\pi}{b}\right)^2 \eta_{yj}t} \right) + \Theta 3\pi y + v2b,\ e - \pi b2\eta yjtdudvbdw \right.$$

* For i = 1, 2 . . . $N_l$ $q_{ij}$ is flux per unit length in layer j and for i = $N_l$ + 1, . . . $N_r$ $q_{ij}$ is flux per unit area in layer Based on the derivation shown in TABLE 2, the general expressions for the hydrocarbon production occurring through multiple vertical wells, horizontal wells, multiple deviated wells, and multiple fractures in a reservoir (e.g., the reservoir (800)) are shown in TABLEs 3 through 7.

TABLE 3

The spatial average pressure response of the line $[z_{02\diamond j} - z_{01\diamond j}]$, $\iota = \diamond$, $1 \le \diamond \le L_\iota$ is given by.

$$p_j = \frac{(d_{j+1} - d_j)}{2(\phi c_t)_j ab(z_{02\diamond j} - z_{01\diamond jj})} \sum_{i=1}^{L_\iota} U(t - t_{0ij}) \int_0^{t - t_{0ij}} q_{ij}(t - t_{0ij} - \tau) \times \tag{0.9}$$

$$\times \left\{ \Theta_3\left( \frac{\pi(x - x_{0ij})}{2a},\ e^{-\left(\frac{\pi}{a}\right)^2 \eta_{xj}\tau} \right) + \Theta_3\left( \frac{\pi(x + x_{0ij})}{2a},\ e^{-\left(\frac{\pi}{a}\right)^2 \eta_{xj}\tau} \right) \right\} \times$$

$$\times \left\{ \Theta_3\left( \frac{\pi(y - y_{01ij})}{2b},\ e^{-\left(\frac{\pi}{b}\right)^2 \eta_{yj}\tau} \right) + \Theta_3\left( \frac{\pi(y + y_{01ij})}{2b},\ e^{-\left(\frac{\pi}{b}\right)^2 \eta_{yj}\tau} \right) \right\} \times$$

$$\times \left\{ \Theta_3\int\int\left( \frac{\pi(z_{02\diamond j} - z_{01ij})}{2(d_{j+1} - d_j)},\ e^{-\left(\frac{\pi}{d_{j+1}-d_j}\right)^2 \eta_{zj}\tau} \right) - \Theta_3\int\int\left( \frac{\pi(z_{01\diamond j} - z_{01ij})}{2(d_{j+1} - d_j)},\ e^{-\left(\frac{\pi}{d_{j+1}-d_j}\right)^2 \eta_{zj}\tau} \right) - \right.$$

$$-\Theta_3\int\int\left( \frac{\pi(z_{02\diamond j} + z_{01ij} - 2d_j)}{2(d_{j+1} - d_j)},\ e^{-\left(\frac{\pi}{d_{j+1}-d_j}\right)^2 \eta_{zj}\tau} \right) + \Theta_3\int\int\left( \frac{\pi(z_{01\diamond j} + z_{01ij} - 2d_j)}{2(d_{j+1} - d_j)},\ e^{-\left(\frac{\pi}{d_{j+1}-d_j}\right)^2 \eta_{zj}\tau} \right) -$$

$$-\Theta_3\int\int\left( \frac{\pi(z_{02\diamond j} - 2_{02ij})}{2(d_{j+1} - d_j)},\ e^{-\left(\frac{\pi}{d_{j+1}-d_j}\right)^2 \eta_{zj}\tau} \right) + \Theta_3\int\int\left( \frac{\pi(z_{02\diamond j} - 2_{01ij})}{2(d_{j+1} - d_j)},\ e^{-\left(\frac{\pi}{d_{j+1}-d_j}\right)^2 \eta_{zj}\tau} \right) +$$

$$\left. +\Theta_3\int\int\left( \frac{\pi(z_{02\diamond j} + z_{02ij} - 2d_j)}{2(d_{j+1} - d_j)},\ e^{-\left(\frac{\pi}{d_{j+1}-d_j}\right)^2 \eta_{zj}\tau} \right) - \Theta_3\int\int\left( \frac{\pi(z_{01\diamond j} + z_{02ij} - 2d_j)}{2(d_{j+1} - d_j)},\ e^{-\left(\frac{\pi}{d_{j+1}-d_j}\right)^2 \eta_{zj}\tau} \right) \right\} d\tau +$$

$$+ \frac{1}{2(\phi c_t)_j b(z_{02\diamond j} - z_{01\diamond jj})} \sum_{i=L_\iota+1}^{M_\iota} U(t - t_{0ij}) \int_0^{t - t_{0ij}} q_{ij}(t - t_{0ij} - \tau) \times$$

$$\times \left\{ \Theta_3\left( \frac{\pi(y - y_{0ij})}{2b},\ e^{-\left(\frac{\pi}{b}\right)^2 \eta_{yj}\tau} \right) + \Theta_3\left( \frac{\pi(y + y_{0ij})}{2b},\ e^{-\left(\frac{\pi}{b}\right)^2 \eta_{yj}\tau} \right) \right\} \times$$

$$\times \left\{ \Theta_3\int\left\{ \frac{\pi(z_{02\diamond j} - z_{0ij})}{2(d_{j+1} - d_j)},\ e^{-\left(\frac{\pi}{d_{j+1}-d_j}\right)^2 \eta_{zj}(t-\tau)} \right\} - \Theta_3\int\left\{ \frac{\pi(z_{01\diamond j} - z_{0ij})}{2(d_{j+1} - d_j)},\ e^{-\left(\frac{\pi}{d_{j+1}-d_j}\right)^2 \eta_{zj}(t-\tau)} \right\} + \right.$$

$$\left. +\Theta_3\int\left\{ \frac{\pi(z_{02\diamond j} + z_{0ij} - 2d_j)}{2(d_{j+1} - d_j)},\ e^{-\left(\frac{\pi}{d_{j+1}-d_j}\right)^2 \eta_{zj}(t-\tau)} \right\} - \Theta_3\int\left\{ \frac{\pi(z_{01\diamond j} + z_{0ij} - 2d_j)}{2(d_{j+1} - d_j)},\ e^{-\left(\frac{\pi}{d_{j+1}-d_j}\right)^2 \eta_{zj}(t-\tau)} \right\} \right\} \times$$

$$\times \left\{ \Theta_3\int\left( \frac{\pi(x - x_{01ij})}{2a},\ e^{-\left(\frac{\pi}{a}\right)^2 \eta_{xj}\tau} \right) - \Theta_3\int\left( \frac{\pi(x + x_{01ij})}{2a},\ e^{-\left(\frac{\pi}{a}\right)^2 \eta_{xj}\tau} \right) - \right.$$

$$\left. -\Theta_3\int\left( \frac{\pi(x - x_{02ij})}{2a},\ e^{-\left(\frac{\pi}{a}\right)^2 \eta_{xj}\tau} \right) + \Theta_3\int\left( \frac{\pi(x + x_{02ij})}{2a},\ e^{-\left(\frac{\pi}{a}\right)^2 \eta_{xj}\tau} \right) \right\} d\tau +$$

TABLE 3-continued

The spatial average pressure response of the line $[z_{02\diamond j} - z_{01\diamond j}]$, $\iota = \diamond$, $1 \le \diamond \le L_\iota$ is given by.

$$+\frac{1}{2(\phi c_t)_j a(z_{02\diamond j} - z_{01\diamond j})}\sum_{i=M_t+1}^{N_t} U(t - t_{0ij})\int_0^{t-t_{0ij}} q_{ij}(t - t_{0ij} - \tau)\times$$

$$\times\left\{\Theta_3\left(\frac{\pi(x - x_{0ij})}{2a}, e^{-\left(\frac{\pi}{a}\right)^2\eta_{xj}\tau}\right) + \Theta_3\left(\frac{\pi(x + x_{0ij})}{2a}, e^{-\left(\frac{\pi}{a}\right)^2\eta_{xj}\tau}\right)\right\}\times$$

$$\times\left\{\Theta_3^f\left\{\frac{\pi(z_{02\diamond j} - z_{0ij})}{2(d_{j+1} - d_j)}, e^{-\left(\frac{\pi}{d_{j+1}-d_j}\right)^2\eta_{zj}(t-\tau)}\right\} - \Theta_3^f\left\{\frac{\pi(z_{01\diamond j} - z_{0ij})}{2(d_{j+1} - d_j)}, e^{-\left(\frac{\pi}{d_{j+1}-d_j}\right)^2\eta_{zj}(t-\tau)}\right\} +\right.$$

$$\left.+\Theta_3^f\left\{\frac{\pi(z_{02\diamond j} + z_{0ij} - 2d_j)}{2(d_{j+1} - d_j)}, e^{-\left(\frac{\pi}{d_{j+1}-d_j}\right)^2\eta_{zj}(t-\tau)}\right\} - \Theta_3^f\left\{\frac{\pi(z_{01\diamond j} + z_{0ij} - 2d_j)}{2(d_{j+1} - d_j)}, e^{-\left(\frac{\pi}{d_{j+1}-d_j}\right)^2\eta_{zj}(t-\tau)}\right\}\right\}\times$$

$$\times\left\{\Theta_3^f\left(\frac{\pi(y - y_{01ij})}{2b}, e^{-\left(\frac{\pi}{b}\right)^2\eta_{yj}\tau}\right) - \Theta_3^f\left(\frac{\pi(y + y_{01ij})}{2b}, e^{-\left(\frac{\pi}{b}\right)^2\eta_{yj}\tau}\right) -\right.$$

$$\left.-\Theta_3^f\left(\frac{\pi(y - y_{02ij})}{2b}, e^{-\left(\frac{\pi}{b}\right)^2\eta_{yj}\tau}\right) + \Theta_3^f\left(\frac{\pi(y + y_{02ij})}{2b}, e^{-\left(\frac{\pi}{b}\right)^2\eta_{yj}\tau}\right)\right\}d\tau +$$

$$+\frac{1}{4\pi(\phi c_t)_j ab(z_{02\diamond j} - z_{01\diamond jj})}\sum_{i=N_t+1}^{N_d} U(t - t_{0ij})\sin\vartheta_{0ij}\times$$

$$\times\int_0^{t-t_{0ij}} q_j(t - t_{0ij} - \tau)\int_{z01ij}^{z02ij}\left[\left\{\Theta_3\left(\frac{\pi}{2a}\{x - (z_{0ij} - \gamma_{0ij})\cot\vartheta_{0ij}\cos\theta_{0ij}\}, e^{-\left(\frac{\pi}{a}\right)^2\eta_{xj}\tau}\right) +\right.\right.$$

$$\left.+\Theta_3\left(\frac{\pi}{2a}\{x + (z_{0ij} - \gamma_{0ij})\cot\vartheta_{0ij}\cos\theta_{0ij}\}, e^{-\left(\frac{\pi}{a}\right)^2\eta_{xj}\tau}\right)\right\}\times$$

$$\times\left\{\Theta_3\left(\frac{\pi}{2b}\{y - (z_{0ij} - \gamma_{0ij})\cot\vartheta_{0ij}\sin\theta_{0ij}\}, e^{-\left(\frac{\pi}{b}\right)^2\eta_{yj}\tau}\right) +\right.$$

$$\left.+\Theta_3\left(\frac{\pi}{2b}\{y + (z_{0ij} - \gamma_{0ij})\cot\vartheta_{0ij}\sin\theta_{0ij}\}, e^{-\left(\frac{\pi}{b}\right)^2\eta_{yj}\tau}\right)\right\}\times$$

$$\times\left\{\Theta_3^f\left(\frac{\pi(z_{02\diamond jj} - z_{0ij})}{2(d_{j+1} - d_j)}, e^{-\eta_{zj}\left(\frac{\pi}{d_{j+1}-d_j}\right)^2 t}\right) - \Theta_3^f\left(\frac{\pi(z_{01\diamond j} - z_{0ij})}{2(d_{j+1} - d_j)}, e^{-\eta_{zj}\left(\frac{\pi}{d_{j+1}-d_j}\right)^2 t}\right) +\right.$$

$$\left.\left.+\Theta_3^f\left(\frac{\pi(z_{02\diamond j} + z_{0ij} - 2d_j)}{2(d_{j+1} - d_j)}, e^{-\eta_{zj}\left(\frac{\pi}{d_{j+1}-d_j}\right)^2 t}\right) - \Theta_3^f\left(\frac{\pi(z_{01\diamond j} + z_{0ij} - 2d_j)}{2(d_{j+1} - d_j)}, e^{-\eta_{zj}\left(\frac{\pi}{d_{j+1}-d_j}\right)^2 t}\right)\right\}\right]dz_{0ij}d\tau +$$

$$+\frac{1}{(\phi c_t)_j(z_{02\diamond j} - z_{01\diamond j})}\sum_{i=N_d+1}^{L_r} U(t - t_{0ij})\int_0^{t-t_{0ij}} q_{ij}(t - t_{0ij} - \tau)\times$$

$$\times\left\{\Theta_3^f\left(\frac{\pi(x - x_{01ij})}{2a}, e^{-\left(\frac{\pi}{a}\right)^2\eta_{xj}\tau}\right) - \Theta_3^f\left(\frac{\pi(x + x_{01ij})}{2a}, e^{-\left(\frac{\pi}{a}\right)^2\eta_{zj}\tau}\right) -\right.$$

$$\left.-\Theta_3^f\left(\frac{\pi(x - x_{02ij})}{2a}, e^{-\left(\frac{\pi}{a}\right)^2\eta_{xj}\tau}\right) + \Theta_3^f\left(\frac{\pi(x + x_{02ij})}{2a}, e^{-\left(\frac{\pi}{a}\right)^2\eta_{zj}\tau}\right)\right\}\times$$

$$\times\left\{\Theta_3^f\left(\frac{\pi(y - y_{01ij})}{2b}, e^{-\left(\frac{\pi}{b}\right)^2\eta_{yj}\tau}\right) - \Theta_3^f\left(\frac{\pi(y + y_{01ij})}{2b}, e^{-\left(\frac{\pi}{b}\right)^2\eta_{yj}\tau}\right) -\right.$$

$$\left.-\Theta_3^f\left(\frac{\pi(y - y_{02ij})}{2b}, e^{-\left(\frac{\pi}{b}\right)^2\eta_{yj}\tau}\right) + \Theta_3^f\left(\frac{\pi(y + y_{02ij})}{2b}, e^{-\left(\frac{\pi}{b}\right)^2\eta_{yj}\tau}\right)\right\}\times$$

$$\times\left\{\Theta_3^f\left\{\frac{\pi(z_{02\diamond j} - z_{0ij})}{2(d_{j+1} - d_j)}, e^{-\left(\frac{\pi}{d_{j+1}-d_j}\right)^2\eta_{zj}(t-\tau)}\right\} - \Theta_3^f\left\{\frac{\pi(z_{01\diamond j} - z_{0ij})}{2(d_{j+1} - d_j)}, e^{-\left(\frac{\pi}{d_{j+1}-d_j}\right)^2\eta_{zj}(t-\tau)}\right\} +\right.$$

$$\left.\times\Theta_3^f\left\{\frac{\pi(z_{02\diamond j} + z_{0ij} - 2d_j)}{2(d_{j+1} - d_j)}, e^{-\left(\frac{\pi}{d_{j+1}-d_j}\right)^2\eta_{zj}(t-\tau)}\right\} - \Theta_3^f\left\{\frac{\pi(z_{01\diamond j} + z_{0ij} - 2d_j)}{2(d_{j+1} - d_j)}, e^{-\left(\frac{\pi}{d_{j+1}-d_j}\right)^2\eta_{zj}(t-\tau)}\right\}\right\}d\tau +$$

TABLE 3-continued

The spatial average pressure response of the line $[z_{02\diamond j} - z_{01\diamond j}]$, $\iota = \diamond$, $1 \le \diamond \le L_\iota$ is given by.

$$+\frac{1}{(\phi c_t)_j a(z_{02\diamond j} - z_{01\diamond jj})}\sum_{i=L_r+1}^{M_r} U(t - t_{0ij})\int_0^{t-t_{0ij}} q_{ij}(t - t_{0ij} - \tau)\times$$

$$\times\left\{\Theta_3\left(\frac{\pi(x - x_{0ij})}{2a}, e^{-\left(\frac{\pi}{a}\right)^2\eta_{xj}\tau}\right) + \Theta_3\left(\frac{\pi(x + x_{0ij})}{2a}, e^{-\left(\frac{\pi}{a}\right)^2\eta_{xj}\tau}\right)\right\}\times$$

$$\times\left\{\Theta_3^{\int}\left(\frac{\pi(y - y_{01ij})}{2b}, e^{-\left(\frac{\pi}{b}\right)^2\eta_{yj}\tau}\right) - \Theta_3^{\int}\left(\frac{\pi(y + y_{01ij})}{2b}, e^{-\left(\frac{\pi}{b}\right)^2\eta_{yj}\tau}\right) -\right.$$

$$\left.-\Theta_3^{\int}\left(\frac{\pi(y - y_{02ij})}{2b}, e^{-\left(\frac{\pi}{b}\right)^2\eta_{yj}\tau}\right) + \Theta_3^{\int}\left(\frac{\pi(y + y_{02ij})}{2b}, e^{-\left(\frac{\pi}{b}\right)^2\eta_{yj}\tau}\right)\right\}\times$$

$$\times\left\{\Theta_3^{\int\int}\left(\frac{\pi(z_{02\diamond j} - z_{01ij})}{2(d_{j+1} - d_j)}, e^{-\left(\frac{\pi}{d_{j+1}-d_j}\right)^2\eta_{zj}\tau}\right) - \Theta_3^{\int\int}\left(\frac{\pi(z_{01\diamond j} - z_{01ij})}{2(d_{j+1} - d_j)}, e^{-\left(\frac{\pi}{d_{j+1}-d_j}\right)^2\eta_{zj}\tau}\right) -\right.$$

$$-\Theta_3^{\int\int}\left(\frac{\pi(z_{02\diamond j} + z_{01ij} - 2d_j)}{2(d_{j+1} - d_j)}, e^{-\left(\frac{\pi}{d_{j+1}-d_j}\right)^2\eta_{zj}\tau}\right) + \Theta_3^{\int\int}\left(\frac{\pi(z_{01\diamond j} + z_{01ij} - 2d_j)}{2(d_{j+1} - d_j)}, e^{-\left(\frac{\pi}{d_{j+1}-d_j}\right)^2\eta_{zj}\tau}\right) -$$

$$-\Theta_3^{\int\int}\left(\frac{\pi(z_{02\diamond j} - z_{02ij})}{2(d_{j+1} - d_j)}, e^{-\left(\frac{\pi}{d_{j+1}-d_j}\right)^2\eta_{zj}\tau}\right) + \Theta_3^{\int\int}\left(\frac{\pi(z_{02\diamond j} - z_{0ij})}{2(d_{j+1} - d_j)}, e^{-\left(\frac{\pi}{d_{j+1}-d_j}\right)^2\eta_{zj}\tau}\right) +$$

$$\left.+\Theta_3^{\int\int}\left(\frac{\pi(z_{02\diamond j} + z_{02ij} - 2d_j)}{2(d_{j+1} - d_j)}, e^{-\left(\frac{\pi}{d_{j+1}-d_j}\right)^2\eta_{zj}\tau}\right) - \Theta_3^{\int\int}\left(\frac{\pi(z_{01\diamond j} + z_{02ij} - 2d_j)}{2(d_{j+1} - d_j)}, e^{-\left(\frac{\pi}{d_{j+1}-d_j}\right)^2\eta_{zj}\tau}\right)\right\}d\tau +$$

$$+\frac{1}{(\phi c_t)_j b(z_{02\diamond j} - z_{01\diamond jj})}\sum_{i=M_r+1}^{N_r} U(t - t_{0ij})\int_0^{t-t_{0ij}} q_{ij}(t - t_{0ij} - \tau)\times$$

$$\times\left\{\Theta_3^{\int}\left(\frac{\pi(x - x_{01ij})}{2a}, e^{-\left(\frac{\pi}{a}\right)^2\eta_{xj}\tau}\right) - \Theta_3^{\int}\left(\frac{\pi(x + x_{01ij})}{2a}, e^{-\left(\frac{\pi}{a}\right)^2\eta_{xj}\tau}\right) -\right.$$

$$\left.-\Theta_3^{\int}\left(\frac{\pi(x - x_{02ij})}{2a}, e^{-\left(\frac{\pi}{a}\right)^2\eta_{xj}\tau}\right) + \Theta_3^{\int}\left(\frac{\pi(x + x_{02ij})}{2a}, e^{-\left(\frac{\pi}{a}\right)^2\eta_{xj}\tau}\right)\right\}\times$$

$$\times\left\{\Theta_3\left(\frac{\pi(y - y_{0ij})}{2b}, e^{-\left(\frac{\pi}{b}\right)^2\eta_{yj}\tau}\right) + \Theta_3\left(\frac{\pi(y + y_{0ij})}{2b}, e^{-\left(\frac{\pi}{b}\right)^2\eta_{yj}\tau}\right)\right\}\times$$

$$\times\left\{\Theta_3^{\int\int}\left(\frac{\pi(z_{02\diamond j} - z_{01ij})}{2(d_{j+1} - d_j)}, e^{-\left(\frac{\pi}{d_{j+1}-d_j}\right)^2\eta_{zj}\tau}\right) + \Theta_3^{\int\int}\left(\frac{\pi(z_{01\diamond j} - z_{01ij})}{2(d_{j+1} - d_j)}, e^{-\left(\frac{\pi}{d_{j+1}-d_j}\right)^2\eta_{zj}\tau}\right) -\right.$$

$$-\Theta_3^{\int\int}\left(\frac{\pi(z_{02\diamond j} + z_{01ij} - 2d_j)}{2(d_{j+1} - d_j)}, e^{-\left(\frac{\pi}{d_{j+1}-d_j}\right)^2\eta_{zj}\tau}\right) + \Theta_3^{\int\int}\left(\frac{\pi(z_{01\diamond j} + z_{01ij} - 2d_j)}{2(d_{j+1} - d_j)}, e^{-\left(\frac{\pi}{d_{j+1}-d_j}\right)^2\eta_{zj}\tau}\right) -$$

$$-\Theta_3^{\int\int}\left(\frac{\pi(z_{02\diamond j} - z_{02ij})}{2(d_{j+1} - d_j)}, e^{-\left(\frac{\pi}{d_{j+1}-d_j}\right)^2\eta_{zj}\tau}\right) + \Theta_3^{\int\int}\left(\frac{\pi(z_{02\diamond j} - z_{01ij})}{2(d_{j+1} - d_j)}, e^{-\left(\frac{\pi}{d_{j+1}-d_j}\right)^2\eta_{zj}\tau}\right) +$$

$$\left.+\Theta_3^{\int\int}\left(\frac{\pi(z_{02\diamond j} + z_{02ij} - 2d_j)}{2(d_{j+1} - d_j)}, e^{-\left(\frac{\pi}{d_{j+1}-d_j}\right)^2\eta_{zj}\tau}\right) - \Theta_3^{\int\int}\left(\frac{\pi(z_{01\diamond j} + z_{02ij} - 2d_j)}{2(d_{j+1} - d_j)}, e^{-\left(\frac{\pi}{d_{j+1}-d_j}\right)^2\eta_{zj}\tau}\right)\right\}d\tau +$$

$$+\frac{1}{2(\phi c_t)_j ab(z_{02\diamond j} - z_{01\diamond jj})}\times\int_0^t\int_0^a\int_0^b\left[\psi_j(u, v, \tau)\left\{\Theta_3^{\int}\left\{\frac{\pi(z_{02\diamond j} - d_j)}{2(d_{j+1} - d_j)}, e^{-\left(\frac{\pi}{d_{j+1}-d_j}\right)^2\eta_{zj}(t-\tau)}\right\} -\right.\right.$$

$$\left.-\Theta_3^{\int}\left\{\frac{\pi(z_{01\diamond j} - d_j)}{2(d_{j+1} - d_j)}, e^{-\left(\frac{\pi}{d_{j+1}-d_j}\right)^2\eta_{zj}(t-\tau)}\right\}\right\} -$$

$$-\psi_{j+1}(u, v, \tau)\left\{\Theta_4^{\int}\left\{\frac{\pi(z_{02\diamond j} - d_j)}{2(d_{j+1} - d_j)}, e^{-\left(\frac{\pi}{d_{j+1}-d_j}\right)^2\eta_{zj}(t-\tau)}\right\} -\right.$$

$$\left.\left.-\Theta_4^{\int}\left\{\frac{\pi(z_{01\diamond j} - d_j)}{2(d_{j+1} - d_j)}, e^{-\left(\frac{\pi}{d_{j+1}-d_j}\right)^2\eta_{zj}(t-\tau)}\right\}\right\}\right]\times$$

TABLE 3-continued

The spatial average pressure response of the line $[z_{02\diamond j} - z_{01\diamond j}]$, $\iota = \diamond$, $1 \le \diamond \le L_\iota$ is given by.

$$\times\left[\Theta_3\left\{\frac{\pi(x-u)}{2a}, e^{-\left(\frac{\pi}{a}\right)^2\eta_{xj}(t-\tau)}\right\} + \Theta_3\left\{\frac{\pi(x+u)}{2a}, e^{-\left(\frac{\pi}{a}\right)^2\eta_{xj}(t-\tau)}\right\}\right]\times$$
$$\times\left[\Theta_3\left\{\frac{\pi(y-v)}{2b}, e^{-\left(\frac{\pi}{b}\right)^2\eta_{yj}(t-\tau)}\right\} + \Theta_3\left\{\frac{\pi(y+v)}{2b}, e^{-\left(\frac{\pi}{b}\right)^2\eta_{yj}(t-\tau)}\right\}\right]dudvd\tau +$$

$$+\frac{1}{2(\phi c_t)_j ab(z_{02\diamond j} - z_{01\diamond j})}\times$$
$$\times\int_0^t\int_0^b\int_0^{d_{j+1}-d_j}\left\{\psi_{0yzj}(v, w, \tau)\Theta_3\left(\frac{\pi x}{2a}, e^{-\left(\frac{\pi}{a}\right)^2\eta_{xj}(t-\tau)}\right) - \psi_{axyzj}(v, w, \tau)\Theta_4\left(\frac{\pi x}{2a}, e^{-\left(\frac{\pi}{a}\right)^2\eta_{xj}(t-\tau)}\right)\right\}\times$$
$$\times\left\{\Theta_3\left\{\frac{\pi(y-v)}{2b}, e^{-\left(\frac{\pi}{b}\right)^2\eta_{yj}(t-\tau)}\right\} + \Theta_3\left\{\frac{\pi(y+v)}{2b}, e^{-\left(\frac{\pi}{b}\right)^2\eta_{yj}(t-\tau)}\right\}\right\}\times$$
$$\times\left\{\Theta_3^{\int}\left\{\frac{\pi(z_{02\diamond jj} - d_j - w)}{2(d_{j+1} - d_j)}, e^{-\left(\frac{\pi}{d_{j+1}-d_j}\right)^2\eta_{zj}(t-\tau)}\right\} - \Theta_3^{\int}\left\{\frac{\pi(z_{01\diamond jj} - d_j - w)}{2(d_{j+1} - d_j)}, e^{-\left(\frac{\pi}{d_{j+1}-d_j}\right)^2\eta_{zj}(t-\tau)}\right\} +\right.$$
$$\left.\times\Theta_3^{\int}\left\{\frac{\pi(z_{02\diamond jj} - d_j + w)}{2(d_{j+1} - d_j)}, e^{-\left(\frac{\pi}{d_{j+1}-d_j}\right)^2\eta_{zj}(t-\tau)}\right\} - \Theta_3^{\int}\left\{\frac{\pi(z_{01\diamond j} - d_j + w)}{2(d_{j+1} - d_j)}, e^{-\left(\frac{\pi}{d_{j+1}-d_j}\right)^2\eta_{zj}(t-\tau)}\right\}\right\}dvdwd\tau +$$

$$+\frac{1}{2(\phi c_t)_j ab(z_{02\diamond j} - z_{01\diamond jj})}\times$$
$$\times\int_0^t\int_0^a\int_0^{d_{j+1}-d_j}\left\{\psi_{x0zj}(v, w, \tau)\Theta_3\left(\frac{\pi y}{2b}, e^{-\left(\frac{\pi}{b}\right)^2\eta_{yj}(t-\tau)}\right) - \psi_{xbzj}(u, w, \tau)\Theta_4\left(\frac{\pi y}{2b}, e^{-\left(\frac{\pi}{b}\right)^2\eta_{yj}(t-\tau)}\right)\right\}\times$$
$$\times\left[\Theta_3\left\{\frac{\pi(x-u)}{2a}, e^{-\left(\frac{\pi}{a}\right)^2\eta_{xj}(t-\tau)}\right\} + \Theta_3\left(\frac{\pi(x+u)}{2a}, e^{-\left(\frac{\pi}{a}\right)^2\eta_{xj}(t-\tau)}\right)\right]\times$$
$$\times\left\{\Theta_3^{\int}\left\{\frac{\pi(z_{02\diamond jj} - d_j - w)}{2(d_{j+1} - d_j)}, e^{-\left(\frac{\pi}{d_{j+1}-d_j}\right)^2\eta_{zj}(t-\tau)}\right\} - \Theta_3^{\int}\left\{\frac{\pi(z_{01\diamond jj} - d_j - w)}{2(d_{j+1} - d_j)}, e^{-\left(\frac{\pi}{d_{j+1}-d_j}\right)^2\eta_{zj}(t-\tau)}\right\} +\right.$$
$$\left.\times\Theta_3^{\int}\left\{\frac{\pi(z_{02\diamond jj} - d_j + w)}{2(d_{j+1} - d_j)}, e^{-\left(\frac{\pi}{d_{j+1}-d_j}\right)^2\eta_{zj}(t-\tau)}\right\} - \Theta_3^{\int}\left\{\frac{\pi(z_{01\diamond j} - d_j + w)}{2(d_{j+1} - d_j)}, e^{-\left(\frac{\pi}{d_{j+1}-d_j}\right)^2\eta_{zj}(t-\tau)}\right\}\right\}dvdwd\tau +$$

$$+\frac{1}{4ab(z_{02\diamond j} - z_{01\diamond jj})}\times$$
$$\times\int_0^{d_{j+1}-d_j}\int_0^b\int_0^a\varphi_j\left\{(u, v, w + d_j)\left[\left\{\Theta_3\left(\frac{\pi(x-u)}{2a}, e^{-\left(\frac{\pi}{a}\right)^2\eta_{xjt}}\right) + \Theta_3\left(\frac{\pi(x+u)}{2a}, e^{-\left(\frac{\pi}{a}\right)^2\eta_{xjt}}\right)\right\}\times\right.\right.$$
$$\times\left\{\Theta_3\left(\frac{\pi(y-v)}{2b}, e^{-\left(\frac{\pi}{b}\right)^2\eta_{yjt}}\right) + \Theta_3\left(\frac{\pi(y+v)}{2b}, e^{-\left(\frac{\pi}{b}\right)^2\eta_{yjt}}\right)\right\}\times$$
$$\times\left\{\Theta_3^{\int}\left(\frac{\pi(z_{02\diamond jj} - d_j - w)}{2(d_{j+1} - d_j)}, e^{-\left(\frac{\pi}{d_{j+1}-d_j}\right)^2\eta_{zjt}}\right) - \Theta_3^{\int}\left(\frac{\pi(z_{01\diamond jj} - d_j - w)}{2(d_{j+1} - d_j)}, e^{-\left(\frac{\pi}{d_{j+1}-d_j}\right)^2\eta_{zjt}}\right) +\right.$$
$$\left.\left.\times\left\{\Theta_3^{\int}\left(\frac{\pi(z_{02\diamond jj} - d_j + w)}{2(d_{j+1} - d_j)}, e^{-\left(\frac{\pi}{d_{j+1}-d_j}\right)^2\eta_{zjt}}\right) - \Theta_3^{\int}\left(\frac{\pi(z_{01\diamond jj} - d_j + w)}{2(d_{j+1} - d_j)}, e^{-\left(\frac{\pi}{d_{j+1}-d_j}\right)^2\eta_{zj}}\right)\right\}\right\}dudvdw$$

TABLE 4

The spatial average pressure response of the line $[x_{02\diamond j} - x_{01\diamond j}]$, $\iota = \diamond$, $L_{\iota+1} \le \diamond \le M_\iota$ is given by.

$$
\begin{aligned}
p_j = {} & \frac{1}{2(\phi c_t)_j\, b(x_{02\diamond j} - x_{01\diamond jj})} \sum_{i=1}^{L_\iota} U(t - t_{0ij}) \int_0^{t-t_{0ij}} q_{ij}(t - t_{0ij} - \tau) \times \\
& \times \left\{ \Theta_3^{\int}\left( \frac{\pi(x_{02\diamond j} - x_{01ij})}{2a}, e^{-\left(\frac{\pi}{a}\right)^2 \eta_{xj}\tau} \right) - \Theta_3^{\int}\left( \frac{\pi(x_{01\diamond j} - x_{0ij})}{2a}, e^{-\left(\frac{\pi}{a}\right)^2 \eta_{xj}\tau} \right) + \right. \\
& \left. + \Theta_3^{\int}\left( \frac{\pi(x_{02\diamond j} + x_{0ij})}{2a}, e^{-\left(\frac{\pi}{a}\right)^2 \eta_{xj}\tau} \right) - \Theta_3^{\int}\left( \frac{\pi(x_{01\diamond j} + x_{0ij})}{2a}, e^{-\left(\frac{\pi}{a}\right)^2 \eta_{xj}\tau} \right) \right\} \times \\
& \times \left\{ \Theta_3\left( \frac{\pi(y - y_{0ij})}{2b}, e^{-\left(\frac{\pi}{b}\right)^2 \eta_{yj}\tau} \right) + \Theta_3\left( \frac{\pi(y + y_{0ij})}{2b}, e^{-\left(\frac{\pi}{b}\right)^2 \eta_{yj}\tau} \right) \right\} \times \\
& \times \left\{ \Theta_3^{\int}\left( \frac{\pi(z - z_{01ij})}{2(d_{j+1} - d_j)}, e^{-\left(\frac{\pi}{d_{j+1} - d_j}\right)^2 \eta_{zj}\tau} \right) - \Theta_3^{\int}\left( \frac{\pi(z + z_{01ij} - 2d_j)}{2(d_{j+1} - d_j)}, e^{-\left(\frac{\pi}{d_{j+1} - d_j}\right)^2 \eta_{zj}\tau} \right) - \right. \\
& \left. - \Theta_3^{\int}\left( \frac{\pi(z - z_{02ij})}{2(d_{j+1} - d_j)}, e^{-\left(\frac{\pi}{d_{j+1} - d_j}\right)^2 \eta_{zj}\tau} \right) + \Theta_3^{\int}\left( \frac{\pi(z + z_{02ij} - 2d_j)}{2(d_{j+1} - d_j)}, e^{-\left(\frac{\pi}{d_{j+1} - d_j}\right)^2 \eta_{zj}t} \right) \right\} d\tau + \\
& + \frac{a}{2(\phi c_t)_j\, b(d_{j+1} - d_j)(x_{02\diamond j} - x_{01\diamond jj})} \sum_{i=L_\iota+1}^{M_\iota} U(t - t_{0ij}) \int_0^{t-t_{0ij}} q_{ij}(t - t_{0ij} - \tau) \times \\
& \times \left\{ \Theta_3\left( \frac{\pi(y - y_{0ij})}{2b}, e^{-\left(\frac{\pi}{b}\right)^2 \eta_{yj}\tau} \right) + \Theta_3\left( \frac{\pi(y + y_{0ij})}{2b}, e^{-\left(\frac{\pi}{b}\right)^2 \eta_{yj}\tau} \right) \right\} \times \\
& \times \left\{ \Theta_3\left( \frac{\pi(z - z_{0ij})}{2(d_{j+1} - d_j)}, e^{-\left(\frac{\pi}{d_{j+1} - d_j}\right)^2 \eta_{zj}\tau} \right) + \Theta_3\left( \frac{\pi(z + z_{0ij} - 2d_j)}{2(d_{j+1} - d_j)}, e^{-\left(\frac{\pi}{d_{j+1} - d_j}\right)^2 \eta_{zj}t} \right) \right\} \times \\
& \times \left\{ \Theta_3^{\int\int}\left( \frac{\pi(x_{02\diamond j} - x_{01ij})}{2a}, e^{-\left(\frac{\pi}{a}\right)^2 \eta_{xj}\tau} \right) - \Theta_3^{\int\int}\left( \frac{\pi(x_{01\diamond j} - x_{01ij})}{2a}, e^{-\left(\frac{\pi}{a}\right)^2 \eta_{xj}\tau} \right) - \right. \\
& - \Theta_3^{\int\int}\left( \frac{\pi(x_{02\diamond j} + x_{01ij})}{2a}, e^{-\left(\frac{\pi}{a}\right)^2 \eta_{xj}\tau} \right) + \Theta_3^{\int\int}\left( \frac{\pi(x_{01\diamond j} + x_{01ij})}{2a}, e^{-\left(\frac{\pi}{a}\right)^2 \eta_{xj}\tau} \right) - \\
& - \Theta_3^{\int\int}\left( \frac{\pi(x_{02\diamond j} - x_{02ij})}{2a}, e^{-\left(\frac{\pi}{a}\right)^2 \eta_{xj}\tau} \right) + \Theta_3^{\int\int}\left( \frac{\pi(x_{01\diamond j} - x_{02ij})}{2a}, e^{-\left(\frac{\pi}{a}\right)^2 \eta_{xj}\tau} \right) + \\
& \left. + \Theta_3^{\int\int}\left( \frac{\pi(x_{02\diamond j} + x_{02ij})}{2a}, e^{-\left(\frac{\pi}{a}\right)^2 \eta_{xj}\tau} \right) - \Theta_3^{\int\int}\left( \frac{\pi(x_{01\diamond j} + x_{02ij})}{2a}, e^{-\left(\frac{\pi}{a}\right)^2 \eta_{xj}\tau} \right) \right\} d\tau + \\
& + \frac{1}{2(\phi c_t)_j (d_{j+1} - d_j)(x_{02\diamond j} - x_{01\diamond j})} \sum_{i=M_\iota+1}^{N_\iota} U(t - t_{0ij}) \int_0^{t-t_{0ij}} q_{ij}(t - t_{0ij} - \tau) \times \\
& \times \left\{ \Theta_3^{\int}\left( \frac{\pi(x_{02\diamond j} - x_{0ij})}{2a}, e^{-\left(\frac{\pi}{a}\right)^2 \eta_{xj}\tau} \right) - \Theta_3^{\int}\left( \frac{\pi(x_{01\diamond j} - x_{0ij})}{2a}, e^{-\left(\frac{\pi}{a}\right)^2 \eta_{xj}\tau} \right) + \right. \\
& \left. + \Theta_3^{\int}\left( \frac{\pi(x_{02\diamond j} + x_{0ij})}{2a}, e^{-\left(\frac{\pi}{a}\right)^2 \eta_{xj}\tau} \right) - \Theta_3^{\int}\left( \frac{\pi(x_{01\diamond j} + x_{0ij})}{2a}, e^{-\left(\frac{\pi}{a}\right)^2 \eta_{xj}\tau} \right) \right\} \times \\
& \times \left\{ \Theta_3\left( \frac{\pi(z - z_{01ij})}{2(d_{j+1} - d_j)}, e^{-\left(\frac{\pi}{d_{j+1} - d_j}\right)^2 \eta_{zj}\tau} \right) + \Theta_3\left( \frac{\pi(z + z_{0ij} - 2d_j)}{2(d_{j+1} - d_j)}, e^{-\left(\frac{\pi}{d_{j+1} - d_j}\right)^2 \eta_{zj}\tau} \right) \right\} \times \\
& \times \left\{ \Theta_3^{\int}\left( \frac{\pi(y - y_{01ij})}{2b}, e^{-\left(\frac{\pi}{b}\right)^2 \eta_{yj}\tau} \right) - \Theta_3^{\int}\left( \frac{\pi(y + y_{01ij})}{2b}, e^{-\left(\frac{\pi}{b}\right)^2 \eta_{yj}\tau} \right) - \right. \\
& \left. - \Theta_3^{\int}\left( \frac{\pi(y - y_{02ij})}{2b}, e^{-\left(\frac{\pi}{b}\right)^2 \eta_{yj}\tau} \right) + \Theta_3^{\int}\left( \frac{\pi(y + y_{02ij})}{2b}, e^{-\left(\frac{\pi}{b}\right)^2 \eta_{yj}\tau} \right) \right\} d\tau + \\
& + \frac{1}{4\pi(\phi c_t)_j\, b(d_{j+1} - d_j)(x_{02\diamond j} - x_{01\diamond jj})} \sum_{i=N_\iota+1}^{N_d} U(t - t_{0ij}) \sin\vartheta_{0ij} \times \\
& \times \int_0^{t-t_{0ij}} q_{ij}(t - t_{0ij} - \tau) \int_{z01ij}^{z02ij} \left[ \left\{ \Theta_3\left( \frac{\pi}{2b}\{y - (z_{0ij} - \gamma_{0ij}) \cot\vartheta_{0ij} \cos\theta_{0ij}\}, e^{-\left(\frac{\pi}{b}\right)^2 \eta_{yj}\tau} \right) + \right. \right. \\
& \left. + \Theta_3\left( \frac{\pi}{2b}\{y - (z_{0ij} - \gamma_{0ij}) \cot\vartheta_{0ij} \cos\theta_{0ij}\}, e^{-\left(\frac{\pi}{b}\right)^2 \eta_{yj}\tau} \right) \right\} \times \\
& \times \left\{ \Theta_3^{\int}\left( \frac{\pi}{2a}\{x_{02\diamond j} - (z_{0ij} - \gamma_{0ij}) \cot\vartheta_{0ij} \sin\theta_{0ij}\}, e^{-\left(\frac{\pi}{a}\right)^2 \eta_{xj}\tau} \right) - \right. \\
& - \Theta_3^{\int}\left( \frac{\pi}{2a}\{x_{01\diamond j} - (z_{0ij} - \gamma_{0ij}) \cot\vartheta_{0ij} \sin\theta_{0ij}\}, e^{-\left(\frac{\pi}{a}\right)^2 \eta_{xj}\tau} \right) + \\
& + \Theta_3^{\int}\left( \frac{\pi}{2a}\{x_{02\diamond j} + (z_{0ij} - \gamma_{0ij}) \cot\vartheta_{0ij} \sin\theta_{0ij}\}, e^{-\left(\frac{\pi}{a}\right)^2 \eta_{xj}\tau} \right) - \\
& \left. - \Theta_3^{\int}\left( \frac{\pi}{2a}\{x_{01\diamond j} + (z_{0ij} - \gamma_{0ij}) \cot\vartheta_{0ij} \sin\theta_{0ij}\}, e^{-\left(\frac{\pi}{a}\right)^2 \eta_{xj}\tau} \right) \right\} \times \\
& \left. \times \left\{ \Theta_3\left( \frac{\pi}{2d}(z - z_{0ij}), e^{-\left(\frac{\pi}{d}\right)^2 \eta_{yj}\tau} \right) + \Theta_3\left( \frac{\pi}{2d}(z + z_{0ij}), e^{-\left(\frac{\pi}{d}\right)^2 \eta_{yj}\tau} \right) \right\} \right] dz_{0ij}\, d\tau +
\end{aligned}
\tag{0.10}
$$

TABLE 4-continued

The spatial average pressure response of the line $[x_{02\diamond j} - x_{01\diamond j}]$, $\iota = \diamond$, $L_{\iota+1} \le \diamond \le M_\iota$ is given by.

$$+\frac{a}{(\phi c_t)_j(d_{j+1}-d_j)(x_{02\diamond j}-x_{01\diamond jj})}\sum_{i=N_d+1}^{L_r} U(t-t_{0ij})\int_0^{t-t_{0ij}} q_{ij}(t-t_{0ij}-\tau)\times$$

$$\times\left\{\Theta_3^{\int\int}\left(\frac{\pi(x_{02\diamond j}-x_{01ij})}{2a}, e^{-\left(\frac{\pi}{a}\right)^2\eta_{xj}\tau}\right)-\Theta_3^{\int\int}\left(\frac{\pi(x_{01\diamond j}-x_{01ij})}{2a}, e^{-\left(\frac{\pi}{a}\right)^2\eta_{xj}\tau}\right)-\right.$$

$$-\Theta_3^{\int\int}\left(\frac{\pi(x_{02\diamond j}+x_{01ij})}{2a}, e^{-\left(\frac{\pi}{a}\right)^2\eta_{xj}\tau}\right)+\Theta_3^{\int\int}\left(\frac{\pi(x_{01\diamond j}+x_{01ij})}{2a}, e^{-\left(\frac{\pi}{a}\right)^2\eta_{xj}\tau}\right)-$$

$$-\Theta_3^{\int\int}\left(\frac{\pi(x_{02\diamond j}-x_{02ij})}{2a}, e^{-\left(\frac{\pi}{a}\right)^2\eta_{xj}\tau}\right)+\Theta_3^{\int\int}\left(\frac{\pi(x_{01\diamond j}-x_{02ij})}{2a}, e^{-\left(\frac{\pi}{a}\right)^2\eta_{xj}\tau}\right)+$$

$$\left.+\Theta_3^{\int\int}\left(\frac{\pi(x_{02\diamond j}+x_{02ij})}{2a}, e^{-\left(\frac{\pi}{a}\right)^2\eta_{xj}\tau}\right)-\Theta_3^{\int\int}\left(\frac{\pi(x_{01\diamond j}+x_{02ij})}{2a}, e^{-\left(\frac{\pi}{a}\right)^2\eta_{xj}\tau}\right)\right\}\times$$

$$\times\left\{\Theta_3^{\int}\left(\frac{\pi(y-y_{01ij})}{2b}, e^{-\left(\frac{\pi}{b}\right)^2\eta_{yj}\tau}\right)-\Theta_3^{\int}\left(\frac{\pi(y+y_{01ij})}{2b}, e^{-\left(\frac{\pi}{b}\right)^2\eta_{yj}\tau}\right)-\right.$$

$$\left.-\Theta_3^{\int}\left(\frac{\pi(y-y_{02ij})}{2b}, e^{-\left(\frac{\pi}{b}\right)^2\eta_{yj}\tau}\right)+\Theta_3^{\int}\left(\frac{\pi(y+y_{02ij})}{2b}, e^{-\left(\frac{\pi}{b}\right)^2\eta_{yj}\tau}\right)\right\}\times$$

$$\times\left\{\Theta_3\left(\frac{\pi(z-z_{0ij})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)}, e^{-\left(\frac{\pi}{d_{j+1}-d_j}\right)^2\eta_{zj}\tau}\right)\right\}d\tau+$$

$$+\frac{1}{(\phi c_t)_j(x_{02\diamond j}-x_{01\diamond jj})}\sum_{i=L_r+1}^{M_r} U(t-t_{0ij})\int_0^{t-t_{0ij}} q_{ij}(t-t_{0ij}-\tau)\times$$

$$\times\left\{\Theta_3^{\int}\left(\frac{\pi(x_{02\diamond j}-x_{0ij})}{2a}, e^{-\left(\frac{\pi}{a}\right)^2\eta_{xj}\tau}\right)-\Theta_3^{\int}\left(\frac{\pi(x_{01\diamond j}-x_{0ij})}{2a}, e^{-\left(\frac{\pi}{a}\right)^2\eta_{xj}\tau}\right)+\right.$$

$$\left.+\Theta_3^{\int}\left(\frac{\pi(x_{02\diamond j}+x_{0ij})}{2a}, e^{-\left(\frac{\pi}{a}\right)^2\eta_{xj}\tau}\right)-\Theta_3^{\int}\left(\frac{\pi(x_{01\diamond j}+x_{0ij})}{2a}, e^{-\left(\frac{\pi}{a}\right)^2\eta_{xj}\tau}\right)\right\}\times$$

$$\times\left\{\Theta_3^{\int}\left(\frac{\pi(y-y_{01ij})}{2b}, e^{-\left(\frac{\pi}{a}\right)^2\eta_{yj}\tau}\right)-\Theta_3^{\int}\left(\frac{\pi(y+y_{01ij})}{2b}, e^{-\left(\frac{\pi}{b}\right)^2\eta_{yj}\tau}\right)-\right.$$

$$\left.-\Theta_3^{\int}\left(\frac{\pi(y-y_{02ij})}{2b}, e^{-\left(\frac{\pi}{b}\right)^2\eta_{yj}\tau}\right)+\Theta_3^{\int}\left(\frac{\pi(y+y_{02ij})}{2b}, e^{-\left(\frac{\pi}{b}\right)^2\eta_{yj}\tau}\right)\right\}\times$$

$$\times\left\{\Theta_3^{\int}\left(\frac{\pi(z-z_{01ij})}{2(d_{j+1}-d_j)}, e^{-\left(\frac{\pi}{d_{j+1}-d_j}\right)^2\eta_{zj}\tau}\right)-\Theta_3^{\int}\left(\frac{\pi(z+z_{01\diamond j}-2d_j)}{2(d_{j+1}-d_j)}, e^{-\left(\frac{\pi}{d_{j+1}-d_j}\right)^2\eta_{zj}\tau}\right)-\right.$$

$$\left.-\Theta_3^{\int}\left(\frac{\pi(z-z_{02ij})}{2(d_{j+1}-d_j)}, e^{-\left(\frac{\pi}{d_{j+1}-d_j}\right)^2\eta_{zj}\tau}\right)+\Theta_3^{\int}\left(\frac{\pi(z+z_{02ij}-2d_j)}{2(d_{j+1}-d_j)}, e^{-\left(\frac{\pi}{d_{j+1}-d_j}\right)^2\eta_{zj}\tau}\right)\right\}d\tau+$$

$$+\frac{a}{(\phi c_t)_j b(x_{02\diamond j}-x_{01\diamond jj})}\sum_{i=M_r+1}^{N_r} U(t-t_{0ij})\int_0^{t-t_{0ij}} q_{ij}(t-t_{0ij}-\tau)\times$$

$$\times\left\{\Theta_3^{\int\int}\left(\frac{\pi(x_{02\diamond j}-x_{01ij})}{2a}, e^{-\left(\frac{\pi}{a}\right)^2\eta_{xj}\tau}\right)-\Theta_3^{\int\int}\left(\frac{\pi(x_{01\diamond j}-x_{01ij})}{2a}, e^{-\left(\frac{\pi}{a}\right)^2\eta_{xj}\tau}\right)-\right.$$

$$-\Theta_3^{\int\int}\left(\frac{\pi(x_{02\diamond j}+x_{01ij})}{2a}, e^{-\left(\frac{\pi}{a}\right)^2\eta_{xj}\tau}\right)+\Theta_3^{\int\int}\left(\frac{\pi(x_{01\diamond j}+x_{01ij})}{2a}, e^{-\left(\frac{\pi}{a}\right)^2\eta_{xj}\tau}\right)-$$

$$-\Theta_3^{\int\int}\left(\frac{\pi(x_{02\diamond j}-x_{02ij})}{2a}, e^{-\left(\frac{\pi}{a}\right)^2\eta_{xj}\tau}\right)+\Theta_3^{\int\int}\left(\frac{\pi(x_{01\diamond j}+x_{02ij})}{2a}, e^{-\left(\frac{\pi}{a}\right)^2\eta_{xj}\tau}\right)+$$

$$\left.+\Theta_3^{\int\int}\left(\frac{\pi(x_{02\diamond j}+x_{02ij})}{2a}, e^{-\left(\frac{\pi}{a}\right)^2\eta_{xj}\tau}\right)-\Theta_3^{\int\int}\left(\frac{\pi(x_{01\diamond j}+x_{02ij})}{2a}, e^{-\left(\frac{\pi}{a}\right)^2\eta_{xj}\tau}\right)\right\}\times$$

$$\times\left\{\Theta_3\left(\frac{\pi(y-y_{0ij})}{2b}, e^{-\left(\frac{\pi}{b}\right)^2\eta_{yj}\tau}\right)+\Theta_3\left(\frac{\pi(y+y_{0ij})}{2b}, e^{-\left(\frac{\pi}{b}\right)^2\eta_{yj}\tau}\right)\right\}\times$$

$$\times\left\{\Theta_3^{\int}\left(\frac{\pi(z-z_{01ij})}{2(d_{j+1}-d_j)}, e^{-\left(\frac{\pi}{d_{j+1}-d_j}\right)^2\eta_{zj}\tau}\right)-\Theta_3^{\int}\left(\frac{\pi(z+z_{01\diamond j}-2d_j)}{2(d_{j+1}-d_j)}, e^{-\left(\frac{\pi}{d_{j+1}-d_j}\right)^2\eta_{zj}\tau}\right)-\right.$$

$$\left.-\Theta_3^{\int}\left(\frac{\pi(z-z_{02ij})}{2(d_{j+1}-d_j)}, e^{-\left(\frac{\pi}{d_{j+1}-d_j}\right)^2\eta_{zj}\tau}\right)+\Theta_3^{\int}\left(\frac{\pi(z+z_{02\diamond j}-2d_j)}{2(d_{j+1}-d_j)}, e^{-\left(\frac{\pi}{d_{j+1}-d_j}\right)^2\eta_{zj}\tau}\right)\right\}d\tau+$$

TABLE 4-continued

The spatial average pressure response of the line $[x_{02\diamond j} - x_{01\diamond j}]$, $\iota = \diamond$, $L_{\iota+1} \le \diamond \le M_\iota$ is given by.

$$+\frac{1}{2(\phi c_t)_j b(d_{j+1}-d_j)(x_{02\diamond j}-x_{01\diamond jj})}\times\int_0^t\int_0^a\int_0^b\left\{\psi_j(u,v,\tau)\Theta_3\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}-\right.$$

$$\left.-\psi_{j+1}(u,v,\tau)\Theta_4\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}\right]\times$$

$$\times\left[\Theta_3^f\left\{\frac{\pi(x_{02\diamond j}-u)}{2a},\ e^{-\left(\frac{\pi}{a}\right)^2\eta_{xj}(t-\tau)}\right\}-\Theta_3^f\left\{\frac{\pi(x_{01\diamond j}-u)}{2a},\ e^{-\left(\frac{\pi}{a}\right)^2\eta_{xj}(t-\tau)}\right\}+\right.$$

$$\left.+\Theta_3^f\left\{\frac{\pi(x_{02\diamond j}+u)}{2a},\ e^{-\left(\frac{\pi}{a}\right)^2\eta_{xj}(t-\tau)}\right\}-\Theta_3^f\left\{\frac{\pi(x_{01\diamond j}+u)}{2a},\ e^{-\left(\frac{\pi}{a}\right)^2\eta_{xj}(t-\tau)}\right\}\right]\times$$

$$\times\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]dudvd\tau+$$

$$+\frac{1}{2(\phi c_t)_j b(d_{j+1}-d_j)(x_{02\diamond j}-x_{01\diamond jj})}\times$$

$$\times\int_0^t\int_0^b\int_0^{d_{j+1}-d_j}\left\{\psi_{0yzj}(v,w,\tau)\left\{\Theta_3^f\left(\frac{\pi x_{02\diamond j}}{2a},\ e^{-\left(\frac{\pi}{a}\right)^2\eta_{xj}(t-\tau)}\right)-\Theta_3^f\left(\frac{\pi x_{01\diamond j}}{2a},\ e^{-\left(\frac{\pi}{a}\right)^2\eta_{xj}(t-\tau)}\right)\right\}-\right.$$

$$\left.-\psi_{ayzj}(v,w,\tau)\left\{\Theta_4^f\left(\frac{\pi x_{02\diamond j}}{2a},\ e^{-\left(\frac{\pi}{a}\right)^2\eta_{xj}(t-\tau)}\right)-\Theta_4^f\left(\frac{\pi x_{01\diamond j}}{2a},\ e^{-\left(\frac{\pi}{a}\right)^2\eta_{xj}(t-\tau)}\right)\right\}\right\}\times$$

$$\times\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]\times$$

$$\times\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]dudwd\tau+$$

$$+\frac{1}{2(\phi c_t)_j b(d_{j+1}-d_j)(x_{02\diamond j}-x_{01\diamond jj})}\times$$

$$\times\int_0^t\int_0^a\int_0^{d_{j+1}-d_j}\left\{\psi_{x0zj}(u,w,\tau)\Theta_3\left(\frac{\pi y}{2b},\ e^{-\left(\frac{\pi}{b}\right)^2\eta_{yj}(t-\tau)}\right)-\psi_{xbzj}(u,w,\tau)\Theta_4\left(\frac{\pi y}{2b},\ e^{-\left(\frac{\pi}{b}\right)^2\eta_{yj}(t-\tau)}\right)\right\}$$

$$\times\left[\Theta_3^f\left\{\frac{\pi(x_{02\diamond j}-u)}{2a},\ e^{-\left(\frac{\pi}{a}\right)^2\eta_{xj}(t-\tau)}\right\}-\Theta_3^f\left\{\frac{\pi(x_{01\diamond j}-u)}{2a},\ e^{-\left(\frac{\pi}{a}\right)^2\eta_{xj}(t-\tau)}\right\}+\right.$$

$$\left.+\Theta_3^f\left\{\frac{\pi(x_{02\diamond j}+u)}{2a},\ e^{-\left(\frac{\pi}{a}\right)^2\eta_{xj}(t-\tau)}\right\}-\Theta_3^f\left\{\frac{\pi(x_{01\diamond j}+u)}{2a},\ e^{-\left(\frac{\pi}{a}\right)^2\eta_{xj}(t-\tau)}\right\}\right]\times$$

$$\times\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]dudwd\tau+$$

$$+\frac{1}{4(d_{j+1}-d_j)(x_{02\diamond j}-x_{01\diamond jj})}\times\int_0^{d_{j+1}-d_j}\int_0^b\int_0^a\varphi_j(u,v,w+d_j)\times$$

$$\times\left[\Theta_3^f\left\{\frac{\pi(x_{02\diamond j}-u)}{2a},\ e^{-\left(\frac{\pi}{a}\right)^2\eta_{xj}(t-\tau)}\right\}-\Theta_3^f\left\{\frac{\pi(x_{01\diamond j}-u)}{2a},\ e^{-\left(\frac{\pi}{a}\right)^2\eta_{xj}(t-\tau)}\right\}+\right.$$

$$\left.+\Theta_3^f\left\{\frac{\pi(x_{02\diamond j}+u)}{2a},\ e^{-\left(\frac{\pi}{a}\right)^2\eta_{xj}(t-\tau)}\right\}-\Theta_3^f\left\{\frac{\pi(x_{01\diamond j}+u)}{2a},\ e^{-\left(\frac{\pi}{a}\right)^2\eta_{xj}(t-\tau)}\right\}\right]\times$$

$$\times\left\{\Theta_3\left(\frac{\pi(y-v)}{2b},\ e^{-\left(\frac{\pi}{b}\right)^2\eta_{yj}t}\right)+\Theta_3\left(\frac{\pi(y+v)}{2b},\ e^{-\left(\frac{\pi}{b}\right)^2\eta_{yj}t}\right)\right\}\times$$

$$\times\left\{\Theta_3\left\{\frac{\pi(z-d_j-w)}{2(d_{j+1}-d_j)},\ e^{-\left(\frac{\pi}{d_{j+1}-d_j}\right)^2\eta_{zj}t}\right\}+\Theta_3\left\{\frac{\pi(z-d_j+w)}{2(d_{j+1}-d_j)},\ e^{-\left(\frac{\pi}{d_{j+1}-d_j}\right)^2\eta_{zj}t}\right\}\right\}dudvdw$$

TABLE 5

The spatial average pressure response of the inclined line $[(z_{02\diamond j} - z_{01\diamond j})\sin\vartheta_{0\diamond j}]$, $i = \diamond j$, $N_{t+1} \le \diamond \le N_d$ is given by.

$$
\begin{aligned}
p = {} & \frac{1}{4\pi ab\,(\phi c_t)_j (z_{02\diamond j} - z_{01\diamond jj})} \times \qquad (0.11)\\
& \times \sum_{i=1}^{L_t} U(t - t_{0ij}) \int_0^{t-t_{0ij}} \Bigg[ q_{ij}(t - t_{0ij} - \tau) \int_{z_{01\diamond j}}^{z_{02\diamond j}} \Bigg\{ \Theta_3\Big(\frac{\pi}{2a}((z - \gamma_{0\diamond j})\cot\vartheta_{0\diamond j}\cos\theta_{0\diamond j} - x_{0ij}),\ e^{-\left(\frac{\pi}{a}\right)^2 \eta_{xj}\tau}\Big) + \\
& + \Theta_3\Big(\frac{\pi}{2a}((z - \gamma_{0\diamond j})\cot\vartheta_{0\diamond j}\cos\theta_{0\diamond j} + x_{0ij}),\ e^{-\left(\frac{\pi}{a}\right)^2 \eta_{xj}\tau}\Big)\Bigg\} \times \\
& \times \Bigg\{ \Theta_3\Big(\frac{\pi}{2b}((z - \gamma_{0\diamond j})\cot\vartheta_{0\diamond j}\sin\theta_{0\diamond j} - y_{0ij}),\ e^{-\left(\frac{\pi}{b}\right)^2 \eta_{yj}\tau}\Big) + \\
& + \Theta_3\Big(\frac{\pi}{2b}((z - \gamma_{0\diamond j})\cot\vartheta_{0\diamond j}\sin\theta_{0\diamond j} + y_{0ij}),\ e^{-\left(\frac{\pi}{b}\right)^2 \eta_{yj}\tau}\Big)\Bigg\} \times \\
& \times \Bigg\{ \Theta_3^{\int}\Bigg(\frac{\pi(z - z_{01ij})}{2(d_{j+1} - d_j)},\ e^{-\left(\frac{\pi}{d_{j+1} - d_j}\right)^2 \eta_{zj}\tau}\Bigg) + \Theta_3^{\int}\Bigg(\frac{\pi(z + z_{01ij} - 2d_j)}{2(d_{j+1} - d_j)},\ e^{-\left(\frac{\pi}{d_{j+1} - d_j}\right)^2 \eta_{zj}\tau}\Bigg) + \\
& + \Theta_3^{\int}\Bigg(\frac{\pi(z - z_{02ij})}{2(d_{j+1} - d_j)},\ e^{-\left(\frac{\pi}{d_{j+1} - d_j}\right)^2 \eta_{zj}\tau}\Bigg) + \Theta_3^{\int}\Bigg(\frac{\pi(z + z_{02ij} - 2d_j)}{2(d_{j+1} - d_j)},\ e^{-\left(\frac{\pi}{d_{j+1} - d_j}\right)^2 \eta_{zj}\tau}\Bigg)\Bigg\}\, dz\Bigg] d\tau + \\
& + \frac{1}{4\pi b\,(d_{j+1} - d_j)(\phi c_t)_j (z_{02\diamond j} - z_{01\diamond jj})} \times \\
& \times \sum_{i=L_t+1}^{M_t} U(t - t_{0ij}) \int_0^{t-t_{0ij}} \Bigg[ q_{ij}(t - t_{0ij} - \tau) \int_{z_{01\diamond j}}^{z_{02\diamond j}} \Bigg\{ \Theta_3\Bigg(\frac{\pi(z - z_{0ij})}{2(d_{j+1} - d_j)},\ e^{-\left(\frac{\pi}{d_{j+1} - d_j}\right)^2 \eta_{zj}\tau}\Bigg) + \\
& + \Theta_3\Bigg(\frac{\pi(z + z_{0ij} - 2d_j)}{2(d_{j+1} - d_j)},\ e^{-\left(\frac{\pi}{d_{j+1} - d_j}\right)^2 \eta_{zj}\tau}\Bigg)\Bigg\} \times \\
& \times \Bigg\{ \Theta_3\Big(\frac{\pi}{2b}((z - \gamma_{0\diamond j})\cot\vartheta_{0\diamond j}\sin\theta_{0\diamond j} - y_{0ij}),\ e^{-\left(\frac{\pi}{b}\right)^2 \eta_{yj}\tau}\Big) + \\
& + \Theta_3\Big(\frac{\pi}{2b}((z - \gamma_{0\diamond j})\cot\vartheta_{0\diamond j}\sin\theta_{0\diamond j} + y_{0ij}),\ e^{-\left(\frac{\pi}{b}\right)^2 \eta_{yj}\tau}\Big)\Bigg\} \times \\
& \times \Bigg\{ \Theta_3^{\int}\Big(\frac{\pi}{2a}((z - \gamma_{0\diamond j})\cot\vartheta_{0\diamond j}\cos\theta_{0\diamond j} - x_{01ij}),\ e^{-\left(\frac{\pi}{a}\right)^2 \eta_{xj}\tau}\Big) + \\
& + \Theta_3^{\int}\Big(\frac{\pi}{2a}((z - \gamma_{0\diamond j})\cot\vartheta_{0\diamond j}\cos\theta_{0\diamond j} + x_{01ij}),\ e^{-\left(\frac{\pi}{a}\right)^2 \eta_{xj}\tau}\Big) + \\
& + \Theta_3^{\int}\Big(\frac{\pi}{2a}((z - \gamma_{0\diamond j})\cot\vartheta_{0\diamond j}\cos\theta_{0\diamond j} - x_{02ij}),\ e^{-\left(\frac{\pi}{a}\right)^2 \eta_{xj}\tau}\Big) \\
& + \Theta_3^{\int}\Big(\frac{\pi}{2a}((z - \gamma_{0\diamond j})\cot\vartheta_{0\diamond j}\cos\theta_{0\diamond j} + x_{02ij}),\ e^{-\left(\frac{\pi}{a}\right)^2 \eta_{xj}\tau}\Big)\Bigg\}\, dz\Bigg] d\tau + \\
& + \frac{1}{4\pi a\,(d_{j+1} - d_j)(\phi c_t)_j (z_{02\diamond j} - z_{01\diamond jj})} \sum_{i=M_t+1}^{N_t} U(t - t_{0ij}) \times \\
& \times \int_0^{t-t_{0ij}} \Bigg[ q_{ij}(t - t_{0ij} - \tau) \int_{z_{01\diamond j}}^{z_{02\diamond j}} \Bigg\{ \Theta_3\Big(\frac{\pi}{2a}((z - \gamma_{0\diamond j})\cot\vartheta_{0\diamond j}\cos\theta_{0\diamond j} - x_{0ij}),\ e^{-\left(\frac{\pi}{a}\right)^2 \eta_{xj}\tau}\Big) + \\
& + \Theta_3\Big(\frac{\pi}{2a}((z - \gamma_{0\diamond j})\cot\vartheta_{0\diamond j}\cos\theta_{0\diamond j} + x_{0ij}),\ e^{-\left(\frac{\pi}{a}\right)^2 \eta_{xj}\tau}\Big)\Bigg\} \times \\
& \times \Bigg\{ \Theta_3\Bigg(\frac{\pi(z - z_{0ij})}{2(d_{j+1} - d_j)},\ e^{-\left(\frac{\pi}{d_{j+1} - d_j}\right)^2 \eta_{zj}\tau}\Bigg) + \Theta_3\Bigg(\frac{\pi(z + z_{0ij} - 2d_j)}{2(d_{j+1} - d_j)},\ e^{-\left(\frac{\pi}{d_{j+1} - d_j}\right)^2 \eta_{zj}\tau}\Bigg)\Bigg\} \times \\
& \times \Bigg\{ \Theta_3^{\int}\Big(\frac{\pi}{2b}((z - \gamma_{0\diamond j})\cot\vartheta_{0\diamond j}\sin\theta_{0\diamond j} - y_{01ij}),\ e^{-\left(\frac{\pi}{b}\right)^2 \eta_{yj}\tau}\Big) + \\
& + \Theta_3^{\int}\Big(\frac{\pi}{2b}((z - \gamma_{0\diamond j})\cot\vartheta_{0\diamond j}\sin\theta_{0\diamond j} + y_{01ij}),\ e^{-\left(\frac{\pi}{b}\right)^2 \eta_{yj}\tau}\Big) + \\
& + \Theta_3^{\int}\Big(\frac{\pi}{2b}((z - \gamma_{0\diamond j})\cot\vartheta_{0\diamond j}\sin\theta_{0\diamond j} - y_{02ij}),\ e^{-\left(\frac{\pi}{b}\right)^2 \eta_{yj}\tau}\Big) + \\
& + \Theta_3^{\int}\Big(\frac{\pi}{2b}((z - \gamma_{0\diamond j})\cot\vartheta_{0\diamond j}\sin\theta_{0\diamond j} + y_{02ij}),\ e^{-\left(\frac{\pi}{b}\right)^2 \eta_{yj}\tau}\Big)\Bigg\}\, dz\Bigg] d\tau +
\end{aligned}
$$

TABLE 5-continued

The spatial average pressure response of the inclined line $[(z_{02\diamond j} - z_{01\diamond j})\sin\vartheta_{0\diamond j}]$, $i = \diamond j$, $N_{t+1} \le \diamond \le N_d$ is given by.

$$+\frac{1}{8(\phi c_t)_j ab(d_{j+1} - d_j)(z_{02\diamond j} - z_{01\diamond jj})}\times$$

$$\times\sum_{i=N_t+1}^{N_d} U(t - t_{0ij})\sin\vartheta_{0ij}\int_0^{t-t_{0ij}} q_{ij}(t - t_{0ij} - \tau)\times$$

$$\times\int_{z_{01ij}}^{z_{02ij}}\int_{z_{01\diamond j}}^{z_{02\diamond j}}\Big[\Big\{\Theta_3\Big(\frac{\pi}{2a}((z - \gamma_{0\diamond j})\cot\vartheta_{0\diamond j}\cos\theta_{0\diamond j} - (z_{0ij} - \gamma_{0ij})\cot\vartheta_{0ij}\cos\theta_{0ij}\}, e^{-\left(\frac{\pi}{a}\right)^2\eta_{xj}\tau}\Big) +$$

$$+\Theta_3\Big(\frac{\pi}{2a}\{(z - \gamma_{0\diamond j})\cot\vartheta_{0\diamond j}\cos\theta_{0\diamond j} + (z_{0ij} - \gamma_{0ij})\cot\vartheta_{0ij}\cos\theta_{0ij}\}, e^{-\left(\frac{\pi}{a}\right)^2\eta_{xj}\tau}\Big)\Big\}\times$$

$$\times\Big\{\Theta_3\Big(\frac{\pi}{2b}\{(z - \gamma_{0\diamond j})\cot\vartheta_{0\diamond j}\sin\theta_{0\diamond j} - (z_{0ij} - \gamma_{0ij})\cot\vartheta_{0ij}\sin\theta_{0ij}\}, e^{-\left(\frac{\pi}{b}\right)^2\eta_{yj}\tau}\Big) +$$

$$+\Theta_3\Big(\frac{\pi}{2b}\{(z - \gamma_{0\diamond j})\cot\vartheta_{0\diamond j}\sin\theta_{0\diamond j} + (z_{0ij} - \gamma_{0ij})\cot\vartheta_{0ij}\sin\theta_{0ij}\}, e^{-\left(\frac{\pi}{b}\right)^2\eta_{yj}\tau}\Big)\Big\}\times$$

$$\times\left\{\Theta_3\left(\frac{\pi(z - z_{0ij})}{2(d_{j+1} - d_j)}, e^{-\left(\frac{\pi}{d_{j+1}-d_j}\right)^2\eta_{zj}\tau}\right) + \Theta_3\left(\frac{\pi(z + z_{0ij} - 2d_j)}{2(d_{j+1} - d_j)}, e^{-\left(\frac{\pi}{d_{j+1}-d_j}\right)^2\eta_{zj}\tau}\right)\right\}\Bigg]dz\,dz_{0ij}\,d\tau +$$

$$+\frac{1}{2\pi^2(d_{j+1} - d_j)(\phi c_t)_j(z_{02\diamond j} - z_{01\diamond jj})}\sum_{i=N_d+1}^{L_r} U(t - t_{0ij})\times$$

$$\times\int_0^{t-t_{0ij}}\Bigg[q_{ij}(t - t_{0ij} - \tau)\int_{z_{01\diamond j}}^{z_{02\diamond j}}\left\{\Theta_3\left(\frac{\pi(z - z_{0ij})}{2(d_{j+1} - d_j)}, e^{-\left(\frac{\pi}{d_{j+1}-d_j}\right)^2\eta_{zj}\tau}\right) +\right.$$

$$\left.+\Theta_3\left(\frac{\pi(z + z_{0j} - 2d_j)}{2(d_{j+1} - d_j)}, e^{-\left(\frac{\pi}{d_{j+1}-d_j}\right)^2\eta_{zj}\tau}\right)\right\}\times$$

$$\times\Big\{\Theta_3^{f}\Big(\frac{\pi}{2b}((z - \gamma_{0\diamond j})\cot\vartheta_{0\diamond j}\sin\theta_{0\diamond j} - y_{01i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} + y_{01i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} - y_{02i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} + y_{02i}), e^{-\left(\frac{\pi}{b}\right)^2\eta_{yj}\tau}\Big)\Big\}\times$$

$$\times\Big\{\Theta_3^{f}\Big(\frac{\pi}{2a}((z - \gamma_{0\diamond j})\cot\vartheta_{0\diamond j}\cos\theta_{0\diamond j} - x_{01i}), e^{-\left(\frac{\pi}{a}\right)^2\eta_{xj}\tau}\Big) +$$

$$+\Theta_3^{f}\Big(\frac{\pi}{2a}((z - \gamma_{0\diamond j})\cot\vartheta_{0\diamond j}\cos\theta_{0\diamond j} + x_{01i}), e^{-\left(\frac{\pi}{a}\right)^2\eta_{xj}\tau}\Big) +$$

$$+\Theta_3^{f}\Big(\frac{\pi}{2a}((z - \gamma_{0\diamond j})\cot\vartheta_{0\diamond j}\cos\theta_{0\diamond j} - x_{02i}), e^{-\left(\frac{\pi}{a}\right)^2\eta_{xj}\tau}\Big) +$$

$$+\Theta_3^{f}\Big(\frac{\pi}{2a}((z - \gamma_{0\diamond j})\cot\vartheta_{0\diamond j}\cos\theta_{0\diamond j} + x_{02i}), e^{-\left(\frac{\pi}{a}\right)^2\eta_{xj}\tau}\Big)\Big\}\,dz\Bigg]d\tau +$$

$$+\frac{1}{2\pi^2 a(\phi c_t)_j(z_{02\diamond j} - z_{01\diamond j})}\sum_{i=L_r+1}^{M_r} U(t - t_{0ij})\times$$

$$\times\int_0^{t-t_{0ij}}\Bigg[q_{ij}(t - t_{0ij} - \tau)\int_{z_{01\diamond j}}^{z_{02\diamond j}}\Big\{\Theta_3\Big(\frac{\pi}{2a}((z - \gamma_{0\diamond j})\cot\vartheta_{0\diamond j}\cos\theta_{0\diamond j} - x_{0ij}), e^{-\left(\frac{\pi}{a}\right)^2\eta_{xj}\tau}\Big) +$$

$$+\Theta_3\Big(\frac{\pi}{2a}((z - \gamma_{0\diamond j})\cot\vartheta_{0\diamond j}\cos\theta_{0\diamond j} + x_{0ij}), e^{-\left(\frac{\pi}{a}\right)^2\eta_{xj}\tau}\Big)\Big\}\times$$

$$\times\Big\{\Theta_3^{f}\Big(\frac{\pi}{2b}((z - \gamma_{0\diamond j})\cot\vartheta_{0\diamond j}\sin\theta_{0\diamond j} - y_{01i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} + y_{01i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} - y_{02i}), e^{-\left(\frac{\pi}{b}\right)^2\eta_{yj}\tau}\Big) +$$

$$+\Theta_3^{f}\Big(\frac{\pi}{2b}((z - \gamma_{0\diamond j})\cot\vartheta_{0\diamond j}\sin\theta_{0\diamond j} + y_{02i}), e^{-\left(\frac{\pi}{b}\right)^2\eta_{yj}\tau}\Big)\Big\}\times$$

TABLE 5-continued

The spatial average pressure response of the inclined line $[(z_{02\diamond j} - z_{01\diamond j})\sin\vartheta_{0\diamond j}]$, $i = \diamond j$, $N_{i+1} \le \diamond \le N_d$ is given by.

$$\times\left\{\Theta_3\int\left(\frac{\pi(z - z_{01i})}{2(d_{j+1} - d_j)}, e^{-\left(\frac{\pi}{d_{j+1}-d_j}\right)^2\eta_{zj}\tau}\right) + \Theta_3\int\left(\frac{\pi(z + z_{01ij} - 2d_j)}{2(d_{j+1} - d_j)}, e^{-\left(\frac{\pi}{d_{j+1}-d_j}\right)^2\eta_{zj}\tau}\right) + \right.$$

$$\left.+\Theta_3\int\left(\frac{\pi(z - z_{02i})}{2(d_{j+1} - d_j)}, e^{-\left(\frac{\pi}{d_{j+1}-d_j}\right)^2\eta_{zj}\tau}\right) + \Theta_3\int\left(\frac{\pi(z + z_{02ij} - 2d_j)}{2(d_{j+1} - d_j)}, e^{-\left(\frac{\pi}{d_{j+1}-d_j}\right)^2\eta_{zj}\tau}\right)\right\} dz\Bigg] d\tau +$$

$$+\frac{1}{2\pi^2 b(\phi c_t)_j(z_{02\diamond j} - z_{01\diamond jj})}\times$$

$$\times\sum_{i=M_r+1}^{N_r} U(t - t_{0ij})\int_0^{t-t_{0ij}}\Bigg[q_i(t - t_{0ij} - \tau)\int_{z_{01\diamond j}}^{z_{02\diamond j}}\Bigg\{\Theta_3\left(\frac{\pi}{2b}((z - \gamma_{0\diamond j})\cot\vartheta_{0\diamond j}\sin\theta_{0\diamond j} - y_{0ij}), e^{-\left(\frac{\pi}{b}\right)^2\eta_{yj}\tau}\right) +$$

$$+\Theta_3\left(\frac{\pi}{2b}((z - \gamma_{0\diamond j})\cot\vartheta_{0\diamond j}\sin\theta_{0\diamond j} + y_{0ij}), e^{-\left(\frac{\pi}{b}\right)^2\eta_{yj}\tau}\right)\Bigg\}\times$$

$$\times\left\{\Theta_3\int\left(\frac{\pi}{2a}((z - \gamma_{0\diamond j})\cot\vartheta_{0\diamond j}\sin\theta_{0\diamond j} - x_{01i}), e^{-\left(\frac{\pi}{a}\right)^2\eta_{xj}\tau}\right) +\right.$$

$$+\Theta_3\int\left(\frac{\pi}{2a}((z - \gamma_{0\diamond j})\cot\vartheta_{0\diamond j}\cos\theta_{0\diamond j} + x_{01i}), e^{-\left(\frac{\pi}{a}\right)^2\eta_{xj}\tau}\right) +$$

$$+\Theta_3\int\left(\frac{\pi}{2a}((z - \gamma_{0\diamond j})\cot\vartheta_{0\diamond j}\cos\theta_{0\diamond j} - x_{02i}), e^{-\left(\frac{\pi}{a}\right)^2\eta_{xj}\tau}\right) +$$

$$\left.+\Theta_3\int\left(\frac{\pi}{2a}((z - \gamma_{0\diamond j})\cot\vartheta_{0\diamond j}\cos\theta_{0\diamond j} + x_{02i}), e^{-\left(\frac{\pi}{a}\right)^2\eta_{xj}\tau}\right)\right\}\times$$

$$\times\left\{\Theta_3\int\left(\frac{\pi(z - z_{01i})}{2(d_{j+1} - d_j)}, e^{-\left(\frac{\pi}{d_{j+1}-d_j}\right)^2\eta_{zj}\tau}\right) + \Theta_3\int\left(\frac{\pi(z + z_{01ij} - 2d_j)}{2(d_{j+1} - d_j)}, e^{-\left(\frac{\pi}{d_{j+1}-d_j}\right)^2\eta_{zj}\tau}\right) + \right.$$

$$\left.+\Theta_3\int\left(\frac{\pi(z - z_{02i})}{2(d_{j+1} - d_j)}, e^{-\left(\frac{\pi}{d_{j+1}-d_j}\right)^2\eta_{zj}\tau}\right) + \Theta_3\int\left(\frac{\pi(z + z_{02ij} - 2d_j)}{2(d_{j+1} - d_j)}, e^{-\left(\frac{\pi}{d_{j+1}-d_j}\right)^2\eta_{zj}\tau}\right)\right\} dz\Bigg] d\tau +$$

$$+\frac{4}{(\phi c_t)_j ab(d_{j+1} - d_j)(z_{02\diamond j} - z_{01\diamond jj})}\sum_{m=0}^{\infty}\sum_{l=0}^{\infty}\ni_m\ \ni_l\int_{z_{01\diamond j}}^{z_{02\diamond j}}\cos\left(\frac{m\pi(z - \gamma_{0\diamond j})\cot\vartheta_{0\diamond j}\sin\theta_{0\diamond j}}{b}\right)\cos\left(\frac{l\pi(z - d_j)}{(d_{j+1} - d_j)}\right)\times$$

$$\times\int_0^t\left\{\bar{\bar{\psi}}_{0yz}(m, l, \tau)\,\Theta_3\left(\frac{\pi(z - \gamma_{0\diamond j})\cot\vartheta_{0\diamond j}\cos\theta_{0\diamond j}}{2a}\right)e^{-\left(\frac{\pi}{a}\right)^2\eta_{xj}(t-\tau)}\right) -$$

$$-\bar{\bar{\psi}}_{ayz}(m, l, \tau)\,\Theta_4\left(\frac{\pi(z - \gamma_{0\diamond j})\cot\vartheta_{0\diamond j}\cos\theta_{0\diamond j}}{2a}, e^{-\left(\frac{\pi}{a}\right)^2\eta_{xj}(t-\tau)}\right)\Bigg\}e^{-\left\{\left(\frac{m\pi}{b}\right)^2\eta_{yj}+\left(\frac{l\pi}{d_{j+1}-d_j}\right)^2\eta_{zj}\right\}(t-\tau)}d\tau dz +$$

$$+\frac{4}{(\phi c_t)_j ab(d_{j+1} - d_j)(z_{02\diamond j} - z_{01\diamond jj})}\sum_{n=0}^{\infty}\sum_{l=0}^{\infty}\ni_n\ \ni_l\int_{z_{01\diamond j}}^{z_{02\diamond j}}\cos\left(\frac{n\pi(z - \gamma_{0\diamond j})\cot\vartheta_{0\diamond j}\cos\theta_{0\diamond j}}{a}\right)\cos\left(\frac{l\pi(z - d_j)}{d_{j+1} - d_j}\right)\times$$

$$\times\int_0^t\left\{\bar{\bar{\psi}}_{x0z}(n, l, \tau)\,\Theta_3\left(\frac{\pi(z_{02\diamond j} - z_{01\diamond jj})\sin\vartheta_{0\diamond j}}{2b}\right)e^{-\left(\frac{\pi}{b}\right)^2\eta_{yj}(t-\tau)}\right) -$$

$$-\bar{\bar{\psi}}_{xbz}(n, l, \tau)\,\Theta_4\left(\frac{\pi(z_{02\diamond j} - z_{01\diamond jj})\sin\vartheta_{0\diamond j}}{2b}, e^{-\left(\frac{\pi}{b}\right)^2\eta_{yj}(t-\tau)}\right)\Bigg\}e^{-\left\{\left(\frac{n\pi}{a}\right)^2\eta_{xj}+\left(\frac{l\pi}{d_{j+1}-d_j}\right)^2\eta_{zj}\right\}(t-\tau)}d\tau dz +$$

$$+\frac{4}{(\phi c_t)_j ab(d_{j+1} - d_j)(z_{02\diamond j} - z_{01\diamond jj})}\times$$

$$\times\sum_{n=0}^{\infty}\sum_{m=0}^{\infty}\ni_n\ \ni_m\int_{z_{01\diamond j}}^{z_{02\diamond j}}\cos\left(\frac{n\pi(z - \gamma_{0\diamond j})\cot\vartheta_{0\diamond j}\cos\theta_{0\diamond j}}{a}\right)\cos\left(\frac{m\pi(z - \gamma_{0\diamond j})\cot\vartheta_{0\diamond j}\cos\theta_{0\diamond j}}{b}\right)\times$$

$$\times\int_0^t\left\{\bar{\bar{\psi}}_{xy0}(n, m, \tau)\,\Theta_3\left(\frac{\pi(z - d_{jj})}{2(d_{j+1} - d_j)}, e^{-\left(\frac{\pi}{d_{j+1}-d_j}\right)^2\eta_{zj}(t-\tau)}\right) -\right.$$

$$\left.-\bar{\bar{\psi}}_{xyd}(n, m, \tau)\,\Theta_4\left(\frac{\pi(z - d_{jj})}{2(d_{j+1} - d_j)}, e^{-\left(\frac{\pi}{d_{j+1}-d_j}\right)^2\eta_{zj}(t-\tau)}\right)\right\}e^{-\{(\frac{n\pi}{a})^2\eta_{xj}+(\frac{m\pi}{b})^2\eta_{yj}\}(t-\tau)}d\tau dz +$$

TABLE 5-continued

The spatial average pressure response of the inclined line $[(z_{02\diamond j} - z_{01\diamond j})\sin\vartheta_{0\diamond j}]$, $i = \diamond j$, $N_{t+1} \le \diamond \le N_d$ is given by.

$$
\begin{aligned}
&+\frac{1}{8ab(d_{j+1}-d_j)(z_{02\diamond j}-z_{01\diamond jj})}\int_0^d\int_0^b\int_0^a \varphi_j(u, v, w, +d_j)\times \\
&\times\int_{z_{01\diamond j}}^{z_{02\diamond j}}\Big[\Big\{\Theta_3\Big(\frac{\pi}{2a}((z-\gamma_{0\diamond j})\cot\vartheta_{0\diamond j}\cos\theta_{0\diamond j}-u),\ e^{-\left(\frac{\pi}{a}\right)^2\eta_{xjt}}\Big)+ \\
&+\Theta_3\Big(\frac{\pi}{2a}((z-\gamma_{0\diamond j})\cot\vartheta_{0\diamond j}\cos\theta_{0\diamond j}+u),\ e^{-\left(\frac{\pi}{a}\right)^2\eta_{xjt}}\Big)\Big\}\times \\
&\times\Big\{\Theta_3\Big(\frac{\pi}{2b}((z-\gamma_{0\diamond j})\cot\vartheta_{0\diamond j}\sin\theta_{0\diamond j}-v),\ e^{-\left(\frac{\pi}{b}\right)^2\eta_{yjt}}\Big)+ \\
&+\Theta_3\Big(\frac{\pi}{2b}((z-\gamma_{0\diamond j})\cot\vartheta_{0\diamond j}\sin\theta_{0\diamond j}+v),\ e^{-\left(\frac{\pi}{b}\right)^2\eta_{yjt}}\Big)\Big\}\times \\
&\times\Big\{\Theta_3\Big(\frac{\pi(z-d_j-w)}{2(d_{j+1}-d_j)},\ e^{-\left(\frac{\pi}{d_{j+1}-d_j}\right)^2\eta_{zjt}}\Big)+\Theta_3\Big(\frac{\pi(z-d_j+w)}{2(d_{j+1}-d_j)},\ e^{-\left(\frac{\pi}{d_{j+1}-d_j}\right)^2\eta_{zjt}}\Big)\Big\}\Big]\,dudvdwdz
\end{aligned}
$$

TABLE 6

The spatial average pressure response of the rectangle $[(x_{02\diamond j} - x_{01\diamond j})(y_{02\diamond j} - y_{01\diamond j})]$, $i = \diamond$, $N_t + 1 \le \diamond \le L_r$ is given by.

$$
\begin{aligned}
p_j = &\frac{1}{(\phi c_t)_j(x_{02\diamond j}-x_{01\diamond jj})(y_{02\diamond j}-y_{01\diamond j})}\sum_{i=1}^{L_t}U(t-t_{0ij})\int_0^{t-t_{0ij}}q_{ij}(t-t_{0ij}-\tau)\times \\
&\times\Big\{\Theta_3^f\Big(\frac{\pi(x_{02\diamond j}-x_{0ij})}{2a},\ e^{-\left(\frac{\pi}{a}\right)^2\eta_{xj\tau}}\Big)-\Theta_3^f\Big(\frac{\pi(x_{01\diamond j}-x_{0ij})}{2a},\ e^{-\left(\frac{\pi}{a}\right)^2\eta_{xj\tau}}\Big)+ \\
&+\Theta_3^f\Big(\frac{\pi(x_{02\diamond j}+x_{0ij})}{2a},\ e^{-\left(\frac{\pi}{a}\right)^2\eta_{xj\tau}}\Big)-\Theta_3^f\Big(\frac{\pi(x_{01\diamond j}+x_{0ij})}{2a},\ e^{-\left(\frac{\pi}{a}\right)^2\eta_{xj\tau}}\Big)\Big\}\times \\
&\times\Big\{\Theta_3^f\Big(\frac{\pi(y_{02\diamond j}-y_{0ij})}{2b},\ e^{-\left(\frac{\pi}{b}\right)^2\eta_{yj\tau}}\Big)-\Theta_3^f\Big(\frac{\pi(y_{01\diamond j}-y_{0ij})}{2b},\ e^{-\left(\frac{\pi}{b}\right)^2\eta_{yj\tau}}\Big)+ \\
&+\Theta_3^f\Big(\frac{\pi(y_{02\diamond j}+y_{0ij})}{2b},\ e^{-\left(\frac{\pi}{b}\right)^2\eta_{yj\tau}}\Big)-\Theta_3^f\Big(\frac{\pi(y_{01\diamond j}+y_{0ij})}{2b},\ e^{-\left(\frac{\pi}{b}\right)^2\eta_{yj\tau}}\Big)\Big\}\times \\
&\times\Big\{\Theta_3^f\Big(\frac{\pi(z-z_{01ij})}{2(d_{j+1}-d_j)},\ e^{-\left(\frac{\pi}{d_{j+1}-d_j}\right)^2\eta_{zj\tau}}\Big)-\Theta_3^f\Big(\frac{\pi(z+z_{01ij}-2d_j)}{2(d_{j+1}-d_j)},\ e^{-\left(\frac{\pi}{d_{j+1}-d_j}\right)^2\eta_{zj\tau}}\Big)- \\
&-\Theta_3^f\Big(\frac{\pi(z-z_{02ij})}{2(d_{j+1}-d_j)},\ e^{-\left(\frac{\pi}{d_{j+1}-d_j}\right)^2\eta_{zj\tau}}\Big)+\Theta_3^f\Big(\frac{\pi(z+z_{02ij}-2d_j)}{2(d_{j+1}-d_j)},\ e^{-\left(\frac{\pi}{d_{j+1}-d_j}\right)^2\eta_{zj\tau}}\Big)\Big\}\,d\tau+ \\
&+\frac{a}{(\phi c_t)_j(d_{j+1}-d_j)(x_{02\diamond j}-x_{01\diamond jj})(y_{02\diamond j}-y_{01\diamond j})}\sum_{i=L_t+1}^{M_t}U(t-t_{0ij})\int_0^{t-t_{0ij}}q_{ij}(t-t_{0ij}-\tau)\times \\
&\times\Big\{\Theta_3^f\Big(\frac{\pi(y_{02\diamond j}-y_{0ij})}{2b},\ e^{-\left(\frac{\pi}{b}\right)^2\eta_{yj\tau}}\Big)-\Theta_3^f\Big(\frac{\pi(y_{01\diamond j}-y_{0ij})}{2b},\ e^{-\left(\frac{\pi}{b}\right)^2\eta_{yj\tau}}\Big)+ \\
&+\Theta_3^f\Big(\frac{\pi(y_{02\diamond j}+y_{0ij})}{2b},\ e^{-\left(\frac{\pi}{b}\right)^2\eta_{yj\tau}}\Big)-\Theta_3^f\Big(\frac{\pi(y_{01\diamond j}+y_{0ij})}{2b},\ e^{-\left(\frac{\pi}{b}\right)^2\eta_{yj\tau}}\Big)\Big\}\times \\
&\times\Big\{\Theta_3\Big(\frac{\pi(z-z_{0ij})}{2(d_{j+1}-d_j)},\ e^{-\left(\frac{\pi}{d_{j+1}-d_j}\right)^2\eta_{zj\tau}}\Big)+\Theta_3\Big\{\frac{\pi(z+z_{0ij}-2d_j)}{2(d_{j+1}-d_j)},\ e^{-\left(\frac{\pi}{d_{j+1}-d_j}\right)^2\eta_{zj\tau}}\Big\}\Big\}\times
\end{aligned}
\tag{0.12}
$$

TABLE 6-continued

The spatial average pressure response of the rectangle $[(x_{02\diamond j}-x_{01\diamond j})(y_{02\diamond j}-y_{01\diamond j})]$, $i=\diamond$, $N_t+1\le\diamond\le L_r$ is given by.

$$\times\left\{\Theta_3^{\int\int}\left(\frac{\pi(x_{02\diamond j}-x_{01ij})}{2a},\ e^{-\left(\frac{\pi}{a}\right)^2\eta_{xj}\tau}\right)-\Theta_3^{\int\int}\left(\frac{\pi(x_{01\diamond j}-x_{01ij})}{2a},\ e^{-\left(\frac{\pi}{a}\right)^2\eta_{xj}\tau}\right)-\right.$$
$$-\Theta_3^{\int\int}\left(\frac{\pi(x_{02\diamond j}+x_{01ij})}{2a},\ e^{-\left(\frac{\pi}{a}\right)^2\eta_{xj}\tau}\right)+\Theta_3^{\int\int}\left(\frac{\pi(x_{01\diamond j}+x_{01ij})}{2a},\ e^{-\left(\frac{\pi}{a}\right)^2\eta_{xj}\tau}\right)-$$
$$-\Theta_3^{\int\int}\left(\frac{\pi(x_{02\diamond j}-x_{02ij})}{2a},\ e^{-\left(\frac{\pi}{a}\right)^2\eta_{xj}\tau}\right)+\Theta_3^{\int\int}\left(\frac{\pi(x_{01\diamond j}-x_{02ij})}{2a},\ e^{-\left(\frac{\pi}{a}\right)^2\eta_{xj}\tau}\right)+$$
$$\left.+\Theta_3^{\int\int}\left(\frac{\pi(x_{02\diamond j}+x_{02ij})}{2a},\ e^{-\left(\frac{\pi}{a}\right)^2\eta_{xj}\tau}\right)-\Theta_3^{\int\int}\left(\frac{\pi(x_{01\diamond j}+x_{02ij})}{2a},\ e^{-\left(\frac{\pi}{a}\right)^2\eta_{xj}\tau}\right)\right\}+$$

$$+\frac{b}{(\phi c_t)_j(d_{j+1}-d_j)(x_{02\diamond j}-x_{01\diamond jj})(y_{02\diamond j}-y_{01\diamond j})}\sum_{i=M_t+1}^{N_t}U(t-t_{0ij})\int_0^{t-t_{0ij}}q_{ij}(t-t_{0ij}-\tau)\times$$
$$\times\left\{\Theta_3^{\int\int}\left(\frac{\pi(x_{02\diamond j}-x_{0ij})}{2a},\ e^{-\left(\frac{\pi}{a}\right)^2\eta_{xj}\tau}\right)-\Theta_3^{\int\int}\left(\frac{\pi(x_{01\diamond j}-x_{0ij})}{2a},\ e^{-\left(\frac{\pi}{a}\right)^2\eta_{xj}\tau}\right)+\right.$$
$$\left.+\Theta_3^{\int\int}\left(\frac{\pi(x_{02\diamond j}+x_{0ij})}{2a},\ e^{-\left(\frac{\pi}{a}\right)^2\eta_{xj}\tau}\right)-\Theta_3^{\int\int}\left(\frac{\pi(x_{01\diamond j}+x_{0ij})}{2a},\ e^{-\left(\frac{\pi}{a}\right)^2\eta_{xj}\tau}\right)\right\}\times$$
$$\times\left\{\Theta_3\left(\frac{\pi(z-z_{0ij})}{2(d_{j+1}-d_j)},\ e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)},\ e^{-\left(\frac{\pi}{d_{j+1}-d_j}\right)^2\eta_{zj}\tau}\right)\right\}\times$$

$$\times\left\{\Theta_3^{\int\int}\left(\frac{\pi(y_{02\diamond j}-y_{01ij})}{2a},\ e^{-\left(\frac{\pi}{b}\right)^2\eta_{yj}\tau}\right)-\Theta_3^{\int\int}\left(\frac{\pi(y_{01\diamond j}-y_{01ij})}{2b},\ e^{-\left(\frac{\pi}{b}\right)^2\eta_{yj}\tau}\right)-\right.$$
$$-\Theta_3^{\int\int}\left(\frac{\pi(y_{02\diamond j}+y_{01ij})}{2b},\ e^{-\left(\frac{\pi}{b}\right)^2\eta_{yj}\tau}\right)+\Theta_3^{\int\int}\left(\frac{\pi(y_{01\diamond j}+y_{01ij})}{2b},\ e^{-\left(\frac{\pi}{b}\right)^2\eta_{yj}\tau}\right)-$$
$$-\Theta_3^{\int\int}\left(\frac{\pi(y_{02\diamond j}-y_{02ij})}{2b},\ e^{-\left(\frac{\pi}{b}\right)^2\eta_{yj}\tau}\right)+\Theta_3^{\int\int}\left(\frac{\pi(y_{01\diamond j}-y_{02ij})}{2b},\ e^{-\left(\frac{\pi}{b}\right)^2\eta_{yj}\tau}\right)+$$
$$\left.+\Theta_3^{\int\int}\left(\frac{\pi(y_{02\diamond j}+y_{02ij})}{2b},\ e^{-\left(\frac{\pi}{b}\right)^2\eta_{yj}\tau}\right)-\Theta_3^{\int\int}\left(\frac{\pi(y_{01\diamond j}+y_{02ij})}{2b},\ e^{-\left(\frac{\pi}{b}\right)^2\eta_{yj}\tau}\right)\right\}d\tau+$$

$$+\frac{1}{2\pi^2(\phi c_t)_j(d_{j+1}-d_j)(x_{02\diamond j}-x_{01\diamond jj})(y_{02\diamond j}-y_{01\diamond j})}\sum_{i=N_t+1}^{N_d}U(t-t_{0ij})\sin\vartheta_{0ij}\times$$
$$\times\int_0^{t-t_{0ij}}q_{ij}(t-t_{0ij}-\tau)\int_{z_{01ij}}^{z_{02ij}}\left[\left\{\Theta_3^f\left(\frac{\pi}{2b}\{y_{02\diamond j}-(z_{0ij}-\gamma_{0ij})\cot\vartheta_{0ij}\sin\theta_{0ij}\},\ e^{-\left(\frac{\pi}{b}\right)^2\eta_{yj}\tau}\right)-\right.\right.$$
$$-\Theta_3^f\left(\frac{\pi}{2b}\{y_{01\diamond j}-(z_{0ij}-\gamma_{0ij})\cot\vartheta_{0ij}\sin\theta_{0ij}\},\ e^{-\left(\frac{\pi}{b}\right)^2\eta_{yj}\tau}\right)+$$
$$+\Theta_3^f\left(\frac{\pi}{2b}\{y_{02\diamond j}+(z_{0ij}-\gamma_{0ij})\cot\vartheta_{0ij}\sin\theta_{0ij}\},\ e^{-\left(\frac{\pi}{b}\right)^2\eta_{yj}\tau}\right)-$$
$$\left.-\Theta_3^f\left(\frac{\pi}{2b}\{y_{01\diamond j}+(z_{0ij}-\gamma_{0ij})\cot\vartheta_{0ij}\sin\theta_{0ij}\},\ e^{-\left(\frac{\pi}{b}\right)^2\eta_{yj}\tau}\right)\right\}\times$$

$$\times\left\{\Theta_3^f\left(\frac{\pi}{2a}\{x_{02\diamond j}-(z_{0ij}-\gamma_{0ij})\cot\vartheta_{0ij}\sin\theta_{0ij}\},\ e^{-\left(\frac{\pi}{a}\right)^2\eta_{xj}\tau}\right)-\right.$$
$$-\Theta_3^f\left(\frac{\pi}{2a}\{x_{01\diamond j}-(z_{0ij}-\gamma_{0ij})\cot\vartheta_{0ij}\sin\theta_{0ij}\},\ e^{-\left(\frac{\pi}{a}\right)^2\eta_{xj}\tau}\right)+$$
$$+\Theta_3^f\left(\frac{\pi}{2a}\{x_{02\diamond j}+(z_{0ij}-\gamma_{0ij})\cot\vartheta_{0ij}\sin\theta_{0ij}\},\ e^{-\left(\frac{\pi}{a}\right)^2\eta_{xj}\tau}\right)-$$
$$\left.-\Theta_3^f\left(\frac{\pi}{2a}\{x_{01\diamond j}+(z_{0ij}-\gamma_{0ij})\cot\vartheta_{0ij}\sin\theta_{0ij}\},\ e^{-\left(\frac{\pi}{a}\right)^2\eta_{xj}\tau}\right)\right\}\times$$
$$\times\left\{\Theta_3\left(\frac{\pi}{2d}(z-z_{0ij}),\ e^{-\left(\frac{\pi}{d}\right)^2\eta_{yj}\tau}\right)+\Theta_3\left(\frac{\pi}{2d}(z+z_{0ij}),\ e^{-\left(\frac{\pi}{d}\right)^2\eta_{yj}\tau}\right)\right\}\Big]dz_{0ij}d\tau+$$

TABLE 6-continued

The spatial average pressure response of the rectangle $[(x_{02\diamond j}-x_{01\diamond j})(y_{02\diamond j}-y_{01\diamond j})]$, $i=\diamond$, $N_t+1\le\diamond\le L_r$ is given by.

$$+\frac{2ab}{(\phi c_t)_j(d_{j+1}-d_j)(x_{02\diamond j}-x_{01\diamond j})(y_{02\diamond j}-y_{01\diamond j})}\sum_{i=N_d+1}^{L_r}U(t-t_{0ij})\int_0^{t-t_{0ij}}q_{ij}(t-t_{0ij}-\tau)\times$$

$$\times\left\{\Theta_3^{\int\int}\left(\frac{\pi(x_{02\diamond j}-x_{01ij})}{2a},e^{-\left(\frac{\pi}{a}\right)^2\eta_{xj}\tau}\right)-\Theta_3^{\int\int}\left(\frac{\pi(x_{01\diamond j}-x_{01ij})}{2a},e^{-\left(\frac{\pi}{a}\right)^2\eta_{xj}\tau}\right)-\right.$$

$$-\Theta_3^{\int\int}\left(\frac{\pi(x_{02\diamond j}+x_{01ij})}{2a},e^{-\left(\frac{\pi}{a}\right)^2\eta_{xj}\tau}\right)+\Theta_3^{\int\int}\left(\frac{\pi(x_{01\diamond j}+x_{01ij})}{2a},e^{-\left(\frac{\pi}{a}\right)^2\eta_{xj}\tau}\right)-$$

$$-\Theta_3^{\int\int}\left(\frac{\pi(x_{02\diamond j}-x_{02ij})}{2a},e^{-\left(\frac{\pi}{a}\right)^2\eta_{xj}\tau}\right)+\Theta_3^{\int\int}\left(\frac{\pi(x_{01\diamond j}-x_{02ij})}{2a},e^{-\left(\frac{\pi}{a}\right)^2\eta_{xj}\tau}\right)+$$

$$\left.+\Theta_3^{\int\int}\left(\frac{\pi(x_{02\diamond j}+x_{02ij})}{2a},e^{-\left(\frac{\pi}{a}\right)^2\eta_{xj}\tau}\right)-\Theta_3^{\int\int}\left(\frac{\pi(x_{01\diamond j}+x_{02ij})}{2a},e^{-\left(\frac{\pi}{a}\right)^2\eta_{xj}\tau}\right)\right\}+$$

$$\times\left\{\Theta_3^{\int\int}\left(\frac{\pi(y_{02\diamond j}-y_{01ij})}{2a},e^{-\left(\frac{\pi}{b}\right)^2\eta_{yj}\tau}\right)-\Theta_3^{\int\int}\left(\frac{\pi(y_{01\diamond j}-y_{01ij})}{2b},e^{-\left(\frac{\pi}{b}\right)^2\eta_{yj}\tau}\right)-\right.$$

$$-\Theta_3^{\int\int}\left(\frac{\pi(y_{02\diamond j}+y_{01ij})}{2b},e^{-\left(\frac{\pi}{b}\right)^2\eta_{yj}\tau}\right)+\Theta_3^{\int\int}\left(\frac{\pi(y_{01\diamond j}+y_{01ij})}{2b},e^{-\left(\frac{\pi}{b}\right)^2\eta_{yj}\tau}\right)-$$

$$-\Theta_3^{\int\int}\left(\frac{\pi(y_{02\diamond j}-y_{02ij})}{2b},e^{-\left(\frac{\pi}{b}\right)^2\eta_{yj}\tau}\right)+\Theta_3^{\int\int}\left(\frac{\pi(y_{01\diamond j}-y_{02ij})}{2b},e^{-\left(\frac{\pi}{b}\right)^2\eta_{yj}\tau}\right)+$$

$$\left.+\Theta_3^{\int\int}\left(\frac{\pi(y_{02\diamond j}+y_{02ij})}{2b},e^{-\left(\frac{\pi}{b}\right)^2\eta_{yj}\tau}\right)-\Theta_3^{\int\int}\left(\frac{\pi(y_{01\diamond j}+y_{02ij})}{2b},e^{-\left(\frac{\pi}{b}\right)^2\eta_{yj}\tau}\right)\right\}\times$$

$$\times\left\{\Theta_3\left(\frac{\pi(z-z_{0ij})}{2(d_{j+1}-d_j)},e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)},e^{-\left(\frac{\pi}{d_{j+1}-d_j}\right)^2\eta_{zj}\tau}\right)\right\}d\tau+$$

$$+\frac{2b}{(\phi c_t)_j(x_{02\diamond j}-x_{01\diamond jj})(y_{02\diamond j}-y_{01\diamond j})}\sum_{i=L_r+1}^{M_r}U(t-t_{0ij})\int_0^{t-t_{0ij}}q_{ij}(t-t_{0ij}-\tau)\times$$

$$\times\left\{\Theta_3^{\int}\left(\frac{\pi(x_{02\diamond j}-x_{0ij})}{2a},e^{-\left(\frac{\pi}{a}\right)^2\eta_{xj}\tau}\right)-\Theta_3^{\int}\left(\frac{\pi(x_{01\diamond j}-x_{0ij})}{2a},e^{-\left(\frac{\pi}{a}\right)^2\eta_{xj}\tau}\right)+\right.$$

$$\left.+\Theta_3^{\int}\left(\frac{\pi(x_{02\diamond j}+x_{0ij})}{2a},e^{-\left(\frac{\pi}{a}\right)^2\eta_{xj}\tau}\right)-\Theta_3^{\int}\left(\frac{\pi(x_{01\diamond j}+x_{0ij})}{2a},e^{-\left(\frac{\pi}{a}\right)^2\eta_{xj}\tau}\right)\right\}\times$$

$$\times\left\{\Theta_3^{\int\int}\left(\frac{\pi(y_{02\diamond j}-y_{01ij})}{2a},e^{-\left(\frac{\pi}{b}\right)^2\eta_{yj}\tau}\right)-\Theta_3^{\int\int}\left(\frac{\pi(y_{01\diamond j}-y_{01ij})}{2b},e^{-\left(\frac{\pi}{b}\right)^2\eta_{yj}\tau}\right)-\right.$$

$$-\Theta_3^{\int\int}\left(\frac{\pi(y_{02\diamond j}+y_{01ij})}{2b},e^{-\left(\frac{\pi}{b}\right)^2\eta_{yj}\tau}\right)+\Theta_3^{\int\int}\left(\frac{\pi(y_{01\diamond j}+y_{01ij})}{2b},e^{-\left(\frac{\pi}{b}\right)^2\eta_{yj}\tau}\right)-$$

$$-\Theta_3^{\int\int}\left(\frac{\pi(y_{02\diamond j}-y_{02ij})}{2b},e^{-\left(\frac{\pi}{b}\right)^2\eta_{yj}\tau}\right)+\Theta_3^{\int\int}\left(\frac{\pi(y_{01\diamond j}-y_{02ij})}{2b},e^{-\left(\frac{\pi}{b}\right)^2\eta_{yj}\tau}\right)+$$

$$\left.+\Theta_3^{\int\int}\left(\frac{\pi(y_{02\diamond j}+y_{02ij})}{2b},e^{-\left(\frac{\pi}{b}\right)^2\eta_{yj}\tau}\right)-\Theta_3^{\int\int}\left(\frac{\pi(y_{01\diamond j}+y_{02ij})}{2b},e^{-\left(\frac{\pi}{b}\right)^2\eta_{yj}\tau}\right)\right\}\times$$

$$\times\left\{\Theta_3^{\int}\left(\frac{\pi(z-z_{01ij})}{2(d_{j+1}-d_j)},e^{-\left(\frac{\pi}{d_{j+1}-d_j}\right)^2\eta_{zj}\tau}\right)-\Theta_3^{\int}\left(\frac{\pi(z+z_{01ij}-2d_j)}{2(d_{j+1}-d_j)},e^{-\left(\frac{\pi}{d_{j+1}-d_j}\right)^2\eta_{zj}\tau}\right)-\right.$$

$$\left.-\Theta_3^{\int}\left(\frac{\pi(z-z_{02ij})}{2(d_{j+1}-d_j)},e^{-\left(\frac{\pi}{d_{j+1}-d_j}\right)^2\eta_{zj}\tau}\right)+\Theta_3^{\int}\left(\frac{\pi(z+z_{02ij}-2d_j)}{2(d_{j+1}-d_j)},e^{-\left(\frac{\pi}{d_{j+1}-d_j}\right)^2\eta_{zj}\tau}\right)\right\}d\tau+$$

TABLE 6-continued

The spatial average pressure response of the rectangle $[(x_{02\diamond j}-x_{01\diamond j})(y_{02\diamond j}-y_{01\diamond j})]$, $i=\diamond$, $N_t+1\le\diamond\le L_r$ is given by.

$$+\frac{2a}{(\phi c_t)_j(x_{02\diamond j}-x_{01\diamond jj})(y_{02\diamond j}-y_{01\diamond j})}\sum_{i=M_r+1}^{N_r}U(t-t_{0ij})\int_0^{t-t_{0ij}}q_{ij}(t-t_{0ij}-\tau)\times$$

$$\times\left\{\Theta_3^{\int\int}\left(\frac{\pi(x_{02\diamond j}-x_{01ij})}{2a},e^{-\left(\frac{\pi}{a}\right)^2\eta_{xj}\tau}\right)-\Theta_3^{\int\int}\left(\frac{\pi(x_{01\diamond j}-x_{01ij})}{2a},e^{-\left(\frac{\pi}{a}\right)^2\eta_{xj}\tau}\right)-\right.$$

$$-\Theta_3^{\int\int}\left(\frac{\pi(x_{02\diamond j}+x_{01ij})}{2a},e^{-\left(\frac{\pi}{a}\right)^2\eta_{xj}\tau}\right)+\Theta_3^{\int\int}\left(\frac{\pi(x_{01\diamond j}+x_{01ij})}{2a},e^{-\left(\frac{\pi}{a}\right)^2\eta_{xj}\tau}\right)-$$

$$-\Theta_3^{\int\int}\left(\frac{\pi(x_{02\diamond j}-x_{02ij})}{2a},e^{-\left(\frac{\pi}{a}\right)^2\eta_{xj}\tau}\right)+\Theta_3^{\int\int}\left(\frac{\pi(x_{01\diamond j}-x_{02ij})}{2a},e^{-\left(\frac{\pi}{a}\right)^2\eta_{xj}\tau}\right)+$$

$$\left.+\Theta_3^{\int\int}\left(\frac{\pi(x_{02\diamond j}+x_{02ij})}{2a},e^{-\left(\frac{\pi}{a}\right)^2\eta_{xj}\tau}\right)-\Theta_3^{\int\int}\left(\frac{\pi(x_{01\diamond j}+x_{02ij})}{2a},e^{-\left(\frac{\pi}{a}\right)^2\eta_{xj}\tau}\right)\right\}+$$

$$\times\left\{\Theta_3^{\int}\left(\frac{\pi(y_{02\diamond j}-y_{0ij})}{2b},e^{-\left(\frac{\pi}{b}\right)^2\eta_{yj}\tau}\right)-\Theta_3^{\int}\left(\frac{\pi(y_{01\diamond j}-y_{0ij})}{2b},e^{-\left(\frac{\pi}{b}\right)^2\eta_{yj}\tau}\right)+\right.$$

$$\left.+\Theta_3^{\int}\left(\frac{\pi(y_{02\diamond j}+y_{0ij})}{2b},e^{-\left(\frac{\pi}{b}\right)^2\eta_{yj}\tau}\right)-\Theta_3^{\int}\left(\frac{\pi(y_{01\diamond j}+y_{0ij})}{2b},e^{-\left(\frac{\pi}{b}\right)^2\eta_{yj}\tau}\right)\right\}\times$$

$$\times\left\{\Theta_3^{\int}\left(\frac{\pi(z-z_{01ij})}{2(d_{j+1}-d_j)},e^{-\left(\frac{\pi}{d_{j+1}-d_j}\right)^2\eta_{zj}\tau}\right)-\Theta_3^{\int}\left(\frac{\pi(z+z_{01ij}-2d_j)}{2(d_{j+1}-d_j)},e^{-\left(\frac{\pi}{d_{j+1}-d_j}\right)^2\eta_{zj}\tau}\right)-\right.$$

$$\left.-\Theta_3^{\int}\left(\frac{\pi(z-z_{02ij})}{2(d_{j+1}-d_j)},e^{-\left(\frac{\pi}{d_{j+1}-d_j}\right)^2\eta_{zj}\tau}\right)+\Theta_3^{\int}\left(\frac{\pi(z+z_{02ij}-2d_j)}{2(d_{j+1}-d_j)},e^{-\left(\frac{\pi}{d_{j+1}-d_j}\right)^2\eta_{zj}\tau}\right)\right\}d\tau+$$

$$+\frac{1}{(\phi c_t)_j(d_{j+1}-d_j)(x_{02\diamond j}-x_{01\diamond jj})(y_{02\diamond j}-y_{01\diamond j})}\times$$

$$\times\int_0^t\int_0^a\int_0^b\left[\psi_j(u,v,\tau)\Theta_3\left\{\frac{\pi(z-d_j)}{2(d_{j+1}-d_j)},e^{-\left(\frac{\pi}{d_{j+1}-d_j}\right)^2\eta_{zj}(t-\tau)}\right\}-\right.$$

$$\left.-\psi_{j+1}(u,v,\tau)\Theta_4\left\{\frac{\pi(z-d_j)}{2(d_{j+1}-d_j)},e^{-\left(\frac{\pi}{d_{j+1}-d_j}\right)^2\eta_{zj}(t-\tau)}\right\}\right]\times$$

$$\times\left[\Theta_3^{\int}\left\{\frac{\pi(x_{02\diamond j}-u)}{2a},e^{-\left(\frac{\pi}{a}\right)^2\eta_{xj}(t-\tau)}\right\}-\Theta_3^{\int}\left\{\frac{\pi(x_{01\diamond j}-u)}{2a},e^{-\left(\frac{\pi}{a}\right)^2\eta_{xj}(t-\tau)}\right\}+\right.$$

$$\left.+\Theta_3^{\int}\left\{\frac{\pi(x_{02\diamond j}+u)}{2a},e^{-\left(\frac{\pi}{a}\right)^2\eta_{xj}(t-\tau)}\right\}-\Theta_3^{\int}\left\{\frac{\pi(x_{01\diamond j}+u)}{2a},e^{-\left(\frac{\pi}{a}\right)^2\eta_{xj}(t-\tau)}\right\}\right]\times$$

$$\times\left[\Theta_3^{\int}\left\{\frac{\pi(y_{02\diamond j}-v)}{2b},e^{-\left(\frac{\pi}{b}\right)^2\eta_{yj}(t-\tau)}\right\}-\Theta_3^{\int}\left\{\frac{\pi(y_{01\diamond j}-v)}{2b},e^{-\left(\frac{\pi}{b}\right)^2\eta_{yj}(t-\tau)}\right\}+\right.$$

$$\left.+\Theta_3^{\int}\left\{\frac{\pi(y_{02\diamond j}+v)}{2b},e^{-\left(\frac{\pi}{b}\right)^2\eta_{yj}(t-\tau)}\right\}-\Theta_3^{\int}\left\{\frac{\pi(y_{01\diamond j}+v)}{2b},e^{-\left(\frac{\pi}{b}\right)^2\eta_{yj}(t-\tau)}\right\}\right]dudvd\tau+$$

$$+\frac{1}{(\phi c_t)_j(d_{j+1}-d_j)(x_{02\diamond j}-x_{01\diamond jj})(y_{02\diamond j}-y_{01\diamond j})}\times$$

$$\times\int_0^t\int_0^b\int_0^{d_{j+1}-d_j}\left\{\psi_{0yzj}(v,w,\tau)\left\{\Theta_3^{\int}\left(\frac{\pi x_{02\diamond j}}{2a},e^{-\left(\frac{\pi}{a}\right)^2\eta_{zj}(t-\tau)}\right)-\Theta_3^{\int}\left(\frac{\pi x_{01\diamond j}}{2a},e^{-\left(\frac{\pi}{a}\right)^2\eta_{zj}(t-\tau)}\right)\right\}-\right.$$

$$\left.-\psi_{ayzj}(v,w,\tau)\left\{\Theta_4^{\int}\left(\frac{\pi x_{02\diamond j}}{2a},e^{-\left(\frac{\pi}{a}\right)^2\eta_{xj}(t-\tau)}\right)-\Theta_4^{\int}\left(\frac{\pi x_{01\diamond j}}{2a},e^{-\left(\frac{\pi}{a}\right)^2\eta_{xj}(t-\tau)}\right)\right\}\right\}\times$$

$$\times\left[\Theta_3^{\int}\left\{\frac{\pi(x_{02\diamond j}-v)}{2b},e^{-\left(\frac{\pi}{b}\right)^2\eta_{yj}(t-\tau)}\right\}-\Theta_3^{\int}\left\{\frac{\pi(y_{01\diamond j}-v)}{2b},e^{-\left(\frac{\pi}{b}\right)^2\eta_{yj}(t-\tau)}\right\}+\right.$$

$$\left.+\Theta_3^{\int}\left\{\frac{\pi(y_{02\diamond j}+v)}{2b},e^{-\left(\frac{\pi}{b}\right)^2\eta_{yj}(t-\tau)}\right\}-\Theta_3^{\int}\left\{\frac{\pi(y_{01\diamond j}+v)}{2b},e^{-\left(\frac{\pi}{b}\right)^2\eta_{yj}(t-\tau)}\right\}\right]\times$$

$$\times\left[\Theta_3\left\{\frac{\pi(z-d_j-w)}{2(d_{j+1}-d_j)},e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},e^{-\left(\frac{\pi}{d_{j+1}-d_j}\right)^2\eta_{zj}(t-\tau)}\right\}\right]dvdwd\tau+$$

TABLE 6-continued

The spatial average pressure response of the rectangle $[(x_{02\diamond j}-x_{01\diamond j})(y_{02\diamond j}-y_{01\diamond j})]$, $i=\diamond$, $N_l+1\le\diamond\le L_r$ is given by.

$$
\begin{aligned}
&+\frac{1}{(\phi c_t)_j(d_{j+1}-d_j)(x_{02\diamond j}-x_{01\diamond jj})(y_{02\diamond j}-y_{01\diamond j})}\times\\
&\times\int_0^t\int_0^a\int_0^{d_{j+1}-d_j}\Big\{\psi_{x0zj}(u,w,\tau)\Big\{\Theta_3^{\int}\Big(\frac{\pi y_{02\diamond j}}{2b},e^{-(\frac{\pi}{b})^2\eta_{yj}(t-\tau)}\Big)-\Theta_3^{\int}\Big(\frac{\pi y_{01\diamond j}}{2b},e^{-(\frac{\pi}{b})^2\eta_{yj}(t-\tau)}\Big)\Big\}-\\
&-\psi_{xbzj}(u,w,\tau)\Big\{\Theta_4^{\int}\Big(\frac{\pi y_{02\diamond j}}{2b},e^{-(\frac{\pi}{b})^2\eta_{yj}(t-\tau)}\Big)-\Theta_4^{\int}\Big(\frac{\pi y_{01\diamond j}}{2b},e^{-(\frac{\pi}{b})^2\eta_{yj}(t-\tau)}\Big)\Big\}\Big\}\times\\
&\times\Big[\Theta_3^{\int}\Big\{\frac{\pi(x_{02\diamond j}-u)}{2a},e^{-(\frac{\pi}{a})^2\eta_{zj}(t-\tau)}\Big\}-\Theta_3^{\int}\Big\{\frac{\pi(x_{01\diamond j}-u)}{2a},e^{-(\frac{\pi}{a})^2\eta_{zj}(t-\tau)}\Big\}+\\
&+\Theta_3^{\int}\Big\{\frac{\pi(x_{02\diamond j}+u)}{2a},e^{-(\frac{\pi}{a})^2\eta_{xj}(t-\tau)}\Big\}-\Theta_3^{\int}\Big\{\frac{\pi(x_{01\diamond j}+u)}{2a},e^{-(\frac{\pi}{a})^2\eta_{xj}(t-\tau)}\Big\}\Big]\times\\
&\times\Big[\Theta_3\Big\{\frac{\pi(z-d_j-w)}{2(d_{j+1}-d_j)},e^{-\left(\frac{\pi}{d_{j+1}-d_j}\right)^2\eta_{zj}(t-\tau)}\Big\}+\Theta_3\Big\{\frac{\pi(z-d_j+w)}{2(d_{j+1}-d_j)},e^{-\left(\frac{\pi}{d_{j+1}-d_j}\right)^2\eta_{zj}(t-\tau)}\Big\}\Big]dudwd\tau+\\
&+\frac{1}{2(d_{j+1}-d_j)(x_{02\diamond j}-x_{01\diamond jj})(y_{02\diamond j}-y_{01\diamond j})}\times\\
&\times\int_0^{d_{j+1}-d_j}\int_0^b\int_0^a\varphi_j(u,v,w+d_j)\Big[\Theta_3^{\int}\Big\{\frac{\pi(x_{02\diamond j}-u)}{2a},e^{-(\frac{\pi}{a})^2\eta_{xj}(t-\tau)}\Big\}-\Theta_3^{\int}\Big\{\frac{\pi(x_{01\diamond j}-u)}{2a},e^{-(\frac{\pi}{a})^2\eta_{xj}(t-\tau)}\Big\}+\\
&+\Theta_3^{\int}\Big\{\frac{\pi(x_{02\diamond j}+u)}{2a},e^{-(\frac{\pi}{a})^2\eta_{xj}(t-\tau)}\Big\}-\Theta_3^{\int}\Big\{\frac{\pi(x_{01\diamond j}+u)}{2a},e^{-(\frac{\pi}{a})^2\eta_{xj}(t-\tau)}\Big\}\Big]\times\\
&\times\Big[\Theta_3^{\int}\Big\{\frac{\pi(y_{02\diamond j}-v)}{2b},e^{-(\frac{\pi}{b})^2\eta_{yj}(t-\tau)}\Big\}-\Theta_3^{\int}\Big\{\frac{\pi(y_{01\diamond j}-v)}{2b},e^{-(\frac{\pi}{b})^2\eta_{yj}(t-\tau)}\Big\}+\\
&+\Theta_3^{\int}\Big\{\frac{\pi(y_{02\diamond j}+v)}{2b},e^{-(\frac{\pi}{b})^2\eta_{yj}(t-\tau)}\Big\}-\Theta_3^{\int}\Big\{\frac{\pi(y_{01\diamond j}+v)}{2b},e^{-(\frac{\pi}{b})^2\eta_{yj}(t-\tau)}\Big\}\Big]\times\\
&\times\Big\{\Theta_3\Big\{\frac{\pi(z-d_j-w)}{2(d_{j+1}-d_j)},e^{-\left(\frac{\pi}{d_{j+1}-d_j}\right)^2\eta_{zj}t}\Big\}+\Theta_3\Big\{\frac{\pi(z-d_j+w)}{2(d_{j+1}-d_j)},e^{-\left(\frac{\pi}{d_{j+1}-d_j}\right)^2\eta_{zj}t}\Big\}\Big\}\Big]dudvdw
\end{aligned}
$$

TABLE 7

The spatial average pressure response of the rectangle $[(y_{02\diamond j}-y_{01\diamond j})(z_{02\diamond j}-z_{01\diamond j})]$, $i=\diamond$, $L_r+1\le\diamond\le M_r$ is given by.

$$
\begin{aligned}
p_j=&\frac{(d_{j+1}-d_j)}{(\phi c_t)_j a(y_{02\diamond j}-y_{01\diamond j})(z_{02\diamond j}-z_{01\diamond j})}\sum_{i=1}^{L_l}U(t-t_{0ij})\int_0^{t-t_{0ij}}q_{ij}(t-t_{0ij}-\tau)\times\\
&\times\Big\{\Theta_3\Big(\frac{\pi(x-x_{0j})}{2a},e^{-(\frac{\pi}{a})^2\eta_{xj}\tau}\Big)+\Theta_3\Big(\frac{\pi(x+x_{0j})}{2a},e^{-(\frac{\pi}{a})^2\eta_{xj}\tau}\Big)\Big\}\times\\
&\times\Big\{\Theta_3^{\int}\Big(\frac{\pi(y_{02\diamond j}-y_{0ij})}{2b},e^{-(\frac{\pi}{b})^2\eta_{yj}\tau}\Big)-\Theta_3^{\int}\Big(\frac{\pi(y_{01\diamond j}-y_{0ij})}{2b},e^{-(\frac{\pi}{b})^2\eta_{yj}\tau}\Big)+\\
&+\Theta_3^{\int}\Big(\frac{\pi(y_{02\diamond j}+y_{0ij})}{2b},e^{-(\frac{\pi}{b})^2\eta_{yj}\tau}\Big)-\Theta_3^{\int}\Big(\frac{\pi(y_{01\diamond j}+y_{0ij})}{2b},e^{-(\frac{\pi}{b})^2\eta_{yj}\tau}\Big)\Big\}\times\\
&\times\Big\{\Theta_3^{\int\int}\Big(\frac{\pi(z_{02\diamond j}-z_{01ij})}{2(d_{j+1}-d_j)},e^{-\left(\frac{\pi}{d_{j+1}-d_j}\right)^2\eta_{zj}\tau}\Big)-\Theta_3^{\int\int}\Big(\frac{\pi(z_{01\diamond j}-z_{01ij})}{2(d_{j+1}-d_j)},e^{-\left(\frac{\pi}{d_{j+1}-d_j}\right)^2\eta_{zj}\tau}\Big)-\\
&-\Theta_3^{\int\int}\Big(\frac{\pi(z_{02\diamond j}+z_{01ij}-2d_j)}{2(d_{j+1}-d_j)},e^{-\left(\frac{\pi}{d_{j+1}-d_j}\right)^2\eta_{zj}\tau}\Big)+\Theta_3^{\int\int}\Big(\frac{\pi(z_{01\diamond j}+z_{01ij}-2d_j)}{2(d_{j+1}-d_j)},e^{-\left(\frac{\pi}{d_{j+1}-d_j}\right)^2\eta_{zj}\tau}\Big)-\\
&-\Theta_3^{\int\int}\Big(\frac{\pi(z_{02\diamond j}-z_{02ij})}{2(d_{j+1}-d_j)},e^{-\left(\frac{\pi}{d_{j+1}-d_j}\right)^2\eta_{zj}\tau}\Big)+\Theta_3^{\int\int}\Big(\frac{\pi(z_{02\diamond j}-z_{01ij})}{2(d_{j+1}-d_j)},e^{-\left(\frac{\pi}{d_{j+1}-d_j}\right)^2\eta_{zj}\tau}\Big)+\\
&+\Theta_3^{\int\int}\Big(\frac{\pi(z_{02\diamond j}+z_{02ij}-2d_j)}{2(d_{j+1}-d_j)},e^{-\left(\frac{\pi}{d_{j+1}-d_j}\right)^2\eta_{zj}\tau}\Big)-\Theta_3^{\int\int}\Big(\frac{\pi(z_{01\diamond j}+z_{02ij}-2d_j)}{2(d_{j+1}-d_j)},e^{-\left(\frac{\pi}{d_{j+1}-d_j}\right)^2\eta_{zj}\tau}\Big)\Big\}+
\end{aligned}
\tag{0.13}
$$

TABLE 7-continued

The spatial average pressure response of the rectangle $[(y_{02\diamond j}-y_{01\diamond j})(z_{02\diamond j}-z_{01\diamond j})]$, $i=\diamond$, $L_r+1\le\diamond\le M_r$ is given by.

$$+\frac{1}{(\phi c_t)_j(y_{02\diamond j}-y_{01\diamond j})(z_{02\diamond j}-z_{01\diamond j})}\sum_{i=L_t+1}^{M_t}U(t-t_{0ij})\int_0^{t-t_{0ij}}q_{ij}(t-t_{0ij}-\tau)\times$$
$$\times\left\{\Theta_3^{\int}\left(\frac{\pi(y_{02\diamond j}-y_{0ij})}{2b},\ e^{-\left(\frac{\pi}{b}\right)^2\eta_{yj}\tau}\right)-\Theta_3^{\int}\left(\frac{\pi(y_{01\diamond j}-y_{0ij})}{2b},\ e^{-\left(\frac{\pi}{b}\right)^2\eta_{yj}\tau}\right)+\right.$$
$$\left.+\Theta_3^{\int}\left(\frac{\pi(y_{02\diamond j}+y_{0ij})}{2b},\ e^{-\left(\frac{\pi}{b}\right)^2\eta_{yj}\tau}\right)-\Theta_3^{\int}\left(\frac{\pi(y_{01\diamond j}+y_{0ij})}{2b},\ e^{-\left(\frac{\pi}{b}\right)^2\eta_{yj}\tau}\right)\right\}\times$$

$$\times\left\{\Theta_3^{\int}\left\{\frac{\pi(z_{02\diamond j}-z_{0ij})}{2(d_{j+1}-d_j)},\ e^{-\left(\frac{\pi}{d_{j+1}-d_j}\right)^2\eta_{zj}(t-\tau)}\right\}-\Theta_3^{\int}\left\{\frac{\pi(z_{01\diamond j}-z_{0ij})}{2(d_{j+1}-d_j)},\ e^{-\left(\frac{\pi}{d_{j+1}-d_j}\right)^2\eta_{zj}(t-\tau)}\right\}+\right.$$
$$\left.+\Theta_3^{\int}\left\{\frac{\pi(z_{02\diamond j}+z_{0ij}-2d_j)}{2(d_{j+1}-d_j)},\ e^{-\left(\frac{\pi}{d_{j+1}-d_j}\right)^2\eta_{zj}(t-\tau)}\right\}-\Theta_3^{\int}\left\{\frac{\pi(z_{01\diamond j}+z_{0ij}-2d_j)}{2(d_{j+1}-d_j)},\ e^{-\left(\frac{\pi}{d_{j+1}-d_j}\right)^2\eta_{zj}(t-\tau)}\right\}\right\}\times$$
$$\times\left\{\Theta_3^{\int}\left(\frac{\pi(x-x_{01ij})}{2a},\ e^{-\left(\frac{\pi}{a}\right)^2\eta_{xj}\tau}\right)-\Theta_3^{\int}\left(\frac{\pi(x+x_{01ij})}{2a},\ e^{-\left(\frac{\pi}{a}\right)^2\eta_{xy}\tau}\right)-\right.$$
$$\left.-\Theta_3^{\int}\left(\frac{\pi(x-x_{02ij})}{2a},\ e^{-\left(\frac{\pi}{a}\right)^2\eta_{xj}\tau}\right)+\Theta_3^{\int}\left(\frac{\pi(x+x_{02ij})}{2a},\ e^{-\left(\frac{\pi}{a}\right)^2\eta_{xj}\tau}\right)\right\}d\tau$$

$$+\frac{b}{(\phi c_t)_j a(y_{02\diamond j}-y_{01\diamond j})(z_{02\diamond j}-z_{01\diamond j})}\sum_{i=M_t+1}^{N_t}U(t-t_{0ij})\int_0^{t-t_{0ij}}q_{ij}(t-t_{0ij}-\tau)\times$$
$$\times\left\{\Theta_3\left(\frac{\pi(x-x_{0j})}{2a},\ e^{-\left(\frac{\pi}{a}\right)^2\eta_{xj}\tau}\right)+\Theta_3\left(\frac{\pi(x+x_{0j})}{2a},\ e^{-\left(\frac{\pi}{a}\right)^2\eta_{xj}\tau}\right)\right\}\times$$
$$\times\left\{\Theta_3^{\int}\left\{\frac{\pi(z_{02\diamond j}-z_{0ij})}{2(d_{j+1}-d_j)},\ e^{-\left(\frac{\pi}{d_{j+1}-d_j}\right)^2\eta_{zj}(t-\tau)}\right\}-\Theta_3^{\int}\left\{\frac{\pi(z_{01\diamond j}-z_{0ij})}{2(d_{j+1}-d_j)},\ e^{-\left(\frac{\pi}{d_{j+1}-d_j}\right)^2\eta_{zj}(t-\tau)}\right\}+\right.$$
$$\left.+\Theta_3^{\int}\left\{\frac{\pi(z_{02\diamond j}+z_{0ij}-2d_j)}{2(d_{j+1}-d_j)},\ e^{-\left(\frac{\pi}{d_{j+1}-d_j}\right)^2\eta_{zj}(t-\tau)}\right\}-\Theta_3^{\int}\left\{\frac{\pi(z_{01\diamond j}+z_{0ij}-2d_j)}{2(d_{j+1}-d_j)},\ e^{-\left(\frac{\pi}{d_{j+1}-d_j}\right)^2\eta_{zj}(t-\tau)}\right\}\right\}\times$$
$$\times\left\{\Theta_3^{\int\int}\left(\frac{\pi(y_{02\diamond j}-y_{01ij})}{2a},\ e^{-\left(\frac{\pi}{b}\right)^2\eta_{yj}\tau}\right)-\Theta_3^{\int\int}\left(\frac{\pi(y_{01\diamond j}-y_{01ij})}{2b},\ e^{-\left(\frac{\pi}{b}\right)^2\eta_{yj}\tau}\right)-\right.$$
$$-\Theta_3^{\int\int}\left(\frac{\pi(y_{02\diamond j}+y_{01ij})}{2b},\ e^{-\left(\frac{\pi}{b}\right)^2\eta_{yj}\tau}\right)+\Theta_3^{\int\int}\left(\frac{\pi(y_{01\diamond j}+y_{01ij})}{2b},\ e^{-\left(\frac{\pi}{b}\right)^2\eta_{yj}\tau}\right)-$$
$$-\Theta_3^{\int\int}\left(\frac{\pi(y_{02\diamond j}-y_{02ij})}{2b},\ e^{-\left(\frac{\pi}{b}\right)^2\eta_{yj}\tau}\right)+\Theta_3^{\int\int}\left(\frac{\pi(y_{01\diamond j}-y_{02ij})}{2b},\ e^{-\left(\frac{\pi}{b}\right)^2\eta_{yj}\tau}\right)+$$
$$\left.+\Theta_3^{\int\int}\left(\frac{\pi(y_{02\diamond j}+y_{02ij})}{2b},\ e^{-\left(\frac{\pi}{b}\right)^2\eta_{yj}\tau}\right)-\Theta_3^{\int\int}\left(\frac{\pi(y_{01\diamond j}+y_{02ij})}{2b},\ e^{-\left(\frac{\pi}{b}\right)^2\eta_{yj}\tau}\right)\right\}d\tau+$$

$$+\frac{1}{2\pi^2(\phi c_t)_j a(y_{02\diamond j}-y_{01\diamond j})(z_{02\diamond j}-z_{01\diamond j})}\sum_{i=N_t+1}^{N_d}U(t-t_{0ij})\sin\vartheta_{0ij}\times$$
$$\times\int_0^{t-t_{0ij}}q_j(t-t_{0ij}-\tau)\int_{z01ij}^{z02ij}\left[\left\{\Theta_3\left(\frac{\pi}{2a}\{x-(z_{0ij}-\gamma_{0ij})\cot\vartheta_{0ij}\cos\theta_{0ij}\},\ e^{-\left(\frac{\pi}{a}\right)^2\eta_{xj}\tau}\right)+\right.\right.$$
$$\left.+\Theta_3\left(\frac{\pi}{2a}\{x+(z_{0ij}-\gamma_{0ij})\cot\vartheta_{0ij}\cos\theta_{0ij}\},\ e^{-\left(\frac{\pi}{a}\right)^2\eta_{xj}\tau}\right)\right\}\times$$
$$\times\left\{\Theta_3^{\int}\left(\frac{\pi}{2b}\{y_{02\diamond j}-(z_{0ij}-\gamma_{0ij})\cot\vartheta_{0ij}\sin\theta_{0ij}\},\ e^{-\left(\frac{\pi}{b}\right)^2\eta_{yj}\tau}\right)-\right.$$
$$-\Theta_3^{\int}\left(\frac{\pi}{2b}\{y_{01\diamond j}-(z_{0ij}-\gamma_{0ij})\cot\vartheta_{0ij}\sin\theta_{0ij}\},\ e^{-\left(\frac{\pi}{b}\right)^2\eta_{yj}\tau}\right)+$$
$$+\Theta_3^{\int}\left(\frac{\pi}{2b}\{y_{02\diamond j}+(z_{0ij}-\gamma_{0ij})\cot\vartheta_{0ij}\sin\theta_{0ij}\},\ e^{-\left(\frac{\pi}{b}\right)^2\eta_{yj}\tau}\right)-$$
$$\left.-\Theta_3^{\int}\left(\frac{\pi}{2b}\{y_{01\diamond j}+(z_{0ij}-\gamma_{0ij})\cot\vartheta_{0ij}\sin\theta_{0ij}\},\ e^{-\left(\frac{\pi}{b}\right)^2\eta_{yj}\tau}\right)\right\}\times$$

TABLE 7-continued

The spatial average pressure response of the rectangle $[(y_{02\diamond j}-y_{01\diamond j})(z_{02\diamond j}-z_{01\diamond j})]$, $i=\diamond$, $L_r+1\le\diamond\le M_r$ is given by.

$$\times\left\{\Theta_3^{\int}\left(\frac{\pi(z_{02\diamond j}-z_{0ij})}{2(d_{j+1}-d_j)},\ e^{-\eta_{zj}\left(\frac{\pi}{d_{j+1}-d_j}\right)^2 t}\right)-\Theta_3^{\int}\left(\frac{\pi(z_{01\diamond j}-z_{0ij})}{2(d_{j+1}-d_j)},\ e^{-\eta_{zj}\left(\frac{\pi}{d_{j+1}-d_j}\right)^2 t}\right)+\right.$$

$$\left.+\Theta_3^{\int}\left(\frac{\pi(z_{02\diamond j}+z_{0ij}-2d_j)}{2(d_{j+1}-d_j)},\ e^{-\eta_{zj}\left(\frac{\pi}{d_{j+1}-d_j}\right)^2 t}\right)-\Theta_3^{\int}\left(\frac{\pi(z_{01\diamond j}+z_{0ij}-2d_j)}{2(d_{j+1}-d_j)},\ e^{-\eta_{zj}\left(\frac{\pi}{d_{j+1}-d_j}\right)^2 t}\right)\right\}\Bigg]\,dz_{0ij}d\tau+$$

$$+\frac{2b}{(\phi c_t)_j(y_{02\diamond j}-y_{01\diamond j})(z_{02\diamond j}-z_{01\diamond j})}\sum_{i=N_d+1}^{L_r}U(t-t_{0ij})\int_0^{t-t_{0ij}}q_{ij}(t-t_{0ij}-\tau)\times$$

$$\times\left\{\Theta_3^{\int}\left(\frac{\pi(x-x_{01ij})}{2a},\ e^{-\left(\frac{\pi}{a}\right)^2\eta_{xj}\tau}\right)-\Theta_3^{\int}\left(\frac{\pi(x+x_{01ij})}{2a},\ e^{-\left(\frac{\pi}{a}\right)^2\eta_{xj}\tau}\right)-\right.$$

$$\left.-\Theta_3^{\int}\left(\frac{\pi(x-x_{02ij})}{2a},\ e^{-\left(\frac{\pi}{a}\right)^2\eta_{xj}\tau}\right)+\Theta_3^{\int}\left(\frac{\pi(x+x_{02ij})}{2a},\ e^{-\left(\frac{\pi}{a}\right)^2\eta_{xj}\tau}\right)\right\}\times$$

$$\times\left\{\Theta_3^{\int\int}\left(\frac{\pi(y_{02\diamond j}-y_{01ij})}{2a},\ e^{-\left(\frac{\pi}{b}\right)^2\eta_{yj}\tau}\right)-\Theta_3^{\int\int}\left(\frac{\pi(y_{01\diamond j}-y_{01ij})}{2b},\ e^{-\left(\frac{\pi}{b}\right)^2\eta_{yj}\tau}\right)-\right.$$

$$-\Theta_3^{\int\int}\left(\frac{\pi(y_{02\diamond j}+y_{01ij})}{2b},\ e^{-\left(\frac{\pi}{b}\right)^2\eta_{yj}\tau}\right)+\Theta_3^{\int\int}\left(\frac{\pi(y_{01\diamond j}+y_{01ij})}{2b},\ e^{-\left(\frac{\pi}{b}\right)^2\eta_{yj}\tau}\right)-$$

$$-\Theta_3^{\int\int}\left(\frac{\pi(y_{02\diamond j}-y_{02ij})}{2b},\ e^{-\left(\frac{\pi}{b}\right)^2\eta_{yj}\tau}\right)+\Theta_3^{\int\int}\left(\frac{\pi(y_{01\diamond j}-y_{02ij})}{2b},\ e^{-\left(\frac{\pi}{b}\right)^2\eta_{yj}\tau}\right)+$$

$$\left.+\Theta_3^{\int\int}\left(\frac{\pi(y_{02\diamond j}+y_{02ij})}{2b},\ e^{-\left(\frac{\pi}{b}\right)^2\eta_{yj}\tau}\right)-\Theta_3^{\int\int}\left(\frac{\pi(y_{01\diamond j}+y_{02ij})}{2b},\ e^{-\left(\frac{\pi}{b}\right)^2\eta_{yj}\tau}\right)\right\}\times$$

$$\times\left\{\Theta_3^{\int}\left\{\frac{\pi(z_{02\diamond j}-z_{0ij})}{2(d_{j+1}-d_j)},\ e^{-\left(\frac{\pi}{d_{j+1}-d_j}\right)^2\eta_{zj}(t-\tau)}\right\}-\Theta_3^{\int}\left\{\frac{\pi(z_{01\diamond j}-z_{0ij})}{2(d_{j+1}-d_j)},\ e^{-\left(\frac{\pi}{d_{j+1}-d_j}\right)^2\eta_{zj}(t-\tau)}\right\}+\right.$$

$$\left.+\Theta_3^{\int}\left\{\frac{\pi(z_{02\diamond j}+z_{0ij}-2d_j)}{2(d_{j+1}-d_j)},\ e^{-\left(\frac{\pi}{d_{j+1}-d_j}\right)^2\eta_{zj}(t-\tau)}\right\}+\Theta_3^{\int}\left\{\frac{\pi(z_{01j}+z_{0ij}-2d_j)}{2(d_{j+1}-d_j)},\ e^{-\left(\frac{\pi}{d_{j+1}-d_j}\right)^2\eta_{zj}(t-\tau)}\right\}\right\}d\tau+$$

$$+\frac{2b(d_{j+1}-d_j)}{(\phi c_t)_j a(y_{02\diamond j}-y_{01\diamond j})(z_{02\diamond j}-z_{01\diamond j})}\sum_{i=L_r+1}^{M_r}U(t-t_{0ij})\int_0^{t-t_{0ij}}q_{ij}(t-t_{0ij}-\tau)\times$$

$$\times\left\{\Theta_3\left(\frac{\pi(x-x_{0ij})}{2a},\ e^{-\left(\frac{\pi}{a}\right)^2\eta_{xj}\tau}\right)+\Theta_3\left(\frac{\pi(x+x_{0j})}{2a},\ e^{-\left(\frac{\pi}{a}\right)^2\eta_{xj}\tau}\right)\right\}\times$$

$$\times\left\{\Theta_3^{\int\int}\left(\frac{\pi(y_{02\diamond j}-y_{01ij})}{2a},\ e^{-\left(\frac{\pi}{b}\right)^2\eta_{yj}\tau}\right)-\Theta_3^{\int\int}\left(\frac{\pi(y_{01\diamond j}-y_{01ij})}{2b},\ e^{-\left(\frac{\pi}{b}\right)^2\eta_{yj}\tau}\right)-\right.$$

$$-\Theta_3^{\int\int}\left(\frac{\pi(y_{02\diamond j}+y_{01ij})}{2b},\ e^{-\left(\frac{\pi}{b}\right)^2\eta_{yj}\tau}\right)+\Theta_3^{\int\int}\left(\frac{\pi(y_{01\diamond j}+y_{01ij})}{2b},\ e^{-\left(\frac{\pi}{b}\right)^2\eta_{yj}\tau}\right)-$$

$$-\Theta_3^{\int\int}\left(\frac{\pi(y_{02\diamond j}-y_{02ij})}{2b},\ e^{-\left(\frac{\pi}{b}\right)^2\eta_{yj}\tau}\right)+\Theta_3^{\int\int}\left(\frac{\pi(y_{01\diamond j}-y_{02ij})}{2b},\ e^{-\left(\frac{\pi}{b}\right)^2\eta_{yj}\tau}\right)+$$

$$\left.+\Theta_3^{\int\int}\left(\frac{\pi(y_{02\diamond j}+y_{02ij})}{2b},\ e^{-\left(\frac{\pi}{b}\right)^2\eta_{yj}\tau}\right)-\Theta_3^{\int\int}\left(\frac{\pi(y_{01\diamond j}+y_{02ij})}{2b},\ e^{-\left(\frac{\pi}{b}\right)^2\eta_{yj}\tau}\right)\right\}\times$$

$$\times\left\{\Theta_3^{\int\int}\left(\frac{\pi(z_{02\diamond j}-z_{01ij})}{2(d_{j+1}-d_j)},\ e^{-\left(\frac{\pi}{d_{j+1}-d_j}\right)^2\eta_{zj}\tau}\right)-\Theta_3^{\int\int}\left(\frac{\pi(z_{01\diamond j}-z_{01ij})}{2(d_{j+1}-d_j)},\ e^{-\left(\frac{\pi}{d_{j+1}-d_j}\right)^2\eta_{zj}\tau}\right)-\right.$$

$$-\Theta_3^{\int\int}\left(\frac{\pi(z_{02\diamond j}+z_{01ij}-2d_j)}{2(d_{j+1}-d_j)},\ e^{-\left(\frac{\pi}{d_{j+1}-d_j}\right)^2\eta_{zj}\tau}\right)+\Theta_3^{\int\int}\left(\frac{\pi(z_{01\diamond j}+z_{01ij}-2d_j)}{2(d_{j+1}-d_j)},\ e^{-\left(\frac{\pi}{d_{j+1}-d_j}\right)^2\eta_{zj}\tau}\right)-$$

$$-\Theta_3^{\int\int}\left(\frac{\pi(z_{02\diamond j}-z_{02ij})}{2(d_{j+1}-d_j)},\ e^{-\left(\frac{\pi}{d_{j+1}-d_j}\right)^2\eta_{zj}\tau}\right)+\Theta_3^{\int\int}\left(\frac{\pi(z_{02\diamond j}-z_{01ij})}{2(d_{j+1}-d_j)},\ e^{-\left(\frac{\pi}{d_{j+1}-d_j}\right)^2\eta_{zj}\tau}\right)+$$

$$\left.+\Theta_3^{\int\int}\left(\frac{\pi(z_{02\diamond j}+z_{02ij}-2d_j)}{2(d_{j+1}-d_j)},\ e^{-\left(\frac{\pi}{d_{j+1}-d_j}\right)^2\eta_{zj}\tau}\right)-\Theta_3^{\int\int}\left(\frac{\pi(z_{01\diamond j}+z_{02ij}-2d_j)}{2(d_{j+1}-d_j)},\ e^{-\left(\frac{\pi}{d_{j+1}-d_j}\right)^2\eta_{zj}\tau}\right)\right\}d\tau+$$

TABLE 7-continued

The spatial average pressure response of the rectangle $[(y_{02\diamond j}-y_{01\diamond j})(z_{02\diamond j}-z_{01\diamond j})]$, $i=\diamond, L_r+1\le\diamond\le M_r$ is given by.

$$+\frac{2(d_{j+1}-d_j)}{(\phi c_t)_j(y_{02\diamond j}-y_{01\diamond j})(z_{02\diamond j}-z_{01\diamond j})}\sum_{i=M_r+1}^{N_r}U(t-t_{0ij})\int_0^{t-t_{0ij}}q_{ij}(t-t_{0ij}-\tau)\times$$

$$\times\left\{\Theta_3^f\left(\frac{\pi(x-x_{01ij})}{2a},e^{-\left(\frac{\pi}{a}\right)^2\eta_{xj}\tau}\right)-\Theta_3^f\left(\frac{\pi(x+x_{01ij})}{2a},e^{-\left(\frac{\pi}{a}\right)^2\eta_{xj}\tau}\right)-\right.$$

$$\left.-\Theta_3^f\left(\frac{\pi(x-x_{02ij})}{2a},e^{-\left(\frac{\pi}{a}\right)^2\eta_{xj}\tau}\right)+\Theta_3^f\left(\frac{\pi(x+x_{02ij})}{2a},e^{-\left(\frac{\pi}{a}\right)^2\eta_{xj}\tau}\right)\right\}\times$$

$$\times\left\{\Theta_3^f\left(\frac{\pi(y_{02\diamond j}-y_{0ij})}{2b},e^{-\left(\frac{\pi}{b}\right)^2\eta_{yj}\tau}\right)-\Theta_3^f\left(\frac{\pi(y_{01\diamond j}-y_{0ij})}{2b},e^{-\left(\frac{\pi}{b}\right)^2\eta_{yj}\tau}\right)+\right.$$

$$\left.+\Theta_3^f\left(\frac{\pi(y_{02\diamond j}+y_{0ij})}{2b},e^{-\left(\frac{\pi}{b}\right)^2\eta_{yj}\tau}\right)-\Theta_3^f\left(\frac{\pi(y_{01\diamond j}+y_{0ij})}{2b},e^{-\left(\frac{\pi}{b}\right)^2\eta_{yj}\tau}\right)\right\}\times$$

$$\times\left\{\Theta_3^{ff}\left(\frac{\pi(z_{02\diamond j}-z_{01ij})}{2(d_{j+1}-d_j)},e^{-\left(\frac{\pi}{d_{j+1}-d_j}\right)^2\eta_{zj}\tau}\right)-\Theta_3^{ff}\left(\frac{\pi(z_{01\diamond j}-z_{01ij})}{2(d_{j+1}-d_j)},e^{-\left(\frac{\pi}{d_{j+1}-d_j}\right)^2\eta_{zj}\tau}\right)-\right.$$

$$-\Theta_3^{ff}\left(\frac{\pi(z_{02\diamond j}+z_{01ij}-2d_j)}{2(d_{j+1}-d_j)},e^{-\left(\frac{\pi}{d_{j+1}-d_j}\right)^2\eta_{zj}\tau}\right)+\Theta_3^{ff}\left(\frac{\pi(z_{01\diamond j}+z_{01ij}-2d_j)}{2(d_{j+1}-d_j)},e^{-\left(\frac{\pi}{d_{j+1}-d_j}\right)^2\eta_{zj}\tau}\right)-$$

$$-\Theta_3^{ff}\left(\frac{\pi(z_{02\diamond j}-z_{02ij})}{2(d_{j+1}-d_j)},e^{-\left(\frac{\pi}{d_{j+1}-d_j}\right)^2\eta_{zj}\tau}\right)+\Theta_3^{ff}\left(\frac{\pi(z_{02\diamond j}-z_{01ij})}{2(d_{j+1}-d_j)},e^{-\left(\frac{\pi}{d_{j+1}-d_j}\right)^2\eta_{zj}\tau}\right)+$$

$$\left.+\Theta_3^{ff}\left(\frac{\pi(z_{02\diamond j}+z_{02ij}-2d_j)}{2(d_{j+1}-d_j)},e^{-\left(\frac{\pi}{d_{j+1}-d_j}\right)^2\eta_{zj}\tau}\right)-\Theta_3^{ff}\left(\frac{\pi(z_{01\diamond j}+z_{02ij}-2d_j)}{2(d_{j+1}-d_j)},e^{-\left(\frac{\pi}{d_{j+1}-d_j}\right)^2\eta_{zj}\tau}\right)\right\}d\tau+$$

$$+\frac{1}{(\phi c_t)_j a(y_{02\diamond j}-y_{01\diamond j})(z_{02\diamond j}-z_{01\diamond j})}\times$$

$$\times\int_0^t\int_0^a\int_0^b\left\{\psi_j(u,v,\tau)\left\{\Theta_3^f\left\{\frac{\pi(z_{02ij}-d_j)}{2(d_{j+1}-d_j)},e^{-\left(\frac{\pi}{d_{j+1}-d_j}\right)^2\eta_{zj}(t-\tau)}\right\}-\right.\right.$$

$$\left.-\Theta_3^f\left\{\frac{\pi(z_{01\diamond j}-d_j)}{2(d_{j+1}-d_j)},e^{-\left(\frac{\pi}{d_{j+1}-d_j}\right)^2\eta_{zj}(t-\tau)}\right\}\right\}-$$

$$-\psi_{j+1}(u,v,\tau)\left\{\Theta_4^f\left\{\frac{\pi(z_{02\diamond j}-d_j)}{2(d_{j+1}-d_j)},e^{-\left(\frac{\pi}{d_{j+1}-d_j}\right)^2\eta_{zj}(t-\tau)}\right\}-\right.$$

$$\left.\left.-\Theta_4^f\left\{\frac{\pi(z_{01\diamond j}-d_j)}{2(d_{j+1}-d_j)},e^{-\left(\frac{\pi}{d_{j+1}-d_j}\right)^2\eta_{zj}(t-\tau)}\right\}\right\}\right]\times$$

$$\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times$$

$$\times\left[\Theta_3^f\left\{\frac{\pi(y_{02\diamond j}-v)}{2b},e^{-\left(\frac{\pi}{b}\right)^2\eta_{yj}(t-\tau)}\right\}-\Theta_3^f\left\{\frac{\pi(y_{01\diamond j}-v)}{2b},e^{-\left(\frac{\pi}{b}\right)^2\eta_{yj}(t-\tau)}\right\}+\right.$$

$$\left.+\Theta_3^f\left\{\frac{\pi(y_{02\diamond j}+v)}{2b},e^{-\left(\frac{\pi}{b}\right)^2\eta_{yj}(t-\tau)}\right\}-\Theta_3^f\left\{\frac{\pi(y_{01\diamond j}+v)}{2b},e^{-\left(\frac{\pi}{b}\right)^2\eta_{yj}(t-\tau)}\right\}\right]dudvd\tau+$$

TABLE 7-continued

The spatial average pressure response of the rectangle $[(y_{02\diamond j}-y_{01\diamond j})(z_{02\diamond j}-z_{01\diamond j})]$, $i=\diamond$, $L_r+1\le\diamond\le M_r$ is given by.

$$
\begin{aligned}
&+\frac{1}{(\phi c_t)_j a(y_{02\diamond j}-y_{01\diamond j})(z_{02\diamond j}-z_{01\diamond j})}\times\\
&\times\int_0^t\int_0^b\int_0^{d_{j+1}-d_j}\left\{\psi_{0yzj}(v,w,\tau)\,\Theta_3\left(\frac{\pi x}{2a},e^{-\left(\frac{\pi}{a}\right)^2\eta_{xj}(t-\tau)}\right)-\psi_{ayzj}(v,w,\tau)\,\Theta_4\left(\frac{\pi x}{2a},e^{-\left(\frac{\pi}{a}\right)^2\eta_{xj}(t-\tau)}\right)\right\}\times\\
&\times\left[\Theta_3^{\int}\left\{\frac{\pi(y_{02\diamond j}-v)}{2b},e^{-\left(\frac{\pi}{b}\right)^2\eta_{yj}(t-\tau)}\right\}-\Theta_3^{\int}\left\{\frac{\pi(y_{01\diamond j}-v)}{2b},e^{-\left(\frac{\pi}{b}\right)^2\eta_{yj}(t-\tau)}\right\}+\right.\\
&\left.+\Theta_3^{\int}\left\{\frac{\pi(y_{02\diamond j}+v)}{2b},e^{-\left(\frac{\pi}{b}\right)^2\eta_{yj}(t-\tau)}\right\}-\Theta_3^{\int}\left\{\frac{\pi(y_{01\diamond j}+v)}{2b},e^{-\left(\frac{\pi}{b}\right)^2\eta_{yj}(t-\tau)}\right\}\right]\times\\
&\times\left\{\Theta_3^{\int}\left\{\frac{\pi(z_{02\diamond j}-d_j-w)}{2(d_{j+1}-d_j)},e^{-\left(\frac{\pi}{d_{j+1}-d_j}\right)^2\eta_{zj}(t-\tau)}\right\}-\Theta_3^{\int}\left\{\frac{\pi(z_{01\diamond j}-d_j-w)}{2(d_{j+1}-d_j)},e^{-\left(\frac{\pi}{d_{j+1}-d_j}\right)^2\eta_{zj}(t-\tau)}\right\}+\right.\\
&\left.\times\Theta_3^{\int}\left\{\frac{\pi(z_{02\diamond j}-d_j+w)}{2(d_{j+1}-d_j)},e^{-\left(\frac{\pi}{d_{j+1}-d_j}\right)^2\eta_{zj}(t-\tau)}\right\}-\Theta_3^{\int}\left\{\frac{\pi(z_{01\diamond j}-d_j+w)}{2(d_{j+1}-d_j)},e^{-\left(\frac{\pi}{d_{j+1}-d_j}\right)^2\eta_{zj}(t-\tau)}\right\}\right\}dv\,dw\,d\tau+\\
&+\frac{1}{(\phi c_t)_j a(y_{02\diamond j}-y_{01\diamond j})(z_{02\diamond j}-z_{01\diamond j})}\times\\
&\times\int_0^t\int_0^a\int_0^{d_{j+1}-d_j}\left\{\psi_{x0zj}(v,w,\tau)\left\{\Theta_3^{\int}\left(\frac{\pi y_{02\diamond j}}{2b},e^{-\left(\frac{\pi}{b}\right)^2\eta_{yj}(t-\tau)}\right)-\Theta_3^{\int}\left(\frac{\pi y_{01\diamond j}}{2b},e^{-\left(\frac{\pi}{b}\right)^2\eta_{yj}(t-\tau)}\right)\right\}-\right.\\
&\left.-\psi_{xbzj}(v,w,\tau)\left\{\Theta_4^{\int}\left(\frac{\pi y_{02\diamond j}}{2b},e^{-\left(\frac{\pi}{b}\right)^2\eta_{yj}(t-\tau)}\right)-\Theta_4^{\int}\left(\frac{\pi y_{01\diamond j}}{2b},e^{-\left(\frac{\pi}{b}\right)^2\eta_{yj}(t-\tau)}\right)\right\}\right\}\times\\
&\times\left[\Theta_3\left\{\frac{\pi(x-u)}{2a},e^{-\left(\frac{\pi}{a}\right)^2\eta_{xj}(t-\tau)}\right\}+\Theta_3\left\{\frac{\pi(x+u)}{2a},e^{-\left(\frac{\pi}{a}\right)^2\eta_{xj}(t-\tau)}\right\}\right]\times\\
&\times\left\{\Theta_3^{\int}\left\{\frac{\pi(z_{02\diamond j}-d_j-w)}{2(d_{j+1}-d_j)},e^{-\left(\frac{\pi}{d_{j+1}-d_j}\right)^2\eta_{zj}(t-\tau)}\right\}-\Theta_3^{\int}\left\{\frac{\pi(z_{01\diamond j}-d_j-w)}{2(d_{j+1}-d_j)},e^{-\left(\frac{\pi}{d_{j+1}-d_j}\right)^2\eta_{zj}(t-\tau)}\right\}+\right.\\
&\left.\times\Theta_3^{\int}\left\{\frac{\pi(z_{02\diamond j}-d_j+w)}{2(d_{j+1}-d_j)},e^{-\left(\frac{\pi}{d_{j+1}-d_j}\right)^2\eta_{zj}(t-\tau)}\right\}-\Theta_3^{\int}\left\{\frac{\pi(z_{01\diamond j}-d_j+w)}{2(d_{j+1}-d_j)},e^{-\left(\frac{\pi}{d_{j+1}-d_j}\right)^2\eta_{zj}(t-\tau)}\right\}\right\}dv\,dw\,d\tau+\\
&+\frac{1}{2a(y_{02\diamond j}-y_{01\diamond j})(z_{02\diamond j}-z_{01\diamond j})}\times\\
&\times\int_0^{d_{j+1}-d_j}\int_0^b\int_0^a\varphi_j(u,v,w+d_j)\left[\left\{\Theta_3\left(\frac{\pi(x-u)}{2a},e^{-\left(\frac{\pi}{a}\right)^2\eta_{xj}t}\right)+\Theta_3\left(\frac{\pi(x+u)}{2a},e^{-\left(\frac{\pi}{a}\right)^2\eta_{xj}t}\right)\right\}\times\right.\\
&\times\left[\Theta_3^{\int}\left\{\frac{\pi(y_{02\diamond j}-v)}{2b},e^{-\left(\frac{\pi}{b}\right)^2\eta_{yj}(t-\tau)}\right\}-\Theta_3^{\int}\left\{\frac{\pi(y_{01\diamond j}-v)}{2b},e^{-\left(\frac{\pi}{b}\right)^2\eta_{yj}(t-\tau)}\right\}+\right.\\
&\left.+\Theta_3^{\int}\left\{\frac{\pi(y_{02\diamond j}+v)}{2b},e^{-\left(\frac{\pi}{b}\right)^2\eta_{yj}(t-\tau)}\right\}-\Theta_3^{\int}\left\{\frac{\pi(y_{01\diamond j}+v)}{2b},e^{-\left(\frac{\pi}{b}\right)^2\eta_{yj}(t-\tau)}\right\}\right]\times\\
&\times\left\{\Theta_3^{\int}\left\{\frac{\pi(z_{02\diamond j}-d_j-w)}{2(d_{j+1}-d_j)},e^{-\left(\frac{\pi}{d_{j+1}-d_j}\right)^2\eta_{zj}t}\right\}-\Theta_3^{\int}\left\{\frac{\pi(z_{01\diamond j}-d_j-w)}{2(d_{j+1}-d_j)},e^{-\left(\frac{\pi}{d_{j+1}-d_j}\right)^2\eta_{zj}t}\right\}+\right.\\
&\left.\times\Theta_3^{\int}\left\{\frac{\pi(z_{02\diamond j}-d_j+w)}{2(d_{j+1}-d_j)},e^{-\left(\frac{\pi}{d_{j+1}-d_j}\right)^2\eta_{zj}t}\right\}-\Theta_3^{\int}\left\{\frac{\pi(z_{01\diamond j}-d_j+w)}{2(d_{j+1}-d_j)},e^{-\left(\frac{\pi}{d_{j+1}-d_j}\right)^2\eta_{zj}t}\right\}\right\}du\,dv\,dw
\end{aligned}
$$

The nomenclatures used in TABLES 3 through 7 are listed in TABLE 8 below.

TABLE 8

| Nomenclature |
|---|
| a Width of the layer, m. |
| b Bredth of the layer, m. |
| $c_t$ Compressibility, $P_a^{-1}$. |
| $\phi$ Porosity, fraction |
| $d_{j+1}-d_j$ Layer thickness, m. |
| $k_x$, $k_y$, $k_z$ Permeability in the x, y and z direction, $m^2$ |
| $\mu$ Viscosity, $P_a\cdot s$. |

TABLE 8-continued

| Nomenclature |
|---|
| $\eta_{xj} = \left(\frac{k_x}{\phi c_t \mu}\right)_j$, $\eta_{yj} = \left(\frac{k_y}{\phi c_t \mu}\right)_j$ and $\eta_{zj} = \left(\frac{k_z}{\phi c_t \mu}\right)_j$ Diffusion coefficients |
| $p_j$ Pressure in the jth layer, $P_a$. |
| $q_{ij}$ Production rate of the ith well or fracture in the jth layer, $m^3/s$. |
| t Time, s. |
| $t_{0ij}$ Stat time of production of the ith well or fracture in the jth layer, s. |
| $\theta_{0ij}$ The inclination to the x − y plane of the ith well or fracture in the jth layer |
| $\gamma_{0j}$ The intercept to the z axis of the ith well or fracture in the jth layer |
| $U(t - t_0) = \begin{cases} 0 & t < t_0 \\ 1 & t > t_0 \end{cases}$ Heaviside's Unit step function s Laplace variable |
| $\ni_m = \begin{cases} \frac{1}{2} & m = 0 \\ 1 & m = 1, 2, 3, \ldots \end{cases}$ |
| $\Theta_3(\pi x, e^{-\pi^2 t}) = \begin{cases} 1 + 2\sum_{n=1}^{\infty} e^{-n^2\pi^2 t}\cos(2n\pi x) & e^{-\pi^2 t} > \frac{1}{\pi} \\ \frac{1}{\sqrt{\pi t}}\sum_{n=-\infty}^{\infty} e^{-\frac{(x+n)^2}{t}} & e^{-\pi^2 t} \le \frac{1}{\pi} \end{cases}$ Eliptic theta function of the third kind |
| $\Theta_3^{\int}(\pi x, e^{-\pi^2 t}) = \int_0^x \Theta_3(\pi u, e^{-\pi^2 t})du = \begin{cases} x + \frac{1}{\pi}\sum_{n=1}^{\infty}\frac{e^{-n^2\pi^2 t}}{n}\sin(2n\pi x) & e^{-\pi^2 t} > \frac{1}{\pi} \\ \frac{1}{2}\sum_{n=-\infty}^{\infty}\left\{\mathrm{erf}\left(\frac{x+n}{\sqrt{t}}\right) - \mathrm{erf}\left(\frac{n}{\sqrt{t}}\right)\right\} & e^{-\pi^2 t} \le \frac{1}{\pi} \end{cases}$ Integral of Eliptic theta function of the third kind |
| $\Theta_3^{\int\int}(\pi x, e^{-\pi^2 t}) = \int_0^x \Theta_3^{\int}(\pi u, e^{-\pi^2 t})du = \begin{cases} \frac{x^2}{2} + \frac{1}{2\pi^2}\sum_{n=1}^{\infty}\frac{e^{-n^2\pi^2 t}}{n^2}\{1 - \cos(2n\pi x)\} & e^{-\pi^2 t} > \frac{1}{\pi} \\ \frac{1}{2}\sum_{n=-\infty}^{\infty}\left\{(x+n)\,\mathrm{erf}\left(\frac{x+n}{\sqrt{t}}\right) + \sqrt{\frac{t}{\pi}}\left(e^{-\frac{(x+n)^2}{t}} - e^{-\frac{n^2}{t}}\right) - n\,\mathrm{erf}\left(\frac{n}{\sqrt{t}}\right)\right\} & e^{-\pi^2 t} \le \frac{1}{\pi} \end{cases}$ Second integral of Elliptic theta function of the third kind. |

Figure 9:
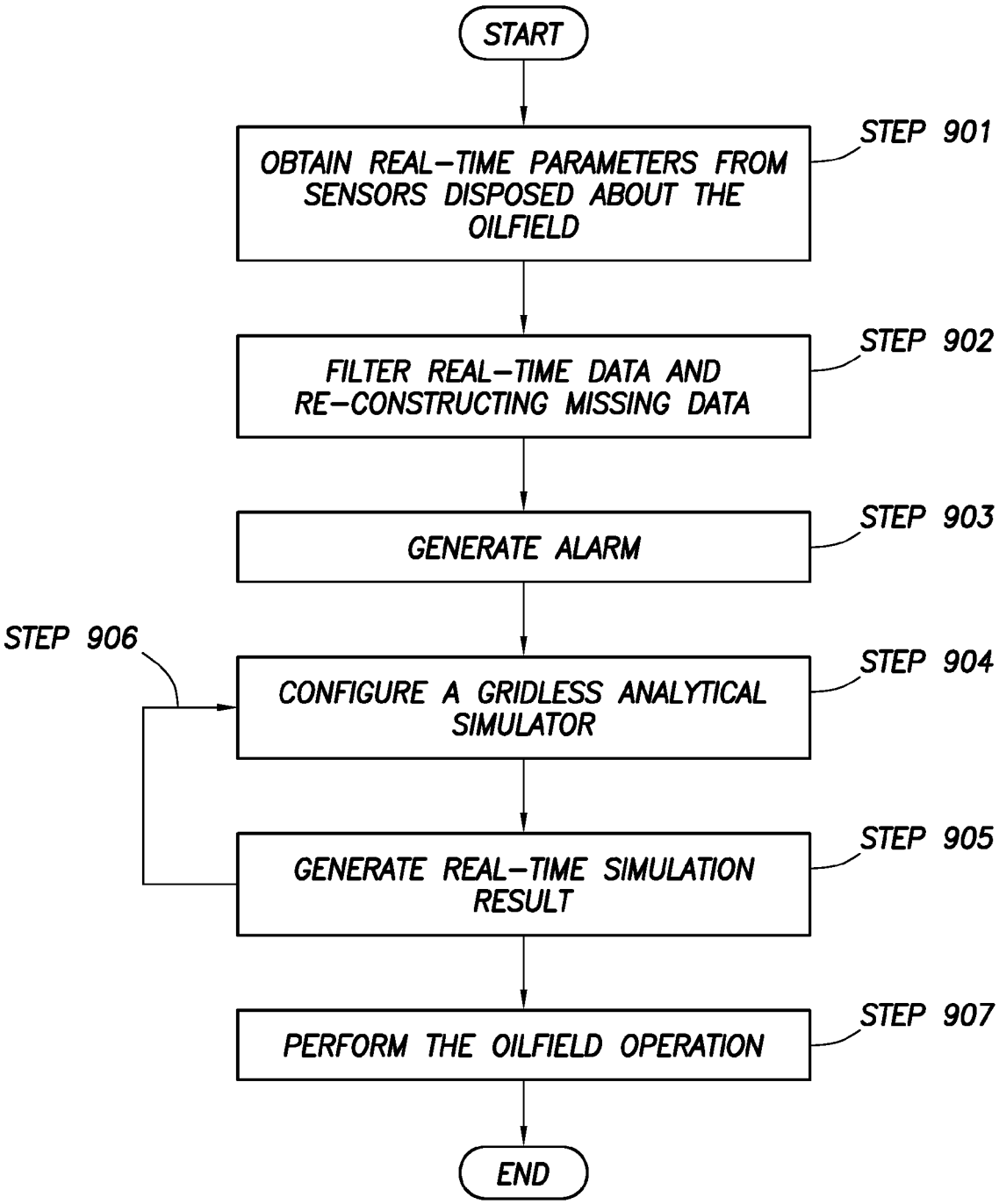
FIG. 9 is a flow chart of a method to perform an oilfield operation using the real-time analytical simulator.

FIG. 9 is a flow chart of a method to perform an oilfield operation using the real-time analytical simulator. The oilfield operation is performed in an oilfield, such as the oilfield (300) depicted in FIG. 3 above. This method involves using the gridless analytical simulator, such as described with respect to FIG. 8, to generate real-time simulation results for performing the oilfield operation.

In Step 901, multiple real-time parameters are obtained from sensors disposed about the oilfield (e.g., oilfield (300)). The oilfield may include multiple wellsites, such as depicted in FIG. 3 above. The multiple real-time parameters include, at least, real-time flow rate data, real-time pressure data, or real-time temperature data of the wellbore (e.g., wellbore (436) of FIG. 5). These real-time data may be monitored by a user (e.g., the surveillance engineer). In some examples, there may be missing periods of the real-time measurement, which may be supplemented with data re-construction, for example based on tubing head or bottom hole pressure measurement (Step 902). The real-time pressure data and/or the real-time flow rate data (if available) are filtered, for example by using a wavelet decomposition technique to remove outliers, noise, and identify transients (Step 902). The large amount of real-time raw data may be sampled to reduce to the filtered data to a manageable amount, while retaining all the relevant characteristics of the original larger data set.

A set of alarm conditions is calculated based on the real-time data after filtering (Step 903). The alarms may include, for example, a drawdown alarm, a downtime alarm, etc. If the alarm is triggered, detailed diagnostics are performed thereafter. For example, drawdown pressure may be selected as the alarm parameter where the running maximum and running minimum values for pressure are calculated for each hour. These running averages are reset at the end of each hour. The running maximum, minimum, and average of the pressure data are also calculated for the day. The running averages are reset at 24:00:00 each day. Static reservoir pressure (Pr) in the vicinity of the well bore is estimated and entered at predefined intervals, typically every 48 to 72 hours.

Occasionally, previously estimated Pr values are re-estimated, in which case other previously estimated values must be updated. Drawdown pressures are calculated by subtracting the gauge pressure (Pwg) from the static reservoir pressure (Pr). Limiting values for gauge pressure are calculated or estimated and entered at predefined intervals, typically 48 to 72 hours.

The sources are bubblepoint limits, sand management limits and drawdown limits. Bubblepoint limits are absolute limits for the bottomhole pressure; sand management limits are functions of the static reservoir pressure; drawdown limits are a fixed offset from the static reservoir pressure. Occasionally, these limits are recomputed, and the previous values must be updated.

Drawdown surveillance is performed each hour by comparing the hourly average, running maxima, running minima, and running averages to the appropriate limiting values for gauge pressure. Automatic alerts (e.g., indicated in color yellow) are generated whenever the gauge pressure is within a defined variance from the limit value.

A surveillance engineer analyzes automatic alerts and sets a validation condition for each alert (e.g., Green: "No action;" Yellow: "Monitor closely:" Red: "Action recommended") with an optional comment. Green measurements indicate that a component or system is performing within specified bounds and requires no action. Essentially, green-light data can be ignored. Yellow is a low level alarm (or alert), meaning the sensor measurement is approaching upper or lower bounds. Red is an alarm (or critical level alert), which indicates that the component has been shut down because sensor measurements fall outside of specified ranges. The yellow alert is one key to asset management, helping operators avoid deferred production. Operators take proactive measures on yellow alerts, and are reactive to red alarms. Alternatively, other colors may also be used in lieu of the Green/Yellow/Red system.

While the drawdown pressure can be directly calculated from the measured real-time data in the above example, wellbore skin may be selected as the alarm parameter in another example where the running maximum and running minimum values for wellbore skin are calculated on a regular basis using the gridless simulator. Within the gridless analytical simulator, many parameters may be used to configure an appropriate model for simulating the oilfield (e.g., the oilfield (300)) (Step 904). For example, static parameters obtained through geological surveys (e.g. as depicted in FIG. 1 and FIG. 3 above) may be used to set up the initial and boundary conditions described in TABLE 1 above.

Based on the configurations of the wellsites (e.g., vertical well, horizontal well, deviated well, fractured well, etc.), the gridless analytical simulator is configured using equations shown in TABLES 3 through 7 above. For example, the coefficients in equation (0.13) are appropriately determined for each well configuration. Preferably, the model is further identified by using a neural network method based on, for example rate of change of the real-time pressure data. Additionally, a history matching method of key parameters, such as the historic value of the reservoir pressure, well skin, effective permeability, and well productivity may be used to update the model further.

Once the model is identified and the simulator is configured, real-time simulation results are then generated, for example based on equations described in TABLES 3-7 above (Step 905). The real-time simulation results include a prediction of the production rates and reservoir pressure over time. The real-time simulation results can be delivered in an automatic workflow with real-time plotting of the key parameters (e.g., the reservoir pressure, well skin, effective permeability, well productivity, etc.) and alarm setting based on pre-determined criteria. The model is automatically updated when the predicted performance diverges from the actual performance by more than a pre-determined limit (Step 906).

In Step 907, the oilfield operation is performed based on the real-time simulation results. The gridless analytical simulator may provide information indicating problems at the wellsites that require action. The simulators may also indicate that adjustments in the oilfield operation may be made to improve efficiency, or correct problems. Well management strategy may be adjusted to define different development scenarios to be included in the integrated simulation run.

The steps of portions or all of the process may be repeated as desired. Repeated steps may be selectively performed until satisfactory results achieved. For example, steps may be repeated after adjustments are made. This may be done to update the simulator and/or to determine the impact of changes made.

The data input, coupling, layout, and constraints defined in the simulation provide flexibility to the simulation process. These factors of the various simulators are selected to meet the requirements of the oilfield operation. Any combination of simulators may be selectively linked to create the overall oilfield simulation. The process of linking the simulators may be re-arranged and simulations repeated using different configurations. Depending on the type of coupling and/or the arrangement of simulators, the oilfield simulation may be selected to provide the desired results. Various combinations may be tried and compared to determine the best outcome. Adjustments to the oilfield simulation may be made based on the oilfield, the simulators, the arrangement, and other factors. The process may be repeated as desired.

It will be understood from the foregoing description that various modifications and changes may be made in the preferred and alternative embodiments of the present invention without departing from its true spirit. For example, the boundary conditions of the multi-layer model of FIG. 8 and TABLE 1 may be varied, the specific formulation of the analytic solutions of TABLES 2-7 and other equations/formulas described throughout this paper may be adjusted or otherwise modified, the simulators, couplings, and arrangement of the system may be selected to achieve the desired simulation. The simulations may be repeated according to the various configurations, and the results compared and/or analyzed.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method of performing an oilfield operation of an oilfield having at least one wellsite, each wellsite having a wellbore penetrating a subterranean formation for extracting fluid from an underground reservoir therein, the method comprising:

obtaining a plurality of real-time parameters from a plurality of sensors disposed about the oilfield, the oilfield receiving command signals from a surface unit to perform the oilfield operation, wherein the plurality of real-time parameters comprise real-time flow rate data and real-time pressure data of the wellbore;

identifying a simulation session marked by identified transients in the plurality of real-time parameters, wherein the identified transients are identified using wavelet decomposition;

identifying, within the simulation session, a first time period during which the real-time flow rate data is not available and a second time period during which the real-time pressure data is not available;

obtaining offline flow rate data for the first time period by performing flow rate re-construction based on at least one selected from a group consisting of tubing head pressure measurement and bottom hole pressure measurement;

obtaining offline pressure data for the second time period based on historical data and spot measurement;

configuring, in the surface unit, a gridless analytical simulator for the simulation session to simulate the underground reservoir based on the plurality of real-time parameters supplemented by the offline flow rate data during the first time period and the offline pressure data during the second time period;

generating real-time simulation results of the underground reservoir and the at least one wellsite in real-time using the gridless analytical simulator; and sending, from the surface unit, the command signals to the oilfield to manage the underground reservoir in real time by performing the oilfield operation, wherein the command signals are based on the real-time simulation results.

2. The method of claim 1, wherein at least a portion of the oilfield is modeled as a vertically stacked system of a plurality of layers using a plurality of analytic solutions corresponding to the plurality of layers, and wherein the gridless analytical simulator is based on coupling the plurality of analytic solutions to account for crossflow among the plurality of layers.

3. The method of claim 2, wherein a flux field at an interface of the plurality of layers is obtained by solving a Fredholm integral equation, and wherein a time evolution of the flux field is governed by a Volterra integral equation.

4. The method of claim 1, wherein the oilfield comprises a plurality of wellsites, and wherein the gridless analytical model is configured to simulate an interference effect from the plurality of wellsites.

5. The method of claim 1, wherein the real-time simulation results are generated using at least one selected from a group consisting of a no-flow boundary condition, and a constant pressure boundary condition.

6. The method of claim 1, wherein configuring the gridless analytical simulator comprises identifying a reservoir model based on at least one selected from a group consisting of a neural network method, a rate of change of the real-time pressure data, and a geological parameter.

7. The method of claim 1, wherein the at least one wellsite comprises at least one selected from a group consisting of a horizontal well, a vertical well, and a deviated well, and wherein the underground reservoir comprises a plurality of heterogeneous layers.

8. The method of claim 1, wherein the underground reservoir is a naturally fractured reservoir.

9. The method of claim 1, wherein hydraulic fracturing is performed for the at least one wellsite.

10. The method of claim 9, wherein the wellbore comprises at least one selected from a group consisting of a finite conductivity hydraulic fracture and an infinite conductivity hydraulic fracture.

11. The method of claim 1, wherein the wellbore is modeled as a line source in the gridless analytical simulator.

12. The method of claim 11, further comprising:

simulating at least one selected from a group consisting of a wellbore storage effect and a finite wellbore radius by applying corrections to the gridless analytical simulator.

13. The method of claim 1, wherein the real-time simulation results comprises at least one selected from a group consisting of reservoir pressure, flow rate, well skin, effective permeability, fracturing performance, well drainage area, compartmentalization, and well productivity.

14. The method of claim 1, wherein performing the oilfield operation comprises at least one selected from a group consisting of anticipating an event, identifying an event, performing real-time diagnostics, performing real-time interpretation, performing real-time decision making, performing real-time corrective action, and forecasting performance of the wellsite and the reservoir in real-time.

15. The method of claim 1, further comprising:

generating an alert based on comparing at least one of the plurality of real-time parameters to a pre-determined limit; and classifying the alert according to a plurality of pre-determined alert levels, wherein an alert level of the plurality of pre-determined alert levels dictates at least one selected from a group consisting of a proactive action and a reactive action.

16. A non-transitory computer readable medium, embodying instructions executable by a computer to perform method steps for an oilfield operation, the oilfield having at least one wellsite, each of the at least one wellsite having a wellbore penetrating a subterranean formation for extracting fluid from an underground reservoir therein, the instructions comprising functionality to:

obtain a plurality of real-time parameters from a plurality of sensors disposed about the oilfield, the oilfield receiving command signals from a surface unit to perform the oilfield operation, wherein the plurality of real-time parameters comprise at least one selected from a group consisting of real-time flow rate data and real-time pressure data of the wellbore;

identify a simulation session marked by identified transients in the plurality of real-time parameters, wherein the identified transients are identified using wavelet decomposition;

identify a first time period during which the real-time flow rate data is not available and a second time period during which the real-time pressure data is not available;

obtain offline flow rate data for the first time period by performing flow rate re-construction based on at least one selected from a group consisting of tubing head pressure measurement and bottom hole pressure measurement;

obtain offline pressure data for the second time period based on historical data and spot measurement;

configure, in the surface unit, a gridless analytical simulator for the simulation session to simulate the underground reservoir based on the plurality of real-time parameters supplemented by the offline flow rate data and the offline pressure data during the first time period and the second time period, respectively; and generate real-time simulation results of the reservoir and the at least one wellsite in real-time using the gridless analytical simulator, wherein the oilfield operation is performed to manage the underground reservoir in real time by receiving the command signals that are generated based on the real-time simulation results.

17. The non-transitory computer readable medium of claim 16, wherein at least a portion of the oilfield is modeled as a vertically stacked system of a plurality of layers using a plurality of analytic solutions corresponding to the plurality of layers, and wherein the gridless analytical simulator is based on coupling the plurality of analytic solutions to account for crossflow among the plurality of layers.

18. The non-transitory computer readable medium of claim 16, wherein a flux field at an interface of the plurality of layers is obtained by solving a Fredholm integral equation, and wherein a time evolution of the flux field is governed by a Volterra integral equation.

19. The non-transitory computer readable medium of claim 16, wherein the oilfield comprises a plurality of wellsites, and wherein the gridless analytical model is configured to simulate an interference effect from the plurality of wellsites.

20. The non-transitory computer readable medium of claim 16, wherein the real-time simulation results are generated using at least one selected from a group consisting of a no-flow boundary condition, and a constant pressure boundary condition.

21. The non-transitory computer readable medium of claim 16, wherein configuring the gridless analytical simulator comprises identifying a reservoir model based on at least one selected from a group consisting of a neural network method, a rate of change of the real-time pressure data, and a geological parameter.

22. The non-transitory computer readable medium of claim 16, wherein the at least one wellsite comprises at least one selected from a group consisting of a horizontal well, a vertical well, and a deviated well, and wherein the underground reservoir comprises a plurality of heterogeneous layers.

23. The non-transitory computer readable medium of claim 16, wherein the underground reservoir is a naturally fractured reservoir.

24. The non-transitory computer readable medium of claim 16, wherein hydraulic fracturing is performed for the at least one wellsite.

25. The non-transitory computer readable medium of claim 24, wherein the wellbore comprises at least one selected from a group consisting of a finite conductivity hydraulic fracture and an infinite conductivity hydraulic fracture.

26. The non-transitory computer readable medium of claim 16, wherein the wellbore is modeled as a line source in the gridless analytical simulator.

27. The non-transitory computer readable medium of claim 26, the instructions further comprising functionality to:

simulating at least one selected from a group consisting of a wellbore storage effect and a finite wellbore radius by applying corrections to the gridless analytical simulator.

28. The non-transitory computer readable medium of claim 16, wherein the real-time simulation results comprises at least one selected from a group consisting of reservoir pressure, flow rate, well skin, effective permeability, fracturing performance, well drainage area, compartmentalization, and well productivity.

29. The non-transitory computer readable medium of claim 16, wherein performing the oilfield operation comprises at least one selected from a group consisting of anticipating an event, identifying an event, performing real-time diagnostics, performing real-time interpretation, performing real-time decision making, performing real-time corrective action, and forecasting performance of the wellsite and the reservoir in real-time.

30. The non-transitory computer readable medium of claim 16, the instructions further comprising functionality to:

generating an alert based on comparing at least one of the plurality of real-time parameters to a pre-determined limit; and classifying the alert according to a plurality of pre-determined alert levels, wherein an alert level of the plurality of pre-determined alert levels dictates at least one selected from a group consisting of a proactive action and a reactive action.

* * * * *